US006390578B1

(12) United States Patent
Koitabashi et al.

(10) Patent No.: US 6,390,578 B1
(45) Date of Patent: May 21, 2002

(54) INK CONTAINER, INK AND INK JET RECORDING APPARATUS USING INK CONTAINER

(75) Inventors: Noribumi Koitabashi; Masami Ikeda, both of Yokohama; Sadayuki Sugama, Tsukuba; Naohito Asai; Hiromitsu Hirabayashi, both of Yokohama; Tsutomu Abe, Isehara; Hiroshi Sato, Yokohama; Shigeyasu Nagoshi, Kawasaki; Eiichiro Shimizu, Urawa; Masahiko Higuma, Tohgane; Yuji Akiyama, Yokohama; Hitoshi Sugimoto, Kawasaki; Miyuki Matsubara, Tokyo; Shinichi Sato, Kawasaki; Fumihiro Gotoh, Yokohama; Masaya Uetsuki, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/184,038

(22) Filed: Nov. 2, 1998

Related U.S. Application Data

(62) Division of application No. 08/612,299, filed on Mar. 7, 1996, which is a division of application No. 08/094,317, filed on Jul. 21, 1993, now Pat. No. 5,509,140.

(30) Foreign Application Priority Data

| | | |
|---|---|---|
| Jul. 24, 1992 | (JP) | 4-198661 |
| Jul. 24, 1992 | (JP) | 4-198680 |
| Jul. 24, 1992 | (JP) | 4-198681 |
| Jul. 24, 1992 | (JP) | 4-198733 |
| Feb. 4, 1993 | (JP) | 5-017562 |
| May 25, 1993 | (JP) | 5-122618 |

(51) Int. Cl.[7] ..... B41J 2/195; B41J 2/175
(52) U.S. Cl. ..... 347/7; 347/85; 347/86
(58) Field of Search ..... 347/7, 85, 86, 347/19, 87, 49, 60, 23, 65, 6

(56) References Cited

U.S. PATENT DOCUMENTS

| | | | | |
|---|---|---|---|---|
| 4,017,871 A | | 4/1977 | Hubbard | 346/140 R |
| 4,119,034 A | | 10/1978 | Wax | 101/366 |
| 4,202,267 A | * | 5/1980 | Heinzl et al. | 347/7 |
| 4,313,124 A | | 1/1982 | Hara | 346/140 R |
| 4,336,767 A | | 6/1982 | Wade | 118/264 |
| 4,345,262 A | | 8/1982 | Shirato et al. | 346/140 R |
| 4,395,476 A | | 7/1983 | Kanbe et al. | 430/102 |
| 4,441,422 A | | 4/1984 | Dreeben | 101/125 |
| 4,459,600 A | | 7/1984 | Sato et al. | 346/140 R |
| 4,463,359 A | | 7/1984 | Ayata et al. | 346/1.1 |
| 4,509,062 A | | 4/1985 | Low et al. | 346/140 R |
| 4,530,961 A | | 7/1985 | Nguyen et al. | 347/100 |
| 4,545,694 A | | 10/1985 | Nonomiya et al. | 400/124 |

(List continued on next page.)

FOREIGN PATENT DOCUMENTS

| | | | |
|---|---|---|---|
| EP | 139508 | 5/1985 | |
| EP | 320165 | 6/1989 | |
| EP | 322131 | 6/1989 | 347/7 |

*Primary Examiner*—John E. Bender, Jr.
*Assistant Examiner*—Charles W. Stewart, Jr.
(74) *Attorney, Agent, or Firm*—Fitzpatrick, Cella, Harper & Scinto

(57) ABSTRACT

An ink containing apparatus for containing ink includes a negative pressure producing material; a first container for containing the negative pressure producing material, the first container having an air vent and a supply port for supplying the ink out; a second container for containing ink; a communication part for communication between bottom portions of the first and second containers; and ribs for introducing ambient air adjacent the air vent for introducing air into the communication part.

20 Claims, 45 Drawing Sheets

U.S. PATENT DOCUMENTS

| | | | | | |
|---|---|---|---|---|---|
| 4,558,333 | A | | 12/1985 | Sugitani et al. | 347/87 |
| 4,571,599 | A | | 2/1986 | Rezanka | 346/140 R |
| 4,608,577 | A | | 8/1986 | Hori | 346/140 R |
| 4,630,758 | A | | 12/1986 | Mutoh | 222/189 |
| 4,677,448 | A | * | 6/1987 | Mizusawa et al. | 347/7 |
| 4,723,129 | A | | 2/1988 | Endo et al. | 346/1.1 |
| 4,740,796 | A | | 4/1988 | Endo et al. | 346/1.1 |
| 4,771,295 | A | | 9/1988 | Baker et al. | 346/1.1 |
| 4,794,409 | A | | 12/1988 | Cowger et al. | 346/140 R |
| 4,920,362 | A | | 4/1990 | Cowger | 346/140 R |
| 4,994,824 | A | | 2/1991 | Winslow | 347/87 |
| 4,994,828 | A | | 2/1991 | Smart | 347/87 |
| 5,025,271 | A | | 6/1991 | Baker et al. | 346/140 |
| 5,095,321 | A | | 3/1992 | Saito et al. | 346/140 R |
| 5,103,243 | A | | 4/1992 | Cowger | 346/1.1 |
| 5,119,115 | A | | 6/1992 | Buat et al. | 347/86 |
| 5,155,502 | A | | 10/1992 | Kimura et al. | 346/140 R |
| 5,157,421 | A | | 10/1992 | Kitahara et al. | 347/86 |
| 5,162,817 | A | | 11/1992 | Tajika et al. | 346/140 R |
| 5,182,581 | A | | 1/1993 | Kashimura et al. | 347/87 |
| 5,221,148 | A | | 6/1993 | Suzuki et al. | 400/124 |
| 5,221,334 | A | | 6/1993 | Ma et al. | 347/100 |
| 5,233,369 | A | | 8/1993 | Carlotta et al. | 347/86 |
| 5,237,342 | A | | 8/1993 | Saikawa et al. | 400/124 |
| 5,262,802 | A | | 11/1993 | Karita et al. | 347/87 |
| 5,430,471 | A | | 7/1995 | Nakajima et al. | 347/87 |
| 5,489,932 | A | | 2/1996 | Cheschin et al. | 347/87 |
| 5,491,501 | A | | 2/1996 | Dietl et al. | 347/86 |
| 5,509,140 | A | | 4/1996 | Koitabashi et al. | 347/86 |
| 5,619,238 | A | | 4/1997 | Higuma et al. | 347/86 |
| 5,621,446 | A | | 4/1997 | Tanaka et al. | 347/85 |
| 5,657,058 | A | | 8/1997 | Lin | 347/87 |
| 5,657,065 | A | | 8/1997 | Mochizuki et al. | 347/86 |

FOREIGN PATENT DOCUMENTS

| | | |
|---|---|---|
| EP | 373302 | 6/1990 |
| EP | 378240 | 7/1990 |
| EP | 381392 | 8/1990 |
| EP | 406983 | 1/1991 |
| EP | 419192 | 3/1991 |
| EP | 486309 | 5/1992 |
| EP | 488292 | 6/1992 |
| EP | 488829 | 6/1992 |
| EP | 490579 | 6/1992 |
| EP | 493058 | 7/1992 |
| EP | 529625 | 3/1993 |
| EP | 536980 | 4/1993 |
| FR | 2229320 | 12/1974 |
| JP | 50-84311 | 8/1975 |
| JP | 54-56847 | 5/1979 |
| JP | 55-70775 | 5/1980 |
| JP | 55-161873 | 12/1980 |
| JP | 56-67289 | 6/1981 |
| JP | 2-39213 | 1/1982 |
| JP | 57-73623 | 5/1982 |
| JP | 59-68985 | 5/1984 |
| JP | 59-98857 | 6/1984 |
| JP | 59-123670 | 6/1984 |
| JP | 61-22952 | 7/1984 |
| JP | 63-13749 | 1/1988 |
| JP | 63-87242 | 4/1988 |
| JP | 63-165467 | 7/1988 |
| JP | 64-35215 | 6/1989 |
| JP | 2-522 | 1/1990 |
| JP | 2-34351 | 2/1990 |
| JP | 2-55184 | 2/1990 |
| JP | 2-214666 | 8/1990 |
| JP | 7-214666 | 8/1990 |
| JP | 4-156339 | 5/1992 |
| JP | 5-96743 | 4/1993 |

* cited by examiner

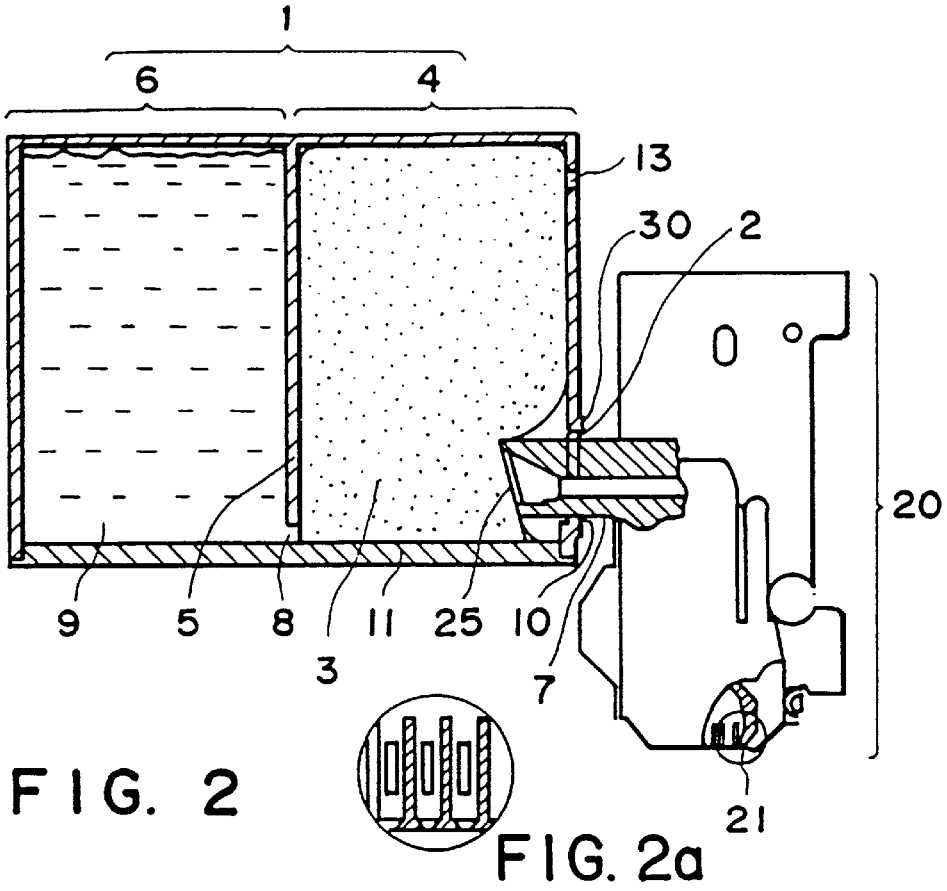
FIG. 2
FIG. 2a
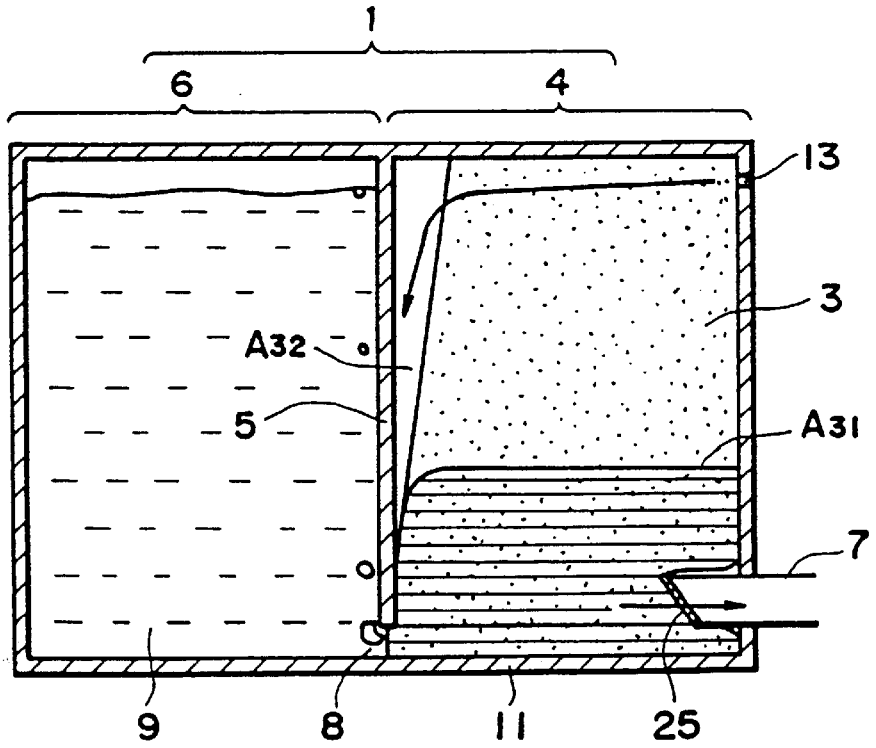
FIG. 3

INK CONTAINER, INK AND INK JET RECORDING APPARATUS USING INK CONTAINER

This application is a division of application Ser. No. 08/612,299, filed Mar. 7, 1996, allowed, which is a division of application Ser. No. 08/094,317 filed Jul. 21, 1993, which issued as U.S. Pat. No. 5,509,140 on Apr. 16, 1996.

FIELD OF THE INVENTION AND RELATED ART

The present invention relates to an ink cartridge for containing liquid ink that can be mounted to and removed from a bubble jet printer for supplying the ink to an ink jet print head.

The ink container used with an ink jet recording apparatus is required to be capable of properly supplying an amount of ink corresponding to the amount of ink ejected from a recording head during the recording operation and to be free of ink leakage through the ejection outlets of the recording head when the recording operation is not executed.

When the ink container is of an exchangeable type, it is required that the ink container can be easily mounted or demounted relative to the recording apparatus without ink leakage, and that the ink can be supplied to the recording head with certainty.

A first conventional example of an ink container usable with the ink jet recording apparatus is disclosed which Japanese Laid-Open Patent Application No. 87242/1988, in which the ink jet recording cartridge has an ink container containing foamed material and having a plurality of ink ejecting orifices. In this ink container, the ink is contained in the porous material such as foamed polyurethane material, and therefore, it is possible to produce negative pressure by the capillary force in the foamed material and to prevent ink leakage from the ink container.

Japanese Laid-Open Patent Application No. 522/1990 discloses an ink jet recording cartridge in which a first ink container and a second ink container are connected with a porous material, and a second ink container and an ink jet recording head are connected with a porous material. In this second conventional ink cartridge, the porous material is not contained in the ink container, but is disposed only in the ink passage, so that the use efficiency of the ink is improved. By the provision of the secondary ink containing portion, the ink flowing out of the first ink container due to air expansion in the first ink container due to a temperature increase (pressure decrease) is stored, so that the vacuum in the recording head during the recording operation is maintained substantially constant.

However, in the first conventional example, the foamed material is required to occupy substantially the entire space in the ink container layer, and therefore the ink capacity is limited. In addition, the amount of the non-usable remaining ink is relatively large, that is, the use efficiency of the ink is poor. These are some problems therewith. In addition, it is difficult to detect the remaining amount of the ink, and it is difficult to maintain a substantially constant vacuum during the ink consumption period. These are additional problems.

In the second conventional example, when the recording operation is not carried out, the vacuum producing material is disposed in the ink passage, and therefore the porous material contains a sufficient amount of the ink, while the production of negative pressure by the capillary force of the porous material is insufficient, with the result that ink is leaked through the orifices of the ink jet recording head by a small impact or the like. This is a problem. In the case of an exchangeable ink cartridge in which the ink jet recording head is formed integrally with the ink container, and the ink container is mounted on the ink recording head, the second conventional ink cartridge is not usable. This is another problem.

Japanese Laid-Open Patent Applications Nos. 67269/1981 and 98857/1984 disclose an ink container using an ink bladder urged by a spring. This is advantageous in that the internal negative pressure is stably produced at the ink supply portion, using the spring force. However, these systems involve problems in that a limited configuration of the spring is required to provide a desired internal negative pressure, and the process of fixing the ink container to the bladder is complicated; the manufacturing cost therefore is high. In addition, for a thin ink container, the ink retaining ratio is small.

Japanese Laid-Open Patent Application No. 214666/1990 discloses a separated chamber type of ink container in which the inside space of the ink container is separated into a plurality of ink chambers, which communicate with each other by a fine hole capable of providing vacuum pressure. In the separate chamber type, the internal negative pressure at the ink supply portion is produced by the capillary force of the fine opening communicating the ink chambers. In this system, the structure of the ink container is simpler than the spring bladder system, which is advantageous from the standpoint of the manufacturing cost, and the configuration of the ink container is not limited by the structure. However, the separated chamber type involves the problem that when the ink container position is changed, the fine opening becomes short of ink depending on the remaining amount of the ink with resulting instability in the internal vacuum pressure even to the extent that the ink is leaked, and therefore, the ink container is limited in handling thereof.

SUMMARY OF THE INVENTION

Accordingly, it is a principal object of the present invention to provide an ink container, and ink jet recording head using the same and an ink jet recording apparatus using the same, which is easy to handle.

It is another object of the present invention to provide an ink container, an ink jet recording head using the same and an ink jet recording apparatus using the same in which the ink retaining ratio is high.

It is a further object of the present invention to provide an ink container, an ink jet recording head using the same and an ink jet recording apparatus using the same in which the ink is not leaked even if the ambient condition changes.

It is a further object of the present invention to provide an ink container, an ink jet recording head using the same and an ink jet recording apparatus using the same in which the vacuum in the ink supply is stabilized against ambient condition change, so that the ink can therefore be supplied to the recording head without influence to the ejection property of the ink.

It is a yet further object of the present invention to provide an ink container, ink, recording head, and ink jet recording apparatus in which the ink is efficiently used by the use of vacuum producing means.

It is a further object of the present invention to provide an ink container, ink, and ink jet recording head and an ink jet recording apparatus in which ink leakage is reliably prevented even when mechanical impact such as vibration or thermal impact such as temperature change is imparted to the recording head or the ink container under the condition of use or transportation of the ink jet recording apparatus.

According to an aspect of the present invention, there is provided an ink containing apparatus for containing ink, comprising: a negative pressure producing material; a container for containing the negative pressure producing material, such container having an air vent and a supply port for supplying the ink out; another container for containing ink; a communication part for communication between bottom portions of the containers; and ambient air introducing means adjacent to the air vent for introducing air into the communication part.

These and other objects, features and advantages of the present invention will become more apparent upon consideration of the following description of the preferred embodiments of the present invention, taken in conjunction with the accompanying drawings.

BRIEF DESCRIPTION OF THE DRAWINGS

FIG. 2 illustrates a recording head and an ink container according to another embodiment of the present invention.

FIG. 2*a* illustrates a detail of the recording head shown in FIG. 2.

FIG. 3 illustrates an ink container according to an embodiment of the present invention.

DETAILED DESCRIPTION OF THE PREFERRED EMBODIMENTS

Figure 1:
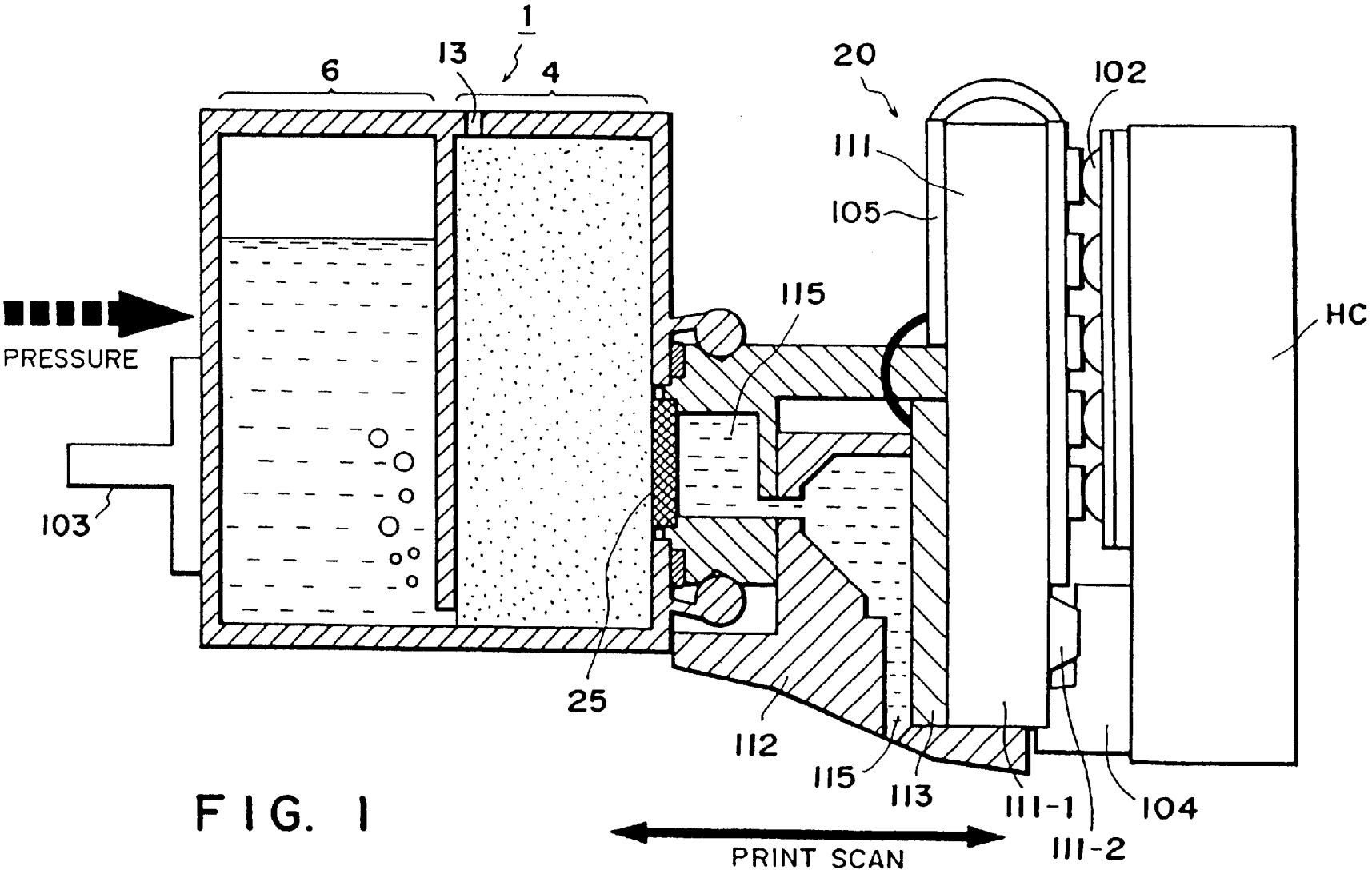
FIG. 1 shows coupling between a recording head and an ink container according to an embodiment of the present invention.

FIG. 1 is a sectional view showing connections among a recording head, ink container, and carriage in a bubble jet recording apparatus according to an embodiment of the present invention. The recording head 20 in this embodiment is of an ink jet type using electrothermal transducers for generating thermal energy for causing film boiling in the ink in accordance with electric signals. In FIG. 1, major parts of the recording head 20 are bonded or pressed into a laminated structure on a head base plate 111 with positioning reference projections 111-1 and 111-2 on the head based plate 111. In the vertical direction on the surface of FIG. 1 drawing, positioning of the base plate is effected by the head positioning portion 104 of a carriage HC and the projection 111-2. In the vertical direction in the cross-section of FIG. 1, a part of the projection 111-2 projects to cover the head positioning portion 104, and the cut-away portion (not shown) of the projection 111-2 and the head positioning portion 104 are used for the correct positioning. A heater board 113 is produced through film formation processes, and includes electrothermal transducers (ejection heaters) arranged on a Si substrate and electric wiring for supplying electric power thereto, the wiring being made of aluminum or the like. The wiring connects to a head flexible base (head PCB) 105 having wiring which has at the end portions thereof pads for receiving electric signals from the main assembly. They are connected by wire bonding. A top plate 112 integrally formed of polysulfone or the like comprises walls for separating a plurality of ink passages corresponding to the ejection heaters, a common liquid chamber for receiving ink from an exchangeable ink container through a passage and for supplying the ink into the plurality of ink passages, and orifices for providing the plurality of ejection outlets. The top plate 112 is urged to the heater board 113 by an unshown spring, and it is pressed and sealed using a sealing member, thus constituting the ink ejection outlet part.

For the purpose of communication with the exchangeable ink container 1, a sealed passage 115 is provided in the top plate 112; this passage penetrates through the holes of the head heater board PCB 113 and the head base plate 111 to the opposite side of the head base plate 111. In addition, it is bonded and fixed to the head base plate 111 at the penetrating portion. At an end connecting with the ink container 1 of the passage 115, there is provided a filter 25 for preventing introduction of foreign matter or bubbles into the ink ejection part.

The exchangeable ink container is connected to the recording head 20 by an engaging guide and pressing means 103, and an ink absorbing material in the ink supplying portion is brought into contact with the filter 25 at an end of the passage 115; mechanical connection between the ink container and recording head is thereby established. After the connection, using a recording head sucking recovery pump 5015 of the main assembly of the recording apparatus, the ink is forcibly supplied from the exchangeable ink container 1 into the recording head 20, by which the ink is supplied.

In this embodiment, upon the engagement by the pressing means, the recording head 20 and the exchangeable ink container 1 are connected with each other, and simultaneously, the recording head 20 and the carriage HC are mechanically and electrically connected in the same direction, and therefore, the positioning between the pads on the head PCB 105 and the head driving electrodes 102 is assuredly effected.

The ring seal between the ink container and reading head is of a relatively thick elastic material in this embodiment so that the joint portion at the outer wall of the exchangeable ink container permits play in the ink supply portion.

Figure 4:
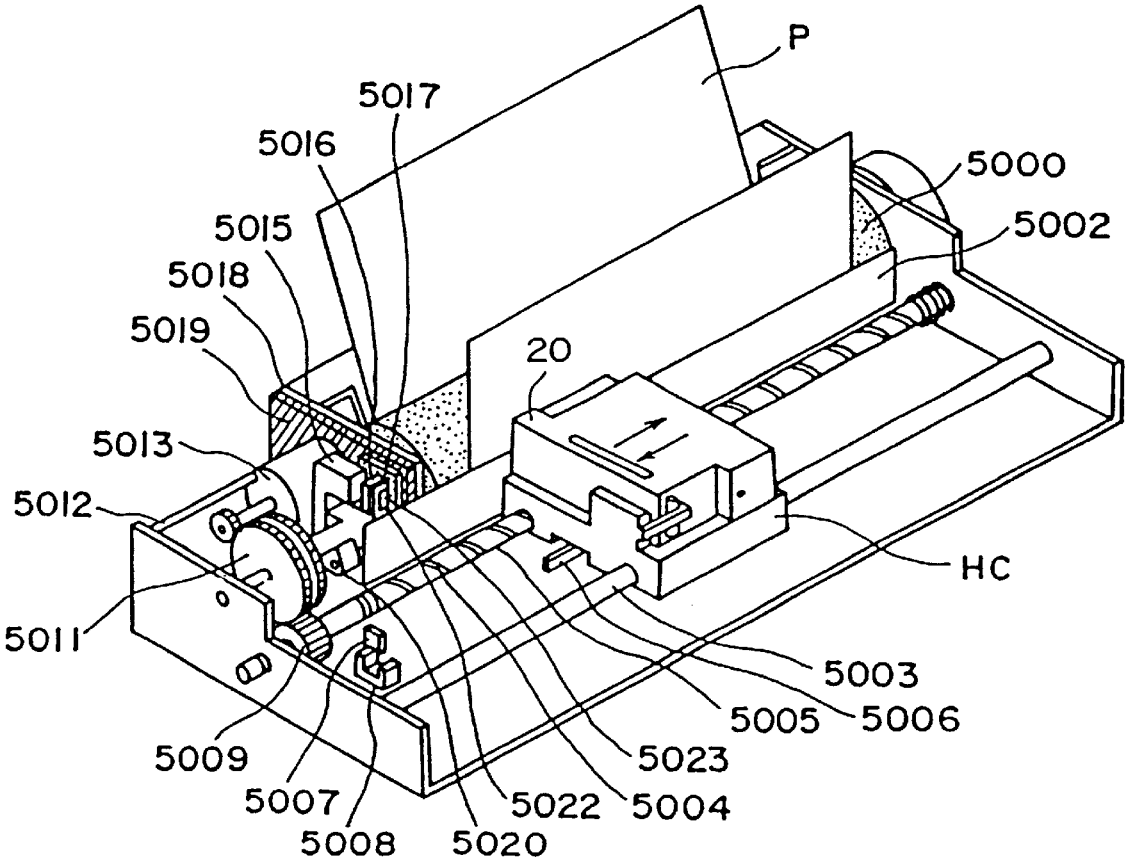
FIG. 4 is a perspective view of a recording apparatus.

As described in the foregoing, in this embodiment, the exchangeable ink container 1 and the recording head 20 are sufficiently joined, and thereafter, the exchangeable ink container is urged, so that the carriage and the recording head can be positively positioned relative to each other with a simple structure. Simultaneously, the recording head and the exchangeable ink container are connected outside the main assembly with a simple structure, and thereafter mounted on mounting structure on the carriage. Therefore, the exchanging operation is easy. In this embodiment, the electric connection between the carriage (recording apparatus main assembly) and the recording head is simultaneously effected. Therefore, good performance is maintained upon the exchange of the recording head and the exchangeable ink container. It is a possible alternative that a separate connector is used to establish the electric connection, with structure assuring the recording head positioning and the connection with the exchangeable ink container. FIG. 4 shows a recording apparatus of a horizontal position type. Referring to this Figure, the arrangement of the operation of the recording head in the ink jet recording apparatus of this embodiment will be described. In this Figure, a recording material P is fed upwardly by a platen roller 5000, and it is urged to the platen roller 5000 over the recording range in the carriage moving direction by a sheet confining plate 5002. A carriage moving pin of the carriage HC is engaged in a helical groove 5004. The carriage is supported by the lead screw 5005 (driving source) and a slider 5003 extending parallel with the lead screw, and it reciprocates along the surface of the recording material P on the platen roller 5000. The lead screw 5005 is rotated by the forward and backward rotation of the driving roller through drive transmission gears 5011 and 5009. Designated by reference numerals 5007 and 5008 are photocouplers, which serve to detect the presence of the carriage lever 5006 to switch the direction of the motor 5013 (home position sensor). The recording image signal is transmitted to the recording head in timed relation with the movement of the carriage carrying the recording head, and the ink droplets are ejected at the proper positions, thus effecting the recording. Designated by a reference numeral 5016 is a member for supporting a capping member 5022 for capping the front surface of the recording head. Designated by a reference numeral 5015 is a sucking means for sucking the inside of the cap. Thus, it is effective to refresh or recover the recording head by sucking through the opening 5023 in the cap. A cleaning blade 5017 is supported by a supporting member 5019 for moving the blade back and forth. They are supported on a supporting plate 5018 of the main assembly. The sucking means, the blade or the like may be of another known type. A lever 5012 for determining the sucking and recovery operation timing moves together with the movement of a cam 5020 engaged with the carriage. The driving force from the driving motor is controlled by a known transmitting means such as clutch or the like. The recovery means carries out a predetermined recovery process at a predetermined timing by the lead screw 5005 at the corresponding positions, when the carriage comes into the region adjacent or at the home position.

Figure 33:
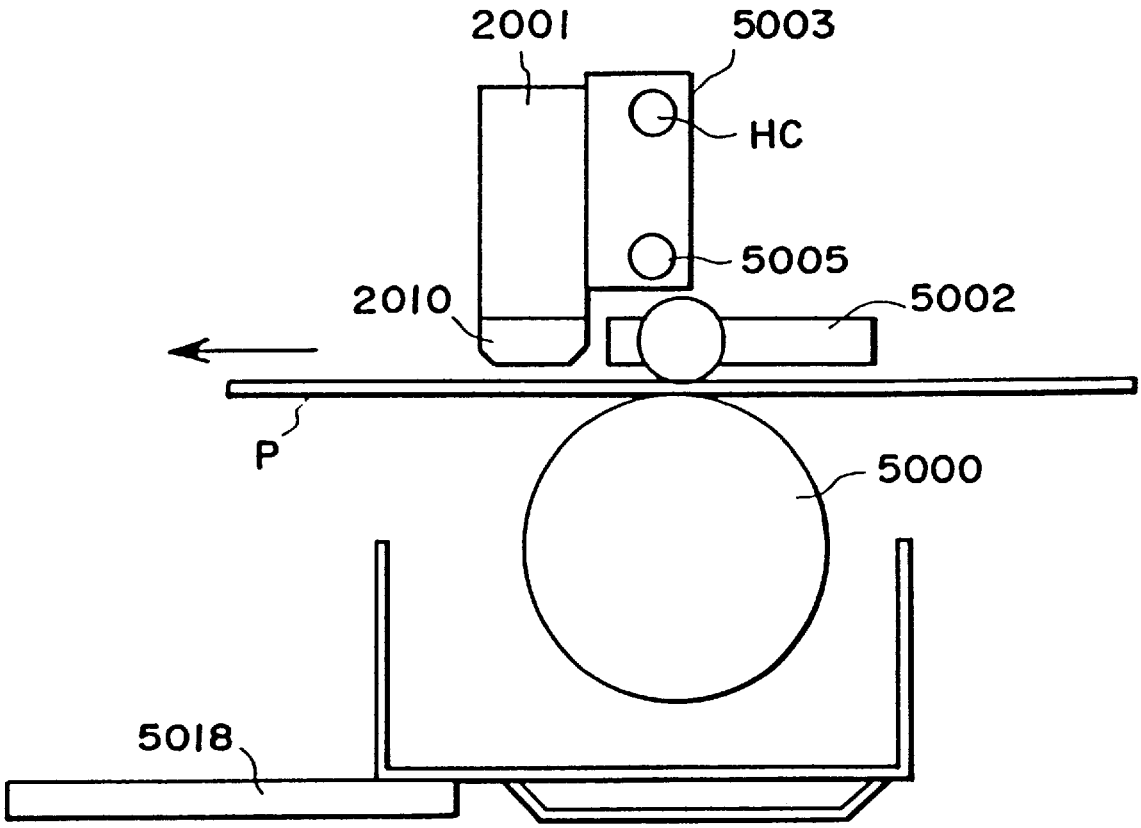
FIG. 33 illustrates horizontal printing position.

As shown in FIG. 33, the ink jet recording apparatus of this embodiment is operable in the vertical printing position. In the vertical position, the recording scanning operation is carried out while the recording material P is faced to the bottom surface of the recording head 2010. In this case, the sheet feeding, printing and sheet discharging operations are possible in substantially the same plane, and therefore, it is possible to effect printing on a thick and high rigidity recording material such as a post card or an OHP sheet. Therefore, the outer casing of the position changeable ink jet recording apparatus of this embodiment is provided with four rubber pads on the bottom surface of FIG. 4, and with two ribs and a retractable auxiliary leg 5018 on the left side surface. By this means, the printing apparatus can be stably positioned in the respective printing positions. In the vertical printing position, the exchangeable ink container 2001 is above the ejection part of the recording head 2010 faced to the recording material P, and therefore, it is desirable to support the resulting static head of the ink and to maintain slightly positive or, preferably, slightly negative internal pressure of the ink at the ejection part, so that the meniscus of the ink in the ejection part is stabilized.

The recording apparatus shown in FIG. 4 and FIG. 33 is usable with the embodiments of the present invention which will be described hereinafter.

A description will now be made in detail as to the ink container of this invention. First, the structure and the operation of the ink container will be described.

Structure

As shown in FIG. 2, the main body of the ink container comprises an opening 2 for connection with an ink jet recording head, a vacuum producing material chamber or container 4 for accommodating a vacuum producing material 3, and an ink containing chamber or container 6 for containing the ink, the ink chamber 6 being adjacent to the vacuum producing material container by way of ribs 5 and being in communication with the vacuum producing material container 4 at a bottom portion 11 of the ink container.

Operation (1)

FIG. 2 is a schematic sectional view of the ink container when a joint member 7 for supplying the ink into the ink jet recording head is inserted into the ink container, and is urged to the vacuum producing material, so that the ink jet recording apparatus is in the operable state. At the end of the joint member, a filter may be provided to exclude foreign matter from the ink container.

When the ink jet recording apparatus is operated, the ink is ejected through the orifice of orifices 21 of the ink jet recording head 20, so that an ink sucking force is produced in the ink container. The ink 9 is introduced into the joint member 7 by the sucking force from the ink container 6 through the clearance 8 between ends of the ribs and the bottom 11 of the ink cartridge, and through the vacuum producing material 3 into the vacuum producing material container 4; thereafter, the ink is supplied into the ink jet recording head. Then, the internal pressure of the ink container 5 which is hermetically sealed except for the clearance 8, decreases as a result of the pressure difference between the ink container 6, and the vacuum material container 4. With the continued recording operation, this pressure difference continues to increase. Since the vacuum producing material container 4 is opened to the ambient air through an air vent 13, air is introduced into the ink container 4 through the clearance 8 between the rib ends and the ink cartridge bottom 11 through the vacuum producing material. At this time, the pressure difference between the ink container 6 and the vacuum producing material container 4 is eliminated. During the ink jet recording operation, the above process is repeated, so that substantially a constant vacuum is maintained in the ink cartridge. The ink in the ink container can be substantially thoroughly used, except for the ink deposited on the internal wall surface of the ink container, and therefore, the ink use efficiency is improved.

Operation (2)

Figure 10:
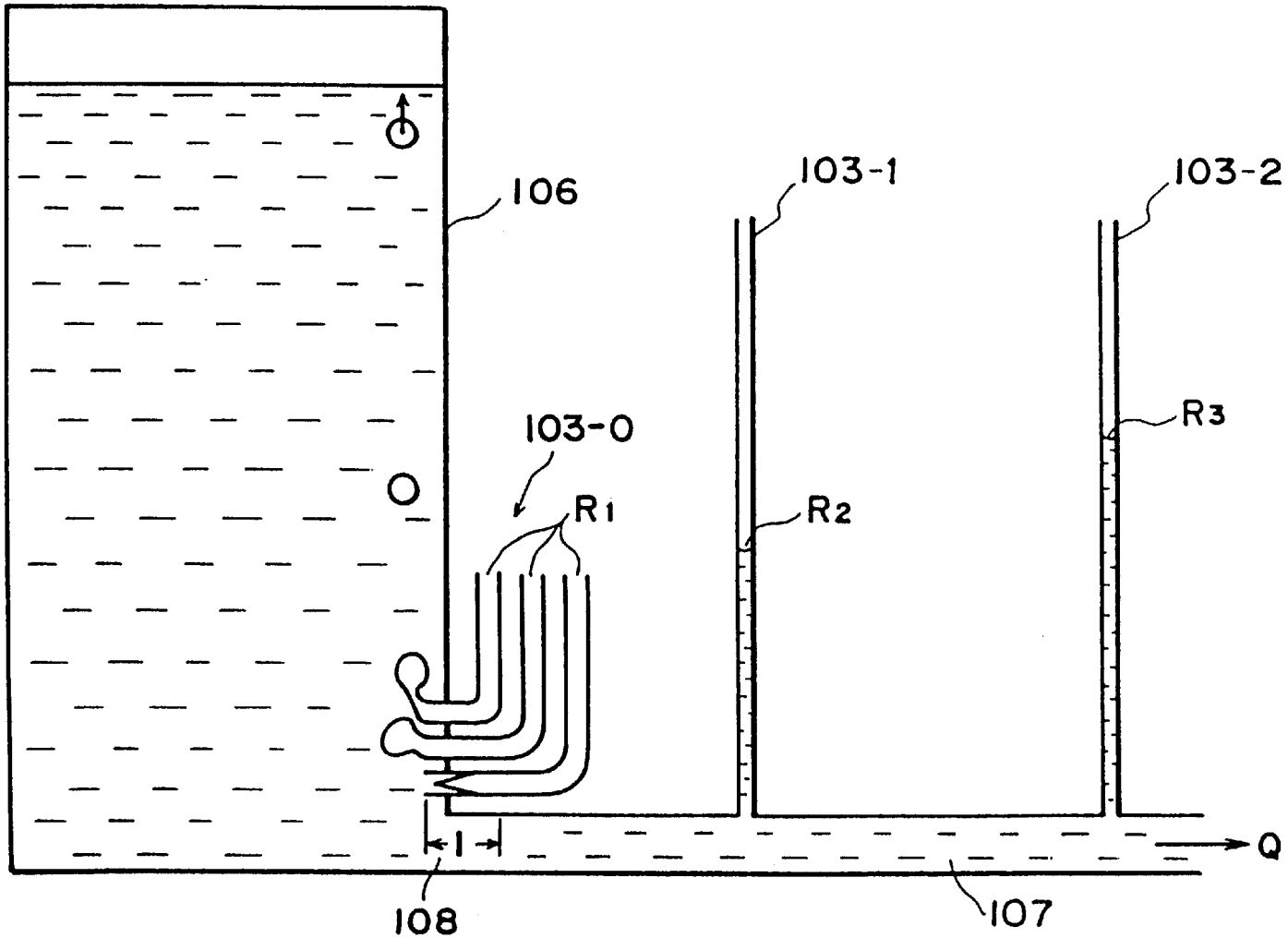
FIG. 10 illustrates a model of ink supply.

The principle of operation of the ink container is further described in detail on the basis of a model shown in FIG. 10.

In FIG. 10, an ink container 106 corresponds to the ink chamber 6 and contains the ink. Designated by reference numerals 103-0, 103-1 and 103-2 are capillary tubes equivalent to the vacuum producing material 3. By the meniscus force thereof, the vacuum is produced in the ink container. An element 107 corresponds to the joint member 7, and is connected with an ink jet recording head (not shown). It supplies the ink from the ink container. The ink is ejected through the orifices, so that the ink flows as indicated by an arrow Q.

The state shown in this Figure is the state in which a small amount of the ink has been supplied out from the vacuum producing material, and therefore, the ink container, from the filled state of the ink container and the vacuum producing material. A balance is established among the static head in the orifice of the recording head, the reduced pressure in the ink container 106 and the capillary forces in the capillary tubes 103-0, 103-1 and 103-2. When the ink is supplied in this state, the height of the ink level in the capillary tubes 103-1 and 103-2 hardly change, and the ink is supplied from the ink container 106 through a clearance 108 corresponding to the clearance 8. This increases the vacuum in the ink container 106, so that the meniscus of the capillary tube 103-0 changes to produce an air bubble or bubbles. As a result of the breakdown of the meniscus, the air bubble or bubbles are introduced into the ink container 106. In this manner, the consumed amount of the ink is supplied from the ink container 106 without a substantial change in the level in the capillary tubes 103-1 and 103-2, that is, without substantial change in the ink distribution in the vacuum producing material. The balanced internal pressure is thus maintained.

When an amount Q of the ink is supplied, the volume change of the ink appears as the meniscus level change in the capillary tubes 103-0, and the surface energy change of the meniscus thereby increases the negative pressure of the ink supply portion. However, the breakdown of the meniscus permits introduction of the air into the ink container, so that the air is exchanged with the ink, and therefore, the meniscus returns to the original position. Thus, the internal pressure of the ink supply portion is maintained at the predetermined internal pressure by the capillary force of the tubes 103-0.

Figure 11:
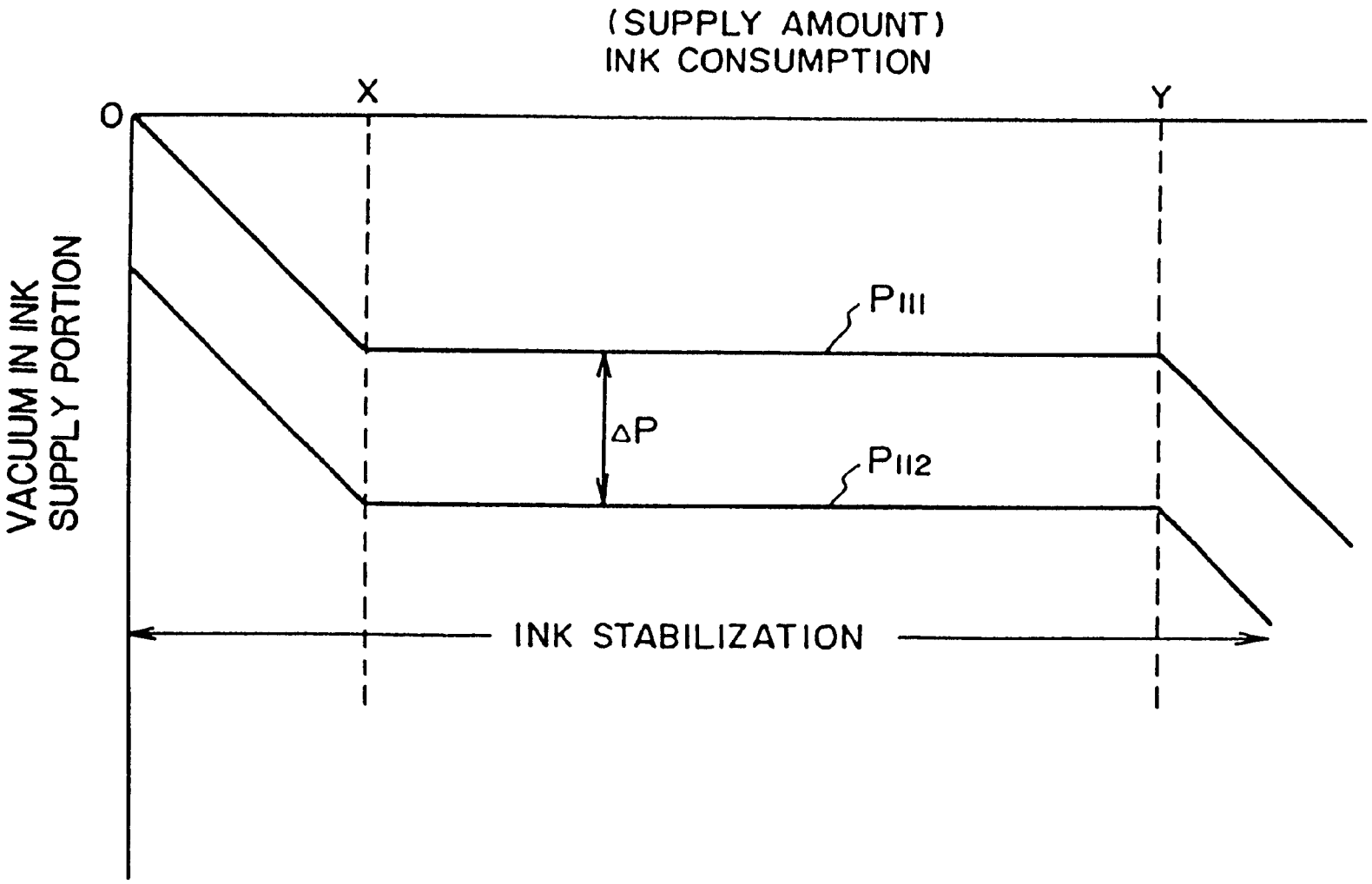
FIG. 11 is a graph showing internal pressure change at the ink supply portion in an ink cartridge according to an embodiment of the present invention.
Figure 16:
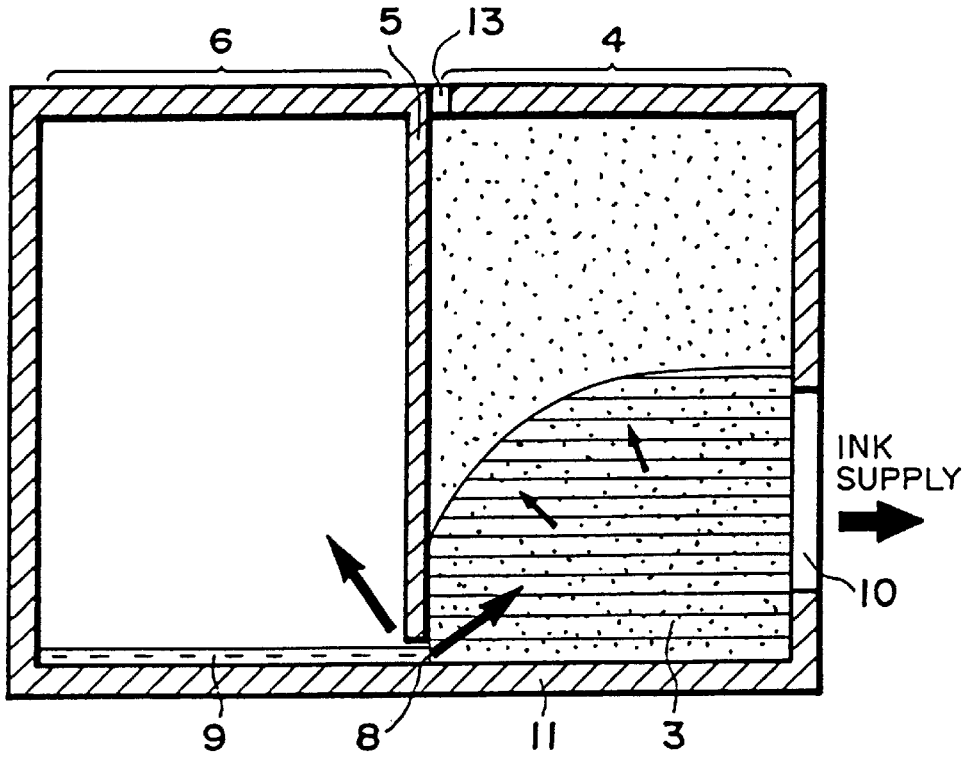
FIG. 16 shows the state about an end of the ink supply.
Figure 17:
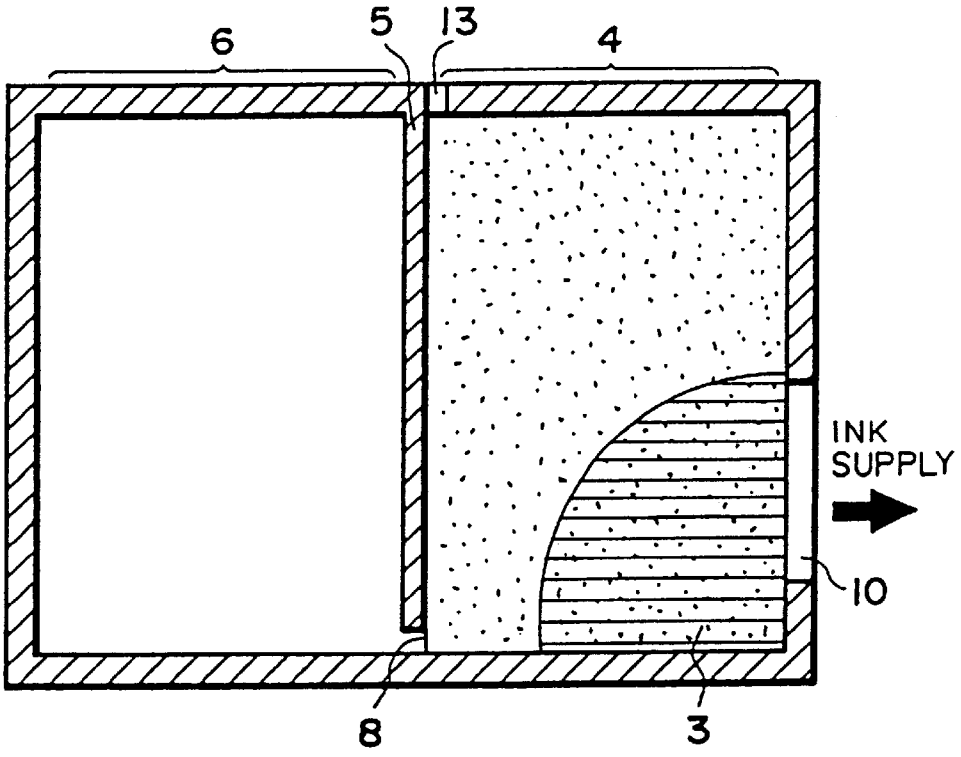
FIG. 17 shows the state in which the ink has been supplied out.

FIG. 11 shows the change of the internal pressure at the ink supply portion of the ink container according to this embodiment of the present invention in accordance with the amount of the ink supply (consumption amount). At the initial state (FIG. 14), the ink supply starts from the vacuum producing material container, as described above. More particularly, the ink is supplied from the vacuum producing material container until the meniscus is formed in the clearance 8 at the bottom portion of the ink container. Therefore, similarly to the ink container according to the first conventional example in which the ink container is filled with the absorbing material, the internal pressure in the ink supply portion is produced due to the balance between the capillary force at the ink top surface (air-liquid interface) of the compressed ink absorbing material in the vacuum producing material container and the static head of the ink itself. When the state is reached in which the air-liquid interface is formed at the bottom portion of the ink container as described in the foregoing, due to the reduction of the ink in the vacuum producing material container in accordance with the consumption of the ink (ink supply) (FIG. 15, and FIG. 11, point X), the ink supply from the ink container starts. By the capillary force of the compressed ink absorbing material adjacent to the bottom portion of the ink chamber, the internal pressure of the ink supply portion is maintained. As long as the ink is supplied from the ink container, the substantially constant internal pressure is maintained. When further ink consumption results in a decrease of the ink level in the ink container 6 below the level of clearance 8, substantially all of the ink in the ink container 6 is consumed (FIG. 16 and FIG. 11, point Y), air is introduced at once into the ink container resulting in direct communication being established between the ink container and the outside air, so that the small amount of the ink remaining in the ink container is absorbed by the compressed ink absorbing material in the vacuum producing material container, and therefore, the amount of the ink contained in the vacuum producing material container increases. This changes the internal pressure of the ink supply portion slightly toward the positive direction by the amount corresponding to the slight rise of the ink top surface (air-liquid interface). When the ink is further consumed, the ink in the vacuum producing material container is consumed. If, however, the air-liquid interface is lowered so that it reaches the ink supply portion 10, the recording head starts to receive the air, and therefore, the ink supply system reaches its limit (FIG. 17). At this state, the exchange of the ink container is required. The following has been found by the investigations of the inventors. By carrying out a sucking recovery operation by sucking means of the main assembly of the recording apparatus upon the connection with the recording head to remove air bubbles in the ink passage produced at the time of the connecting operation and to flow a slight amount of ink out of the ink container, it is possible to maintain the stabilized ink internal pressure from the initial stage. In addition, even if the ink is supplied out from the vacuum producing material container at the initial stage and at the stage immediately before the exchange of the ink container, the recording is not adversely affected during the ink stabilized supply period shown in FIG. 11, and therefore, proper recording may be carried out. In order to establish ink supply through the above-described mechanism, the following points are considered.

It is desirable that the meniscus be formed stably between the ink and the ambient air at a position very close to the clearance 8. Otherwise, in order to displace the meniscus to the ink container, the ink has to be consumed to such a large extent that a quire high vacuum is produced in the ink supply portion. Then, a high frequency drive of the recording apparatus becomes difficult, and therefore, this is disadvantageous from the standpoint of high speed recording operation.

FIG. 11 shows the change of the internal pressure at the ink supply portion of the ink container in accordance with the ink supply amount (consumption amount). It shows a so-called static pressure P111 in the state of no ink supply and a so-called dynamic pressure P112 in the state of ink supply being carried out.

The difference between the dynamic pressure P112 and the static pressure P111, is the pressure loss $\Delta P$ when the ink is supplied. The negative pressure produced at the time of the meniscus displacement is influential.

Accordingly, it is desirable that the breakdown of the meniscus at this portion occur without delay. For this purpose, there is provided an air introduction passage for forcedly permitting the air introduction adjacent the clearance 8. Embodiments in this respect will be described.

Embodiment 1

FIG. 3 illustrates a first embodiment. The vacuum producing material 3 in the ink container is an ink absorbing material such as foamed urethane material or the like. When the absorbing material is accommodated in the vacuum producing material container 4, it provides a clearance functioning as an air introduction passage A32 at a part of the vacuum producing material container. The passage extends to the neighborhood of the clearance or opening 8 between the ink container bottom 11 and the end of the rib or partition 5. Thus, the communication with the air is established by this air passage. When the ink supply from the ink supplying portion is started, the ink is consumed from the absorbing material 3, so that the internal pressure of the ink supply portion reaches a predetermined level. Then, the ink surface A31 shown in FIG. 3 is stably formed in the absorbing material 3, and meniscus is formed between the ink and the ambient air adjacent the clearance 8. The dimensions of the clearance 8 are preferably not more than 1.5 mm in the height, and is preferably long in its longitudinal direction. When this state is established, the breakdown of the meniscus at the clearance 8 occurs without delay by the subsequent ink consumption. Therefore, the ink can be supplied stably without increasing the pressure loss $\Delta P$. Accordingly, the ink ejection is stabilized at high speed printing.

When the recording operation is not carried out, the capillary forces of the vacuum producing material itself (or the meniscus force at the interface between the ink and the vacuum producing material) serves to suppress ink leaks from the ink jet recording head.

For the purpose of using the ink container of this invention in a color ink jet recording apparatus, different color inks (black, yellow, magenta and cyan, for example) can be accommodated in separate ink containers. The respective ink cartridges may be unified as an ink container. In another form there are provided an exchangeable ink cartridge for black ink which is most frequently used, and an exchangeable ink cartridge unifying other color ink containers. Other combinations are possible in consideration of ink jet apparatus used therewith.

The present invention will be described below in more detail.

In order to control the vacuum in the ink jet recording head when the ink container of this invention is used, the following are preferably optimized: material, configuration and dimensions of the vacuum producing material 3, configuration and dimensions of the rib or partition 5, configuration and dimensions of the clearance or opening 8 between the rib 5 and the ink container bottom 11, volume ratio between the vacuum producing material container 4 and the ink container 6, configuration and dimensions of the joint member 7 and the insertion degree thereof into the ink container, configuration, dimension and mesh of the filter 25, and the surface tension of the ink.

The material of the vacuum producing member may be any known material if it can retain the ink despite the weight of the material, the weight of the liquid (ink) and small vibration. For example, there are sponge-like materials made of fibers and porous material having continuous pores. It is preferably in the form of a sponge of polyurethane foamed material, in which it is easy to adjust the vacuum and the ink retaining power. Particularly, in the case of foamed material, the pore density can be adjusted during the manufacturing thereof. When the foamed material is subjected to thermal compression treatment to adjust the pore density, decomposition is produced by the heat with the result of changing the nature of the ink with the possible result of adverse influence to the recording quality, so that a cleaning treatment is desirable. For the various ink cartridges used in various ink jet recording apparatuses, corresponding pore density foamed materials are required. It is desirable that a foamed material, not treated by thermal compression and having a predetermined number of cells (number of pores per 1 inch), be cut to a desired dimension, and then be squeezed into the vacuum producing material container so as to provide the desired pore density and the capillary force.

Ambient Condition Change in the Ink Jet Recording Apparatus

In an ink cartridge having a closed ink container, the ink can leak out. That is, when a change in ambient condition (temperature rise or pressure decrease) occurs with the ink cartridge contained in the ink jet recording apparatus, the air in the ink container (as well as the ink), to push out the ink contained in the ink container, with the result of ink leakage. In the ink cartridge of this embodiment, the volume of air expansion (including expansion of the ink, although the amount thereof is small) in the closed ink container is estimated for the predicted worst ambient condition, and the corresponding amount of the ink movement from the ink container thereby is allotted to the vacuum producing material container. The position of the air vent is not limited provided it is at a higher position than the opening for the joint in the vacuum producing material container. In order to cause the ink to flow in the vacuum producing material away from the opening for the joint upon an ambient condition change, it is preferably at a position remote from the joint opening. The number, the configuration, the size and the like of the air vent can be properly determined by one having ordinary skill in the art in consideration of the evaporation of the ink.

Transportation of the Ink Cartridge per se

During the transportation of the ink cartridge per se, the joint opening and/or the air vent is preferably sealed with a sealing member or material to suppress ink evaporation or the expansion of the air in the ink cartridge. The sealing member is preferably a single layer barrier used in the packing field, a multi-layer member including it and plastic film, or a compound barrier material having them and aluminum foil or reinforcing material such as paper or cloth. It is preferable that a bonding layer of the same material or similar material as the ink cartridge main body be used, and that it be bonded by heat, thus improving the hermetic sealing property.

In order to suppress the introduction of air and the evaporation of the ink, it is effective that the ink cartridge be packaged, the air then be removed therefrom, and the package then sealed. As for the packing material, it is preferably selected from the above mentioned barrier material in consideration of the air transmissivity and the liquid transmissivity.

With proper selection as described in the foregoing, the ink leakage can be prevented with high reliability during the transportation of the ink cartridge per se.

Manufacturing Method

The material of the main body of the ink cartridge may be any known material. It is desirable that the material not influence the ink jet recording or that it have been treated for avoiding such influence. It is also preferable that consideration be given to the productivity of the ink cartridge. For example, the main body of the ink cartridge is separated into the bottom portion 11 and an upper portion (see FIG. 2), and they are integrally formed respectively from resin material. After the vacuum producing material is squeezed, the bottom portion 11 and the upper portion are bonded, thus producing the ink cartridge. If the resin material is transparent or semi-transparent, the ink in the ink container can be observed externally, and therefore, the timing of the ink cartridge exchange can be discriminated easily. In order to facilitate the bonding of the above-described sealing materials or the like, the provision of a projection as shown in FIG. 2 is preferable, from the outer appearance standpoint, the outer surface of the ink cartridge may be grained.

The ink may be filled through pressurization and pressure reduction. It is preferable to provide an ink filling port in either of the containers so that other openings are not contaminated at the time of the ink filling operation. The ink filling port, after the ink filling, is preferably plugged with a plastic or metal plug.

The structure and configuration of the ink cartridge can be modified within the spirit of the present invention.

The ink container (cartridge) of the above-described embodiments may be of the exchangeable type, or may be unified with the recording head.

When it is of the exchangeable type, it is preferable that the main assembly can detect the exchange of the container and that the recovery operation (such as a sucking operation) be carried out by the operator.

Figure 18:
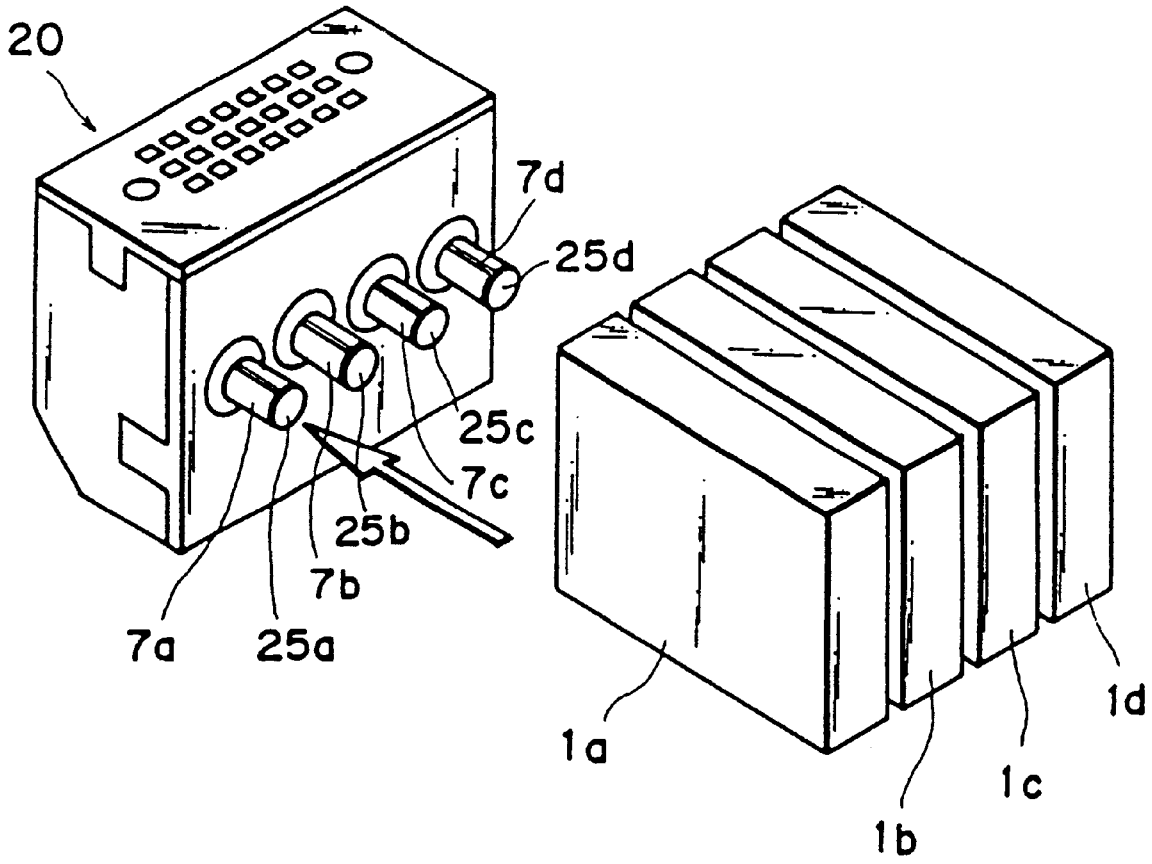
FIG. 18 is a perspective view of a device having four integral heads, and respective ink cartridges therefor which are removably mountable.

As shown in FIG. 18, the ink container may be used in an ink jet printer in which four recording heads are unified into a recording head 20 connectable with four color ink containers 1*a*, 1*b*, 1*c*, 1*d*. Each ink container connects to its respective joint member 7*a*, 7*b*, 7*c*, 7*d*, with the ink filtered by filter 25*a*, 25*b*, 25*c*, 25*d*.

COMPARISON EXAMPLE 1

A comparison example will be explained with reference to the change of the internal pressure at the ink supply portion of the ink container in accordance with the ink supply.

There is no air introduction passage in the ink container, and in the vacuum pressure producing material container, an absorbing material having substantially uniform pore size distribution is contained.

Figure 13:
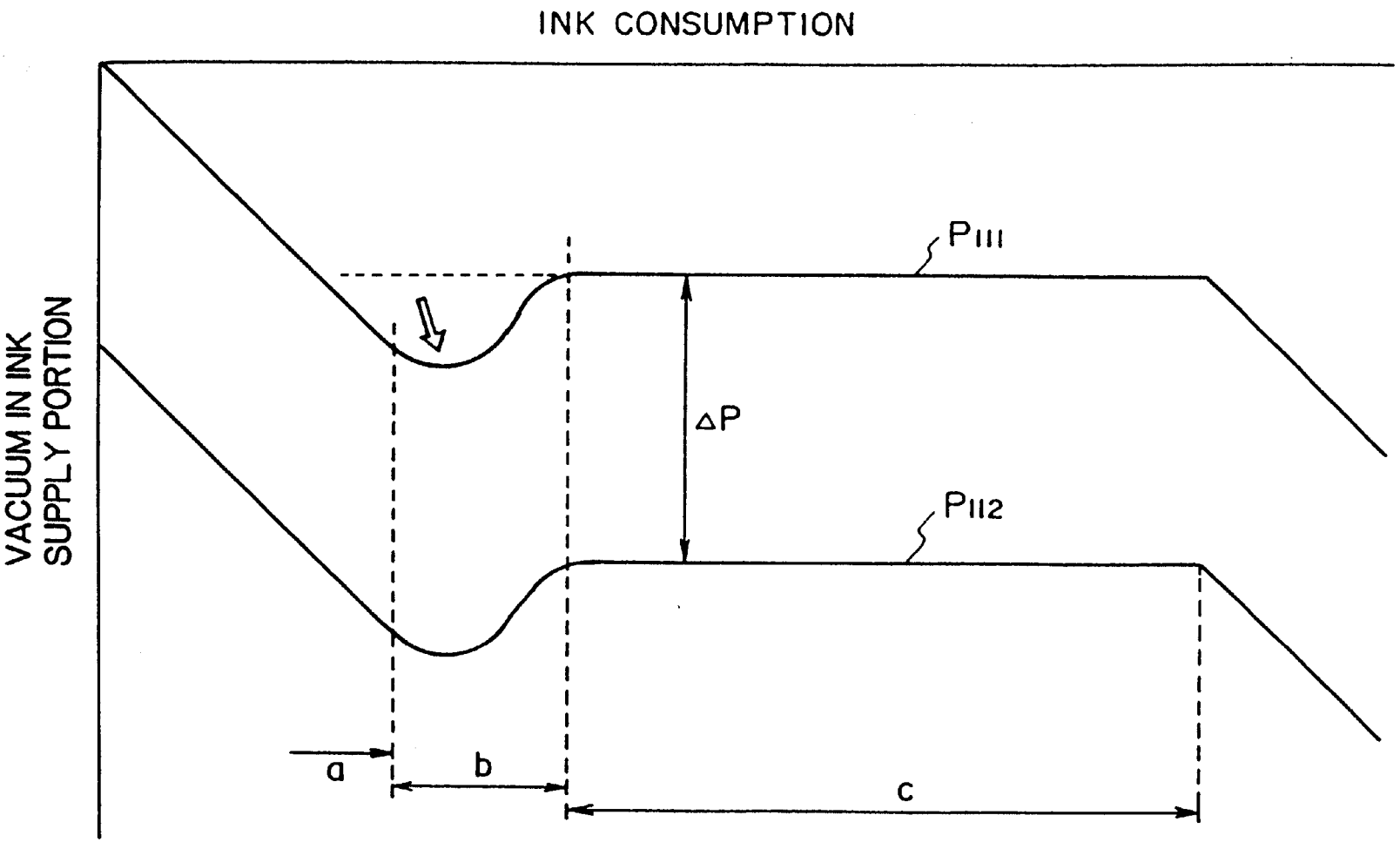
FIG. 13 is a graph showing the internal pressure change at the ink supply portion in the comparison example.
Figure 14:
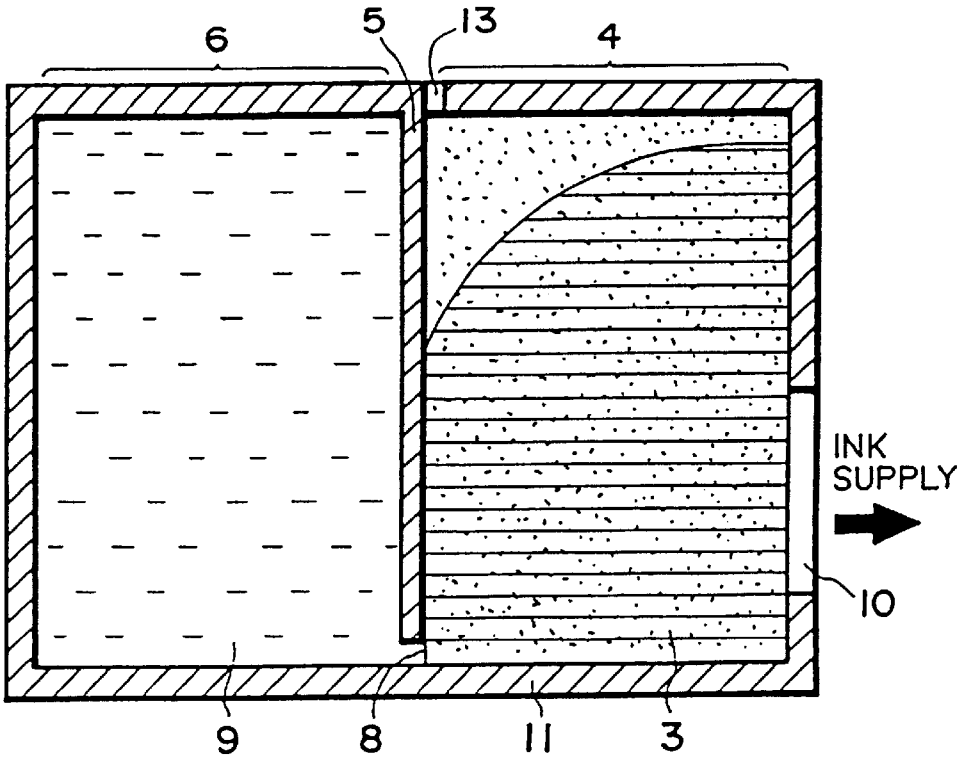
FIG. 14 illustrates an initial state in which the ink container is filled with the ink.

At the initial stage, as shown in FIG. 14, the ink is substantially fully contained in the ink container 6, and a certain amount of the ink is contained in the vacuum producing material container 4. When the ink supply starts from this state, the ink is supplied out from the vacuum producing material container 4, and therefore, due to the balance between the static head of the ink and the capillary force of the ink top surface (air-liquid interface) of the absorbing material 3 in the vacuum producing material container 4, internal pressure is produced at the ink supply portion. With continued ink supply, the ink top surface lowers. Therefore, the negative pressure increases substantially linearly in response to the height of the ink surface into the state shown by a in FIG. 13. The negative pressure in the ink supply portion continues to increase until the air-liquid interface (meniscus) is formed at the clearance at the bottom of the ink chamber by the ink supply.

Until the meniscus-formed state is established at the clearance, the ink surface in the absorbing material lowers to a substantial extent, and the liquid surface may thus fall below the joint portion with the recording head.

If this occurs, air is introduced into the recording head with the result of unstable ejection or ejection failure.

Figure 12:
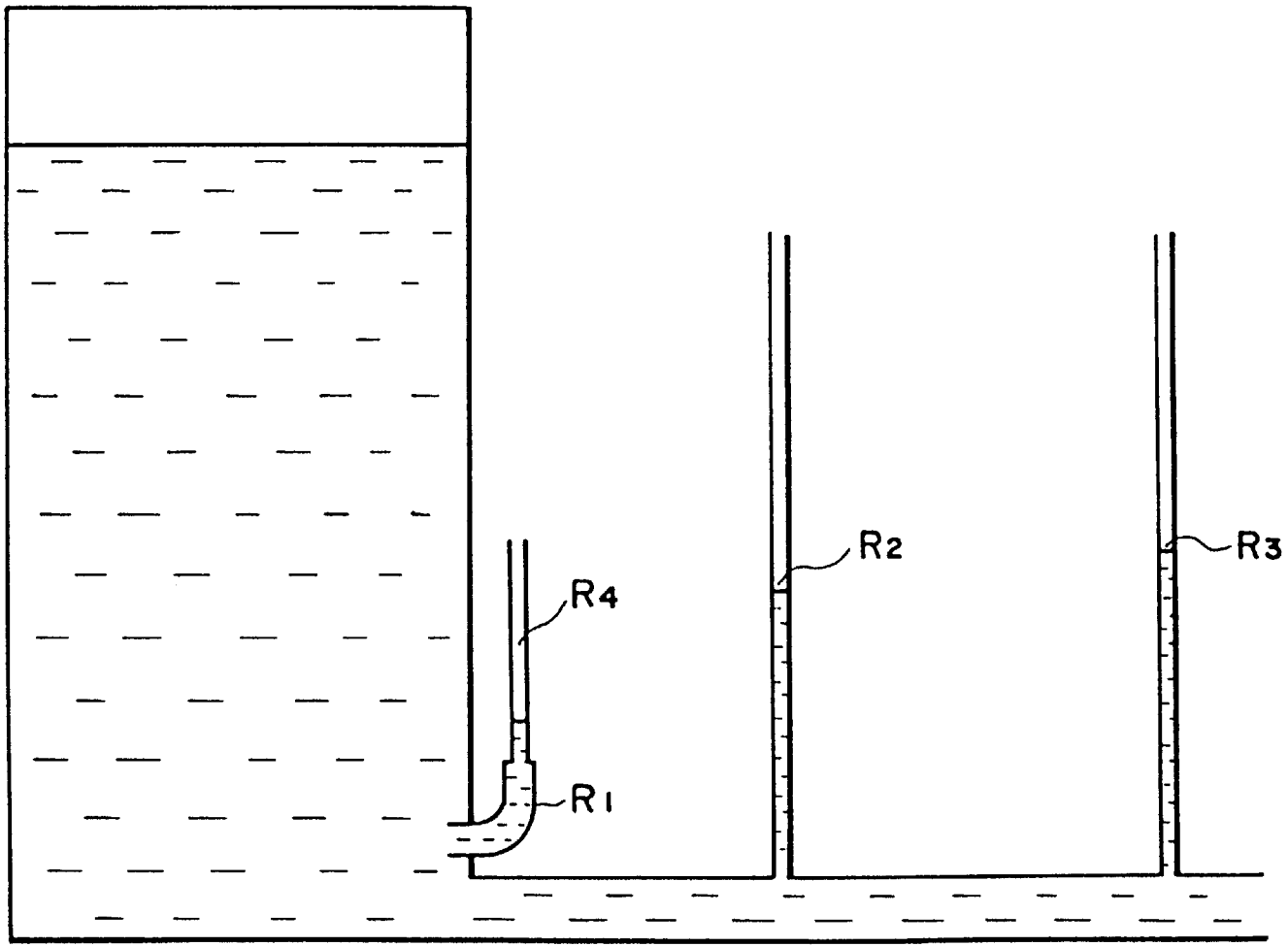
FIG. 12 shows a model of ink supply in a comparison example.

Even if this condition is not reached, it is possible that the internal pressure at the ink supply portion may increase beyond a predetermined negative pressure determined by the pore size of the absorbing material at the clearance, as shown in b in FIG. 13. The reason is believed to be as follows. The absorbing material is compressed more or less by the internal wall of the vacuum producing material container 4 at the periphery thereof. However, because of the non-existence of the wall at the clearance, it is not compressed with the result that the compression ratio thereat is slightly less than at other portions. Therefore, the situation is as shown in FIG. 12.

In this Figure, the situation is shown in which the ink is consumed from the vacuum producing material container 4 to some extent. If the ink is further supplied from this state, the meniscus R4 which corresponds tot he largest pore size among R2, R3 and R4 in the absorbing material 3, is displaced more than the meniscuses at R2 and R3. When the meniscus comes close to the clearance, the meniscus force suddenly decreases with the result that the meniscus moves to the ink container, and the meniscus is broken, so that air is introduced in the ink container. At this time, only a small amount of the ink is consumed from the portions R2 and R3 as compared with the portion R4. The pressure loss ΔP at the time of the meniscus movement is relatively large.

However, the once broken meniscus is reformed by inertia at a time of the restoring, at the position close to the original position, and therefore, the high pressure loss state continues for only a short while.

Until the meniscus is stabilized at the portion having the pore size R1, the similar actions are repeated. Once the meniscus is stabilized at the clearance, the air bubbles enter the ink container until the negative pressure determined by the pore size R1 in the clearance is established, so that stabilization is reached.

The above is shown in FIG. 13, at c, in which the ink is consumed both from the ink container and the absorbing material. If the air introduction passage is not particularly provided, the internal pressure at the ink supply portion is not stabilized and the pressure loss ΔP at the time of the ink supply is increased, and therefore, the ejection property deteriorates, resulting in difficulty in high speed printing.

Embodiment 2

Figure 5B:
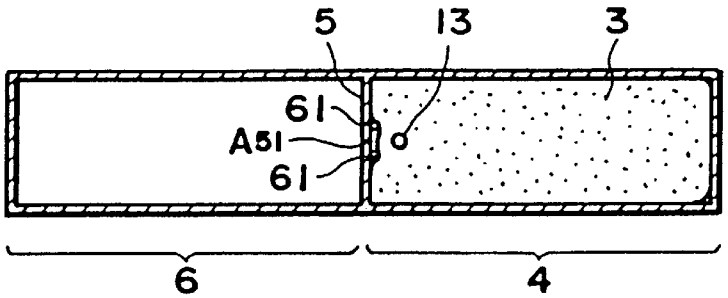
FIGS. 5A, 5B and 5C are respectively a longitudinal sectional view, a longitudinal cross-sectional view and a vertical cross-sectional view, illustrating an ink cartridge according to a further embodiment of the present invention.
Figure 5C:
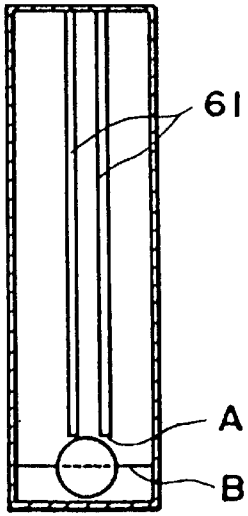
Figure 5A:
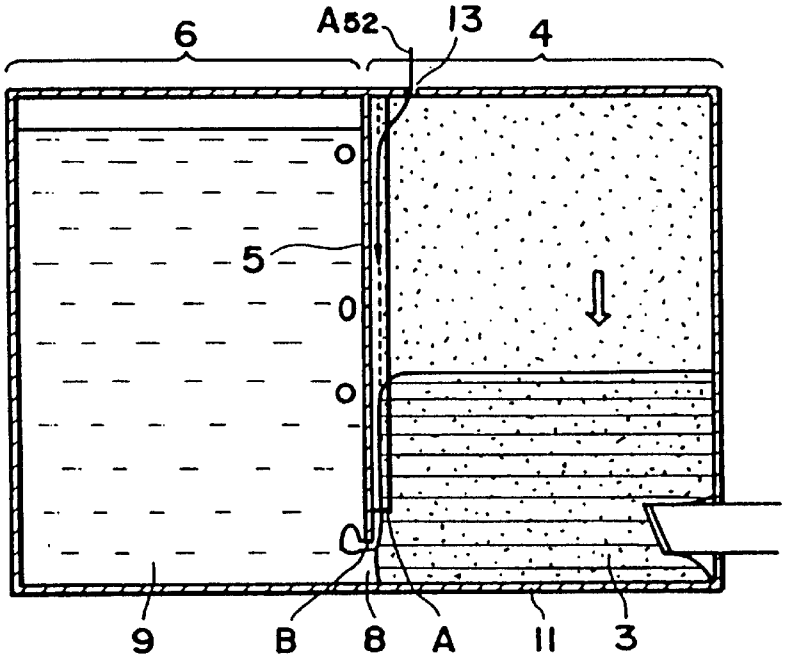

FIGS. 5A, 5B and 5C show a device according to another embodiment.

In this embodiment, two ribs or projections 61 provide a groove on the surface of partition rib 5 of the vacuum producing material container 4. The air introduction passage A51 is established between the ribs and the absorbing material 3. The bottom end A of the rib 61 is placed above the bottom end B of the rib 5, so that the clearance 8 can be covered by the absorbing material 3 simply by inserting a rectangular parallelopiped absorbing material 3 into the vacuum producing material container 4. Therefore, the air introduction passage A51 can be extended to a position very close to the clearance 8 without difficulty and with stability. Arrow A52 shows the flow of the air.

Using this ink container, the printing operation has been actually carried out, and it has been confirmed that the ink surface and the meniscus as shown in FIG. 5A can be quickly established by the ink supply due to the recording operation, and the sharp exchange between the air and the ink is carried out by the meniscus breakdown, and therefore, the ink can be supplied with small pressure loss, so that the high speed printing operation can be carried out with stability.

Embodiment 3

Figure 6B:
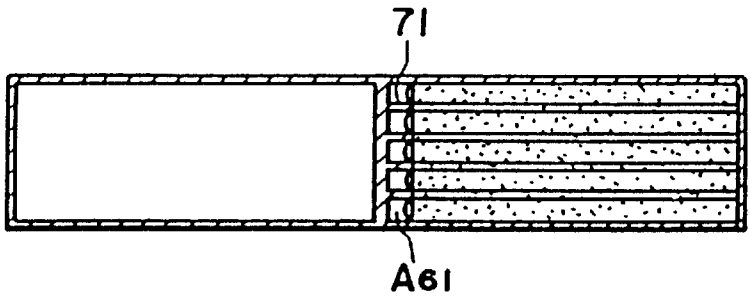
FIGS. 6A, 6B and 6C are respectively a longitudinal sectional view, a longitudinal cross-sectional view and a vertical cross-sectional view, illustrating an ink cartridge according to a further embodiment of the present invention.
Figure 6C:
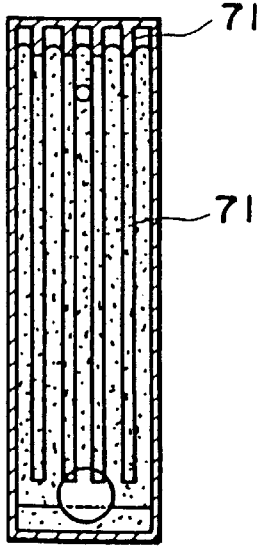
Figure 6A:
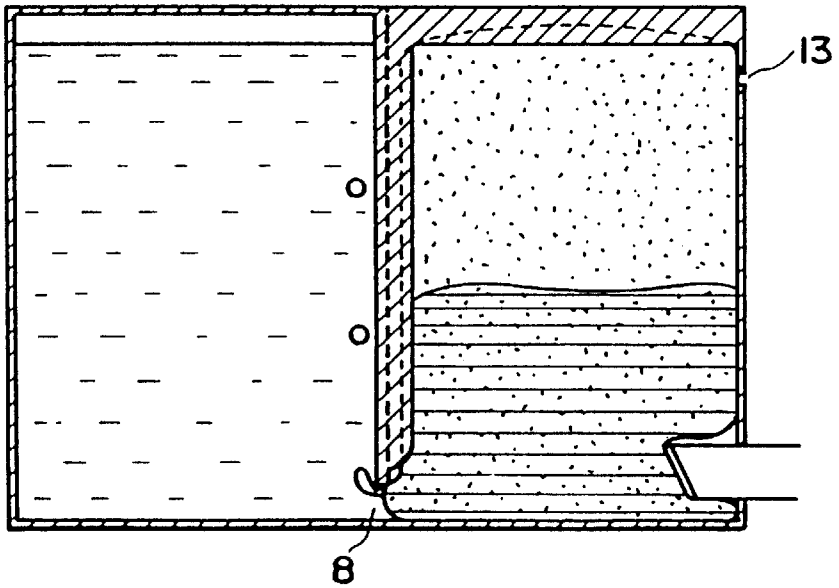

FIGS. 6A, 6B and 6C show the device of the third embodiment in which the number of ribs 71 is increased, thus increasing the number of air introduction passages. The ribs 71 are provided on the sealing of the vacuum producing material container. According to this embodiment, the plurality of air introduction passages A61 can be provided with stability from the air vent 13 to the neighborhood of the clearance 8, and therefore, the ink supply can be carried out with small pressure loss, as in the first and second embodiments, so that a high speed printing operation can be carried out with stability.

In this embodiment, even if the air vent 13 is disposed at a position remote from the clearance 8, the air can be introduced smoothly.

Embodiment 4

Figure 7B:
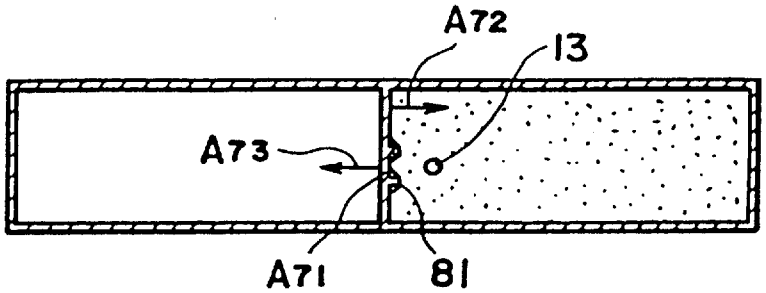
FIGS. 7A, 7B and 7C are respectively a longitudinal sectional view, a longitudinal cross-sectional view and a vertical cross-sectional view, illustrating an ink cartridge according to a further embodiment of the present invention.
Figure 7A:
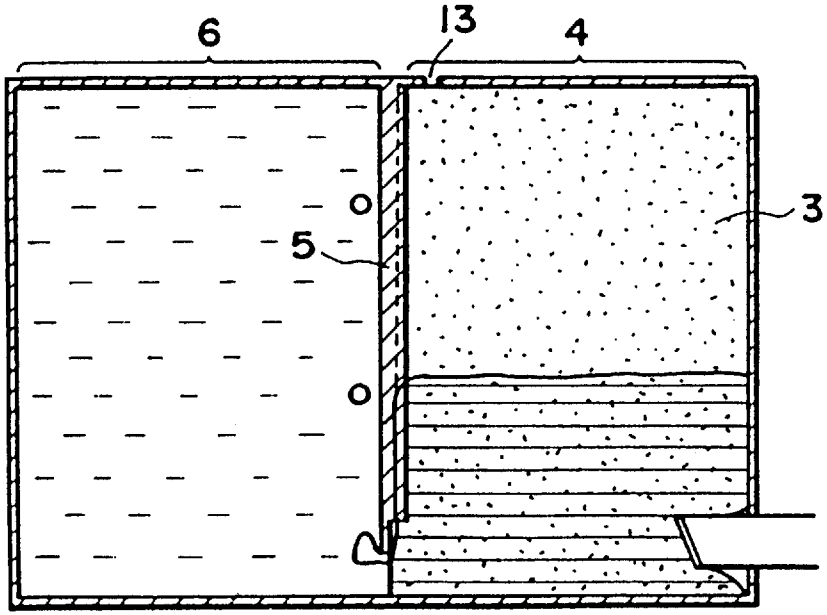
Figure 7C:
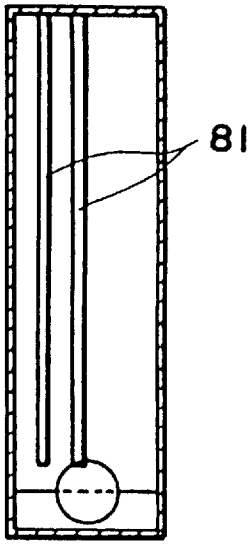

FIGS. 7A, 7B and 7C show a device according to a fourth embodiment of the present invention.

In this embodiment, similarly to the embodiments 2 and 3, ribs 81 are provided on the partition rib to provide the air introduction passage A71. The ribs 81 are asymmetrical about the rib 5, so that the passage for the ink flow from the ink container 6 through the clearance 8 into the vacuum producing material container 4, and the passage of the air flow A73, corresponding to this ink flow A72, along the air introduction passage A71, through the clearance 8 into the ink container 6, can be made independent relative to the center line; therefore, the pressure loss by the exchange can be reduced.

More particularly, this structure is effective to reduce the pressure loss ΔP required for the exchange between the ink and the air by approximately one half.

Thus, the ink can be stably ejected from the recording head.

Embodiment 5

Figure 8B:
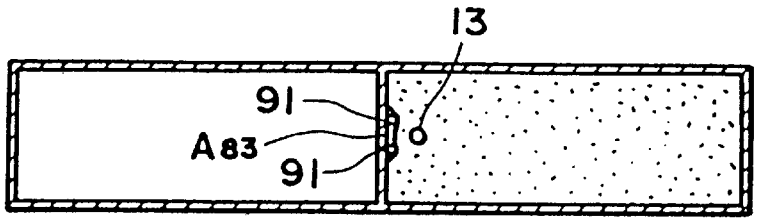
FIGS. 8A, 8B and 8C are respectively a longitudinal sectional view, a longitudinal cross-sectional view and a vertical cross-sectional view, illustrating an ink cartridge according to a further embodiment of the present invention.
Figure 8C:
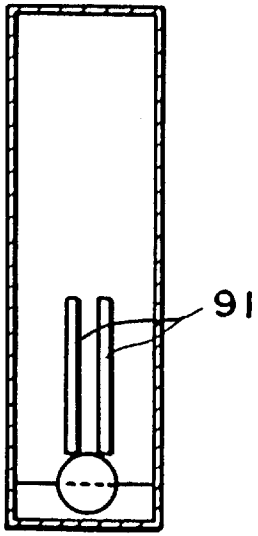
Figure 8A:
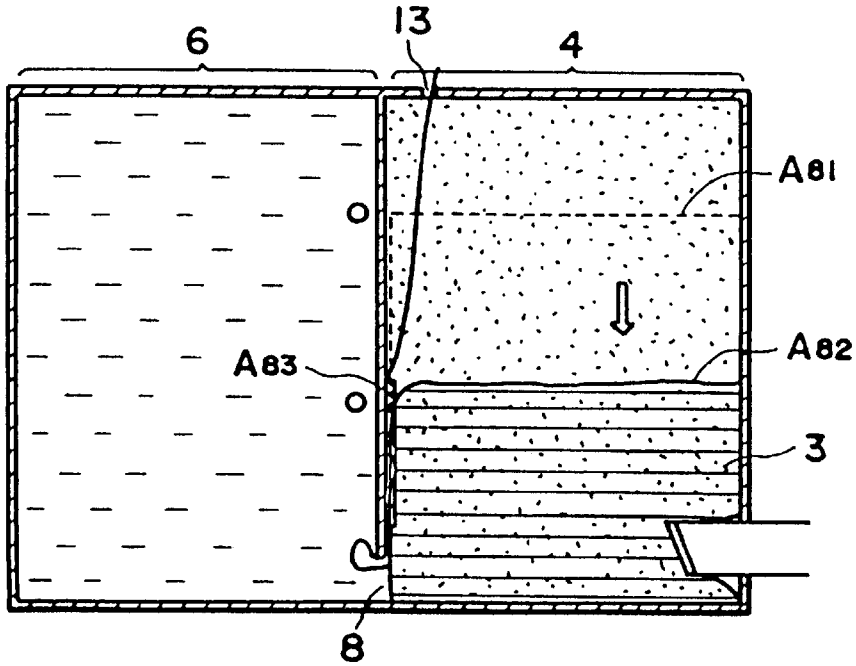

FIGS. 8A, 8B and 8C show a device according to a further embodiment. The device is provided with ribs 91. In the embodiments 2–4, the top end of the ribs 91 are extended to the upper part of the internal surface of the wall of the vacuum producing material accommodator 4. However, in this embodiment, they are not extended to such extent. By doing so, the top part of the absorbing material is not compressed by the ribs 91, so that the production of the meniscus force at the compressed portion can be avoided, thus further stabilizing the vacuum control.

More particularly, the ink is consumed from the absorbing material 3 until the ink surface A81 in the absorbing material (vacuum producing material) 3 moves to the stabilized ink surface A82 in the initial ink container from which the ink is consumed. That is, if the air-liquid exchange through the air introduction passage air A83 is promoted too soon, the consumption of the ink from the absorbing material 3 becomes low; as a result, the ink is consumed from the ink container. Therefore, the amount of the ink capable of moving to the vacuum producing material container 4 from the ink container 6 at the time of the ambient condition change such as pressure change, is limited. Therefore, the buffering effect of the absorbing material 3 against the ink leakage can be reduced. In this embodiment, the air introduction passage A83 is provided so that the air is introduced only after the ink is consumed from the absorbing material 3 to a certain extent, so that the ink surface in the absorbing material 3 is controlled, thus increasing the buffering effect against the ink leakage.

Embodiment 6

Figure 9B:
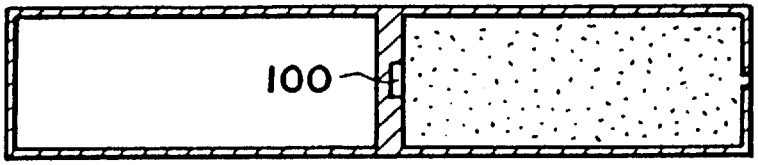
FIGS. 9A, 9B and 9C are respectively a longitudinal sectional view, a longitudinal cross-sectional view and a vertical cross-sectional view, illustrating an ink cartridge according to a further embodiment of the present invention.
Figure 9C:
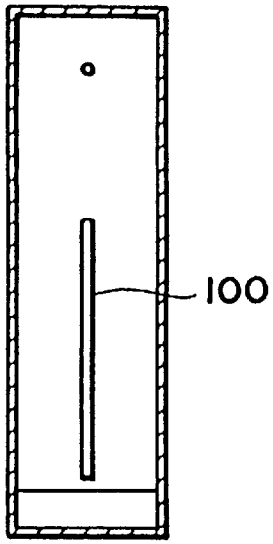
Figure 9A:
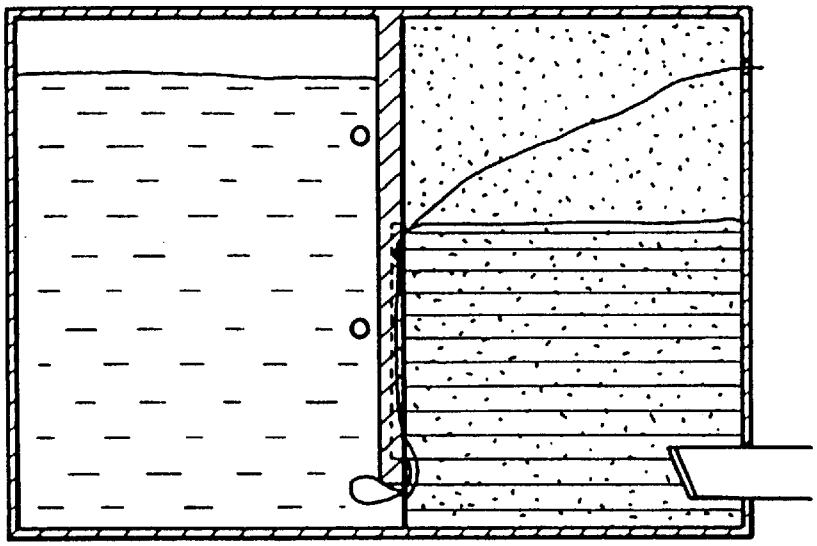

FIGS. 9A, 9B and 9C show another embodiment.

In this embodiment, the air introduction passage is provided by forming a groove provided by a channel 100 in the partition rib or wall.

According to this embodiment, the irregularity of the compression ratio of the absorbing material contained in the vacuum producing material container is reduced, and therefore, the vacuum control is easy, so that the ink can be supplied stably.

Embodiment 7

Figure 19B:
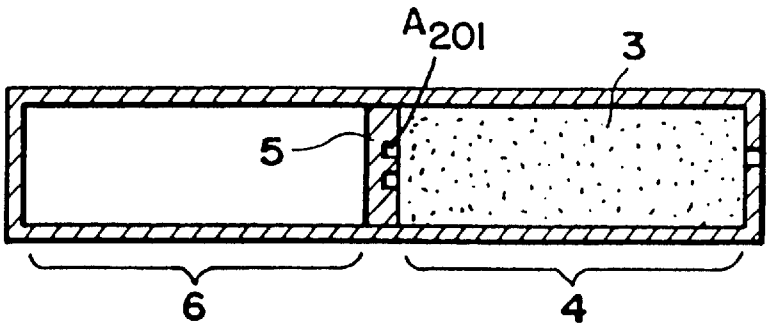
FIGS. 19A, 19B and 19C are respectively a longitudinal sectional view, a longitudinal cross-sectional view and a vertical cross-sectional view, illustrating an ink cartridge according to a further embodiment of the present invention.
Figure 19C:
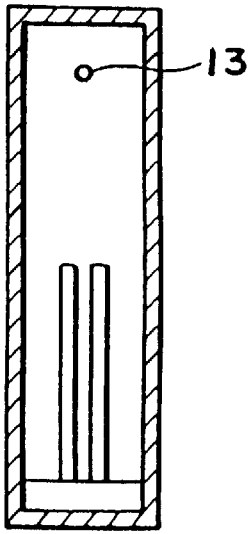
Figure 19A:
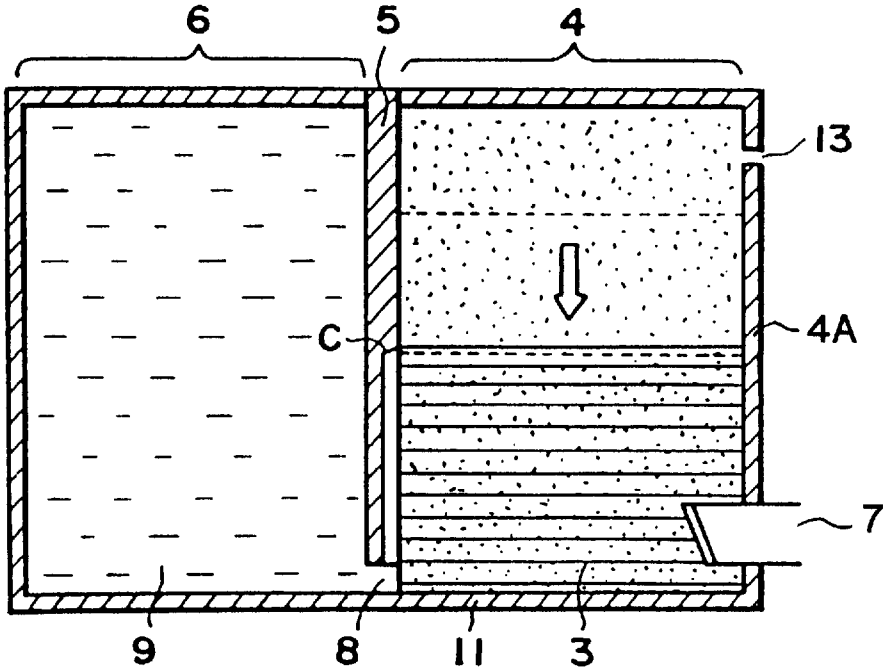

FIGS. 19A, 19B and 19C show a further embodiment.

The structure is similar to that of the FIG. 6 embodiment, with a first chamber 6 containing a reservoir of liquid ink 9 and a second chamber 4 containing a sponge-like material 3, in communication through an opening 8 formed by the partition 5. However, it is different therefrom in that the air introduction flow passage extends to the bottom end of the partition 5.

Similarly to Embodiments 5 and 6, for example, the ink is consumed from the sponge-like absorbing material 3 until the ink surface in the absorbing material 3 in the second ink chamber 4 at the initial stage of the ink consumption displaces to the stabilized ink surface position (shown by a solid line) at an end C of the air introduction passage A201. Thereafter, the liquid ink 9 in the first ink chamber 6 is consumed, while the air-liquid exchange is carried out through the air flow passage. Since the air introduction passage extends to the bottom end of the partition, the structure is equivalent to the model shown in FIG. 20. A description will be made as to the model of FIG. 20 in detail.

Figure 20:
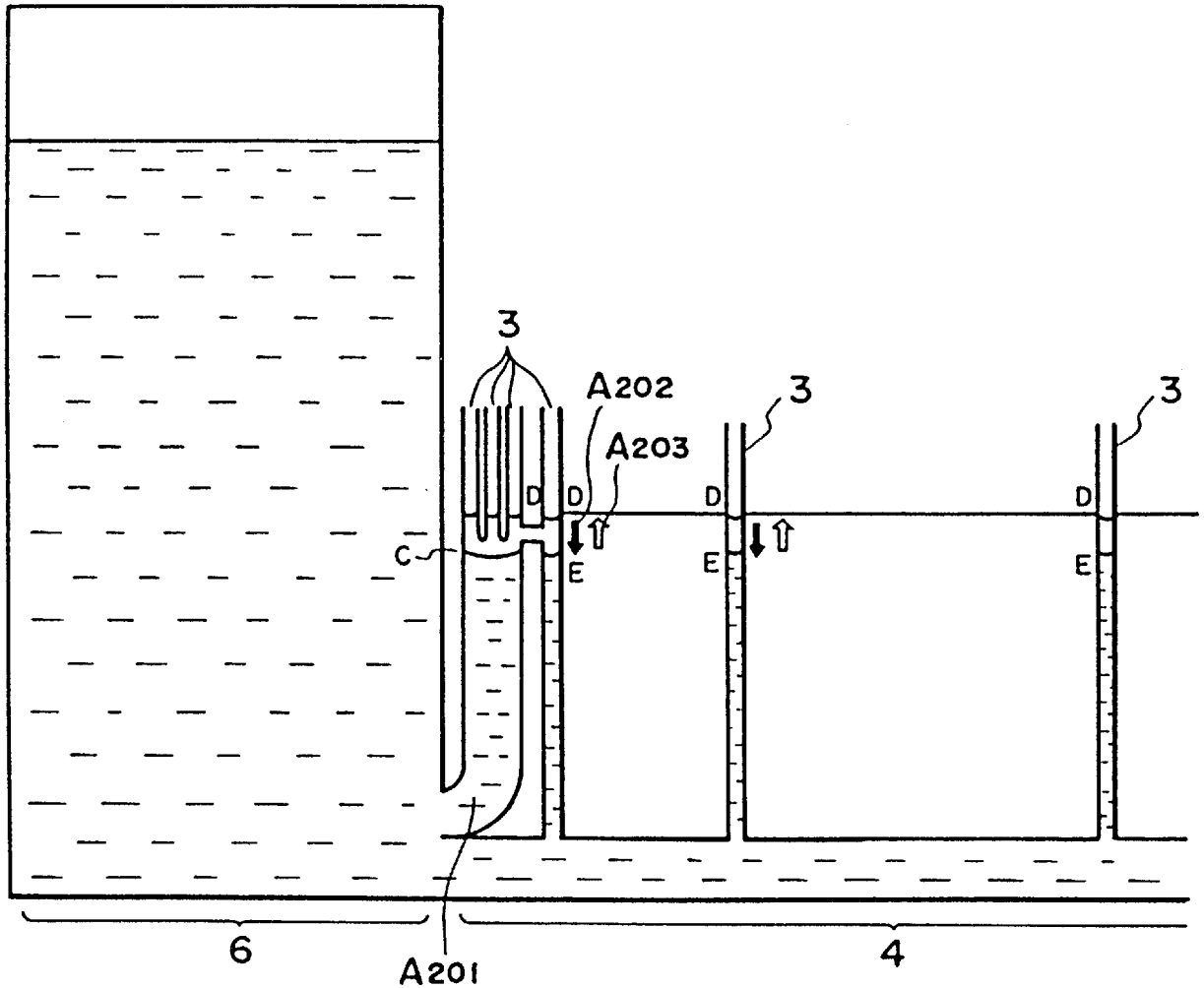
FIG. 20 shows a model of ink supply.

The absorbing material 3 is considered as capillary tubes shown in FIG. 20. The air introduction passage A201 continues from the portion C to the bottom end of the partition, and it is considered that the air introduction passage A201 is connected again to the capillary tube at the portion above the portion C.

As described hereinbefore, the ink surface in the absorbing material 3 is at a certain level (shown by the upper dotted line in FIG. 19A) at the initial stage of the ink consumption. However, in accordance with the consumption of the ink, the surface lowers gradually. In accordance with it, the internal pressure in the ink supply portion (negative pressure) increases gradually.

When the ink is consumed to the level C at the top end of the air introduction passage A201, a meniscus is formed at a position D in the capillary tube. When the ink is further received and consumed, the ink meniscus, that is, in the ink surface, lowers again. If the position E is reached, the meniscus force of the ink surface in the air introduction passage suddenly decreases, so that the ink can be consumed at once in the air introduction passage. Thereafter, the ink is consumed from the ink container, with this position maintained. That is, the air-liquid exchange is carried out. In this manner, during the ink consumption, the ink surface is stabilized at a position slightly lower than the height C, and therefore, the internal pressure in the ink supply portion is stabilized. When the ink supply stops, the meniscus in the capillary tube returns from position E to the position D, thus providing the stabilization.

As described in the foregoing, the ink surface in the absorbing material reciprocates between the positions D and E until all of the ink is used up in the ink container. In the Figure, A202 indicates ink supply period, and A203 indicates non-ink-supply period.

Thereafter, the ink is consumed from the ink absorbing material, and therefore, the internal pressure (vacuum) in the supply portion increases, and the ink becomes non-suppliable.

The internal pressure at the ink supply portion is provided as a difference between the capillary force of the absorbing material 3 (the height to which the absorbing material 3 can suck the ink up) and the ink surface level height in the absorbing material 3, and therefore, the height C is set at a predetermined level relative to the ink supply outlet 6. From this standpoint, it is desirable that the pore size of the absorbing material 3 be relatively small.

The reason why the height C is set at a predetermined level relative to the ink supply outlet is that if the ink surface is lower than the supply outlet, the air is introduced with the result of improper ink ejection.

However, it is not desirable that the level be higher than the predetermined level, because the buffering effect at the time when the ink is overflowed from the ink container to the absorbing material due to the internal pressure change in the ink container attributable to an ambient condition change, is reduced. In consideration of the above, the volume of the absorbing material above the height C is selected to the substantially one half the volume of the ink container.

The above-described mechanism will be explained in further detail.

It is assumed that the absorbing material has a uniform density. The internal pressure in the ink supply portion (vacuum or negative pressure) is determined as a difference H1−H2 between a height H1 to which the capillary force of the absorbing material can suck the ink up from the ink supply portion level and the height H2 to which the ink has already been sucked up from the height of the ink supply portion.

For example, if the ink sucking force of the absorbing material is 60 mm (H1), and the height of the air introduction passage from the ink containing portion is 15 mm (H2), the internal pressure of the ink supply portion is 45 mm=60 mm−15 mm=H1−H2.

At the initial stage, in accordance with the consumption of the ink from the absorbing material, the height of the liquid surface lowers correspondingly, and the internal pressure lowers substantially linearly.

When the ink container of the above-described structure is used, the ink can be supplied stably by the vacuum.

The structure itself of the ink container is so simple that it can be easily manufactured using a mold or the like, and therefore, a large number of ink containers can be produced uniformly.

When the ink is consumed to such an extent that the surface level of the liquid in the absorbing material is at the air introduction passage A201, that is, position C, or in other words, the ink surface is at E, the meniscus in the air introduction passage A201 cannot be maintained, and therefore, the ink is absorbed into the absorbing material, and the air introduction passage is formed. Then, the air-liquid exchange occurs at once. On the other hand, the liquid surface in the absorbing material rises because of the ink absorbed from the ink container, so that the liquid surface D is established, and the air-liquid exchange stops. In this state, there is no ink in the air introduction passage A201, and the absorbing material above the air introduction passage in the model, functions simply as a valve.

If the ink is consumed again in this state, the liquid surface in the absorbing material lowers slightly, which corresponds to opening of the valve, so that the air-liquid exchange occurs at once to permit consumption of the ink from the ink container 6. Upon completion of the ink consumption, the liquid surface of the absorbing material rises due to the capillary force of the absorbing material. When it reaches the position D, the air-liquid exchange stops, so that the liquid surface is stabilized at that position.

In this manner, the ink liquid surface can be stably controlled according to the height of the air introduction passage A201, that is, the height C, and the capillary force of the absorbing material, that is, the ink sucking height, is adjusted beforehand, so that the internal pressure of the ink supply portion can be controlled easily.

In order to retain the ink overflowed from the first chamber 6 to the second chamber 4 due to the internal pressure change in the ink container due to the ambient condition change, the capillary force of the absorbing material, that is, the ink sucking height is increased, by which the overflow of the ink from the ink container can be prevented, and the occurrence of positive pressure at the ink supply portion can be prevented.

Embodiment 8

Figure 21:
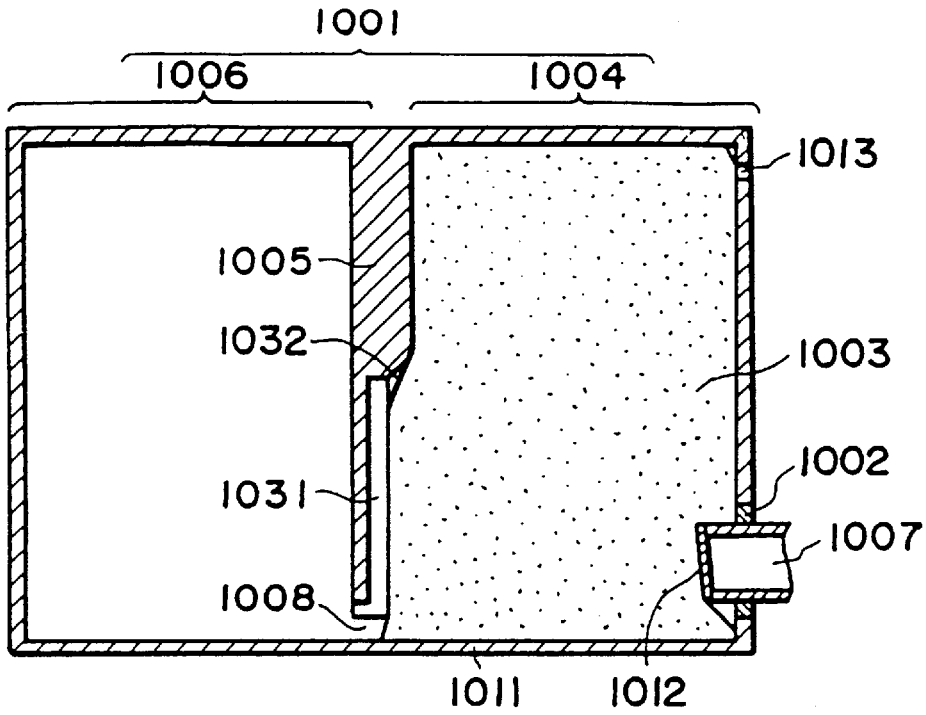
FIG. 21 is a longitudinal sectional view of an ink cartridge according to a further embodiment of the present invention.
Figure 22:
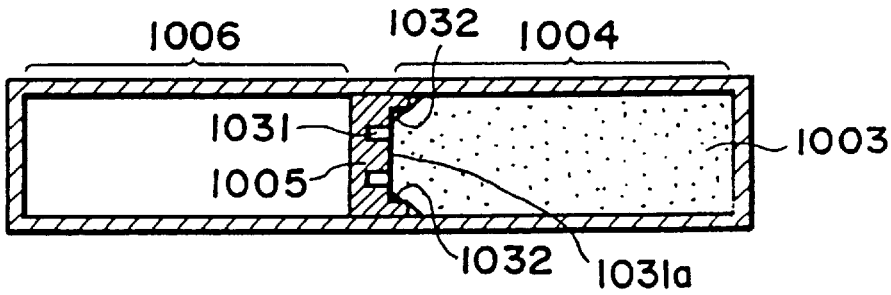
FIG. 22 is a cross-sectional view of the ink cartridge of FIG. 21.
Figure 23:
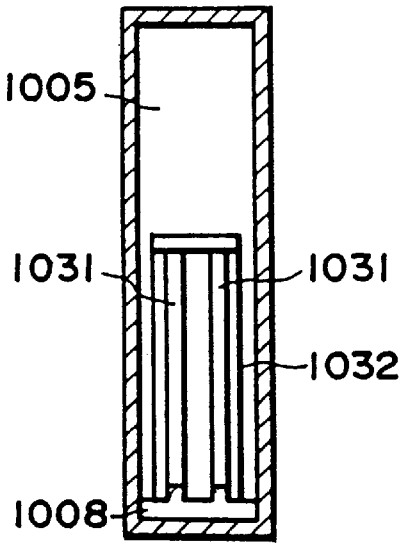
FIG. 23 is a sectional view of the ink cartridge, particularly showing the surface of the partition rib of FIG. 21.

FIG. 21 is a longitudinal sectional view of an ink cartridge 1001 for an ink jet recording apparatus according to an eighth embodiment of the present invention. This ink cartridge also includes an ink supply outlet 1002, an ink port joint member 1007, a filter 1012 and an air vent 1013, similar to the structure shown in FIG. 2. FIG. 22 is a cross-sectional view of the same, and FIG. 23 is a sectional view showing a surface of the rib or partition 1005.

An air introduction groove 1031 and a vacuum producing material adjusting chamber 1032 are formed on a rib 1005 which is a partition wall between the ink container 1006 and the vacuum producing material container 1004. The air introduction groove 1031 is formed at the vacuum producing material container 1004 and is extended from the central portion of the rib 1005 to an end of the rib 1005, that is, to the clearance or opening 1008 formed with the bottom 1011 of the ink cartridge. Between the rib 1005 and the vacuum producing material 1003 contacted to the neighborhood of the air introduction passage 1031 of the rib 1005, the vacuum producing material adjusting chambers 1032 are formed, and are in an excavated form, with the groove 1031 being formed in a recessed portion 1031*a* in the partition.

Since the vacuum producing material 1003 is contacted to the inside surface of the material container 1004, and therefore, even if the vacuum producing material 1003 is non-uniformly squeezed into the material container 1004, the contact pressure (compression) to the vacuum producing material 1003 is partially eased, as shown in FIGS. 21 and 22. Therefore, when the ink consumption from the head is started, the ink contained in the vacuum producing material 1003 is consumed, and reaches to the adjusting chamber 1032. If the ink continues to be consumed, the air can easily break the ink meniscus at the portion where the contact pressure of the vacuum producing material 1003 is eased by the adjusting chambers 1032, and therefore, the air is quickly introduced into the air introduction passage 1031, thus making the vacuum control easier.

In this embodiment, it is desirable to use an elastic porous (i.e., sponge-like) material as the vacuum producing material 1003.

When the recording operation is not carried out, the capillary force of the vacuum producing material 1003 itself (the meniscus force at the interface between the ink and the vacuum producing material), can be used to prevent the leakage of the ink from the ink jet recording head.

Figure 29:
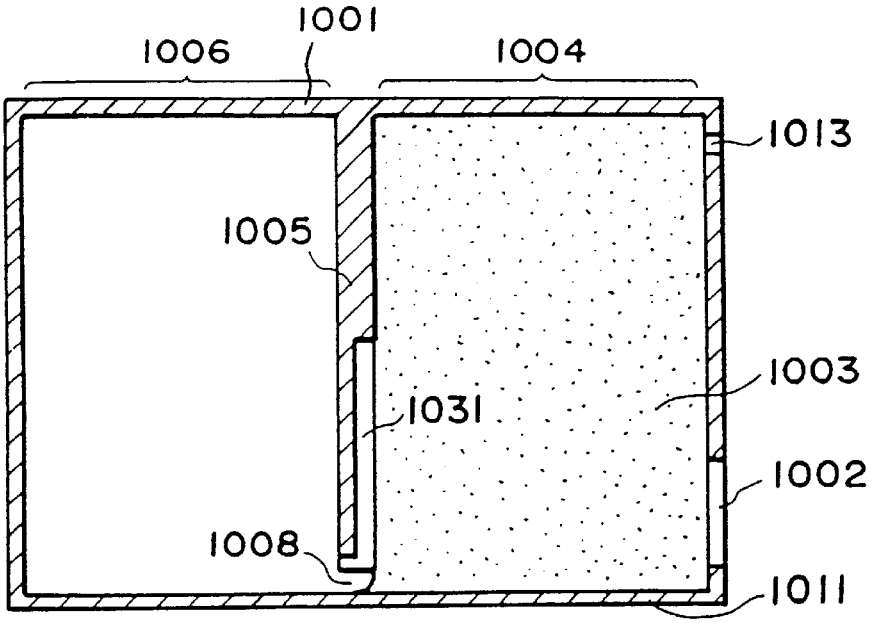
FIG. 29 is a longitudinal sectional view of an ink cartridge in a comparison example.
Figure 30:
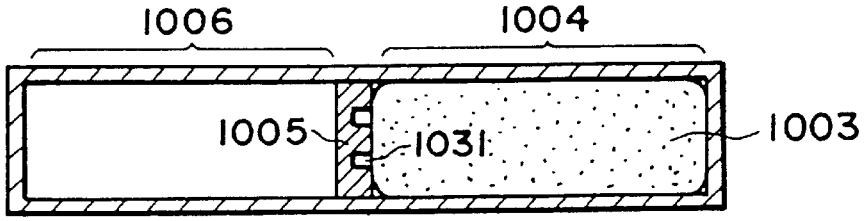
FIG. 30 is a sectional view of an ink cartridge in the comparison example.
Figure 31:
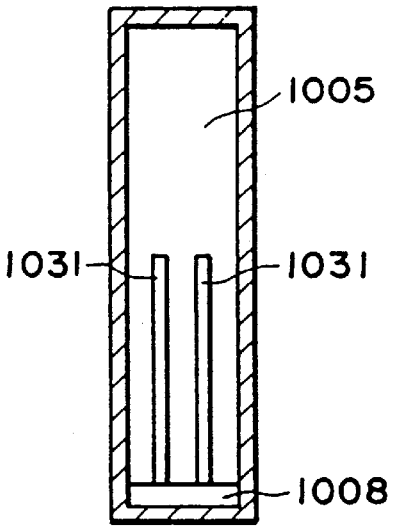
FIG. 31 is a sectional view of the ink container showing the surface of the partition rib in a comparison example.

FIGS. 29–31 show an example of an ink cartridge without the vacuum producing material adjusting chamber 1032, as Comparison Example 2.

Even in the ink cartridge of this Comparison Example, proper operation can be carried out without problem by using the mechanism described in the foregoing, in the usual state. However, further stabilized operation is accomplished because of the provision of the air introduction passage.

In order to even further stabilize the operation, or in order to permit use of porous resin material having continuous pores as the negative pressure producing material, further stabilization control is desirable.

Figure 32:
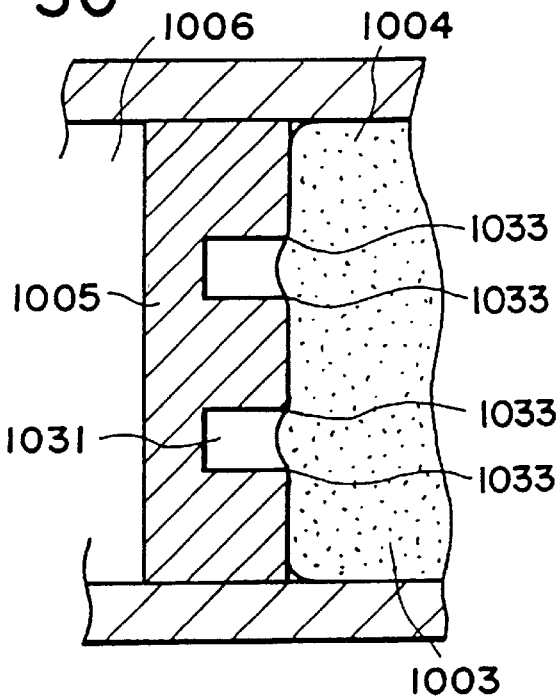
FIG. 32 is an enlarged sectional view, showing the cross-section of the partition rib in the comparison example.

As shown in FIG. 32 which is an enlarged sectional view, the vacuum or negative pressure producing material 1003 contacts the rib 1005, and partly enters the air introduction groove 1031. If this occurs, the contact pressure (compression force) to the material 1003 is not eased at the contact portions 1033. This makes it more difficult for the air to break the ink meniscus and enter the air introduction passage 1031. If this occurs, the air-liquid exchange does not occur even if the ink continues to be consumed, and the effect of the air introduction passage 1031 is not accomplished. There is a liability that the ink becomes non-suppliable from the ink absorbing material 1006.

As contrasted to the Comparison Example 2, as described in the foregoing, this embodiment is advantageous in that it effectively addresses this problem.

Embodiment 9

Figure 24A:
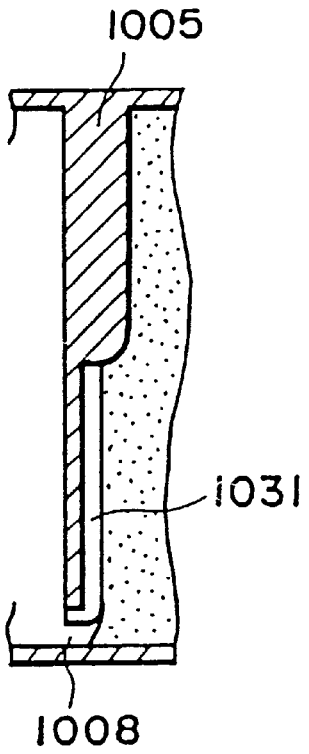
FIGS. 24A and 24B are sectional views of two variations of the ink cartridge, showing the surface of the partition rib according to two further embodiments of the present invention.
Figure 24B:
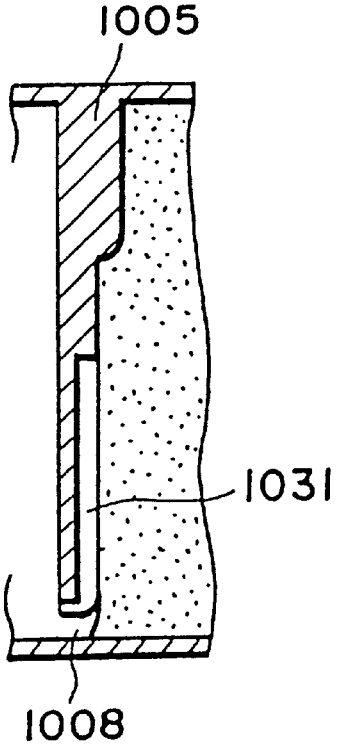
Figure 25:
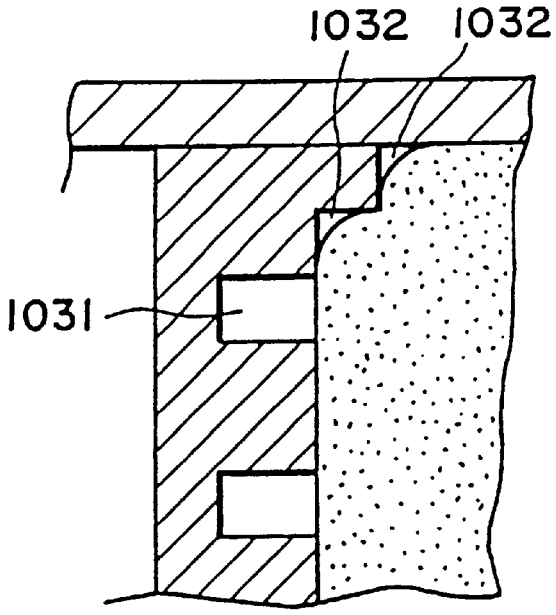
FIG. 25 is an enlarged sectional view of a partition rib according to a further embodiment of the present invention.

FIGS. 24A and 24B are longitudinal sectional views of two ribs 1005 having different cross-sectional profiles. FIG. 25 is an enlarged cross-sectional view of a rib.

As shown in FIG. 24B, the configuration of the vacuum producing material adjusting chamber 1032 and the air introduction groove 1031 in this embodiment are different from those in Embodiment 8.

More particularly, the stepped portion of the rib 1005 contacted to the vacuum producing material 1003 is rounded to further enhance the effect of easing the press-contact and compression.

In the neighborhood of the rib 1005 adjacent the material container 1004 having a rounded surface air is introduced into the ink in the material 1003, and the thus introduced air moves into the ink container 1006. With the movement of the air, the ink in the ink container 1006 is supplied into the material container 1004. In an air-liquid exchanging region, the air is introduced into the ink contained in the material 1003.

In order to carry out the air-liquid exchange more smoothly, it is desirable that the contact pressure between the material 1003 and the material container at a lower portion of the air-liquid exchanging region be greater than in the upper part of the air-liquid exchanging region.

This is because the air can move more smoothly from the gas phase to an ink phase through the capillary tube of the vacuum pressure producing material 1003 whose contacting force is eased.

Figure 26:
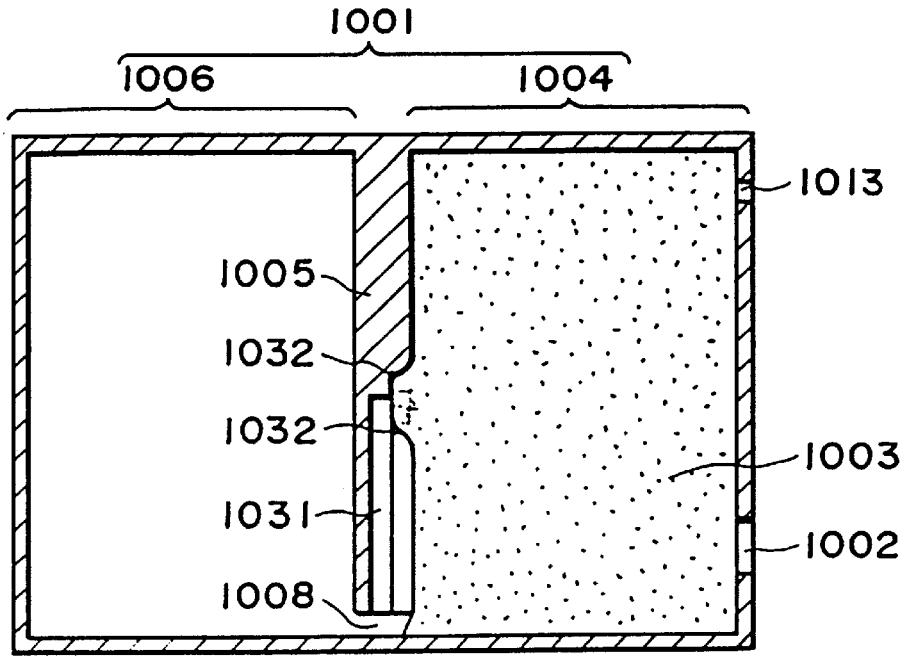
FIG. 26 is a longitudinal sectional view of an ink cartridge according to a further embodiment of the present invention.
Figure 27:
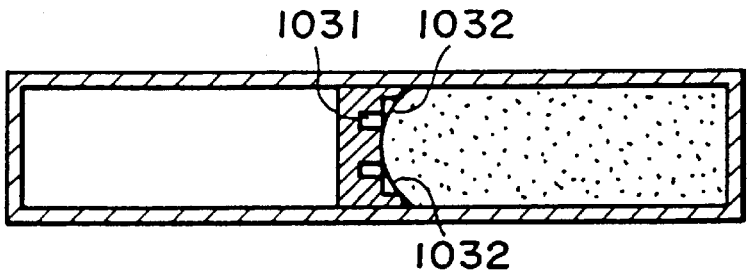
FIG. 27 is a cross-sectional view of an ink cartridge according to a further embodiment of the present invention.
Figure 28:
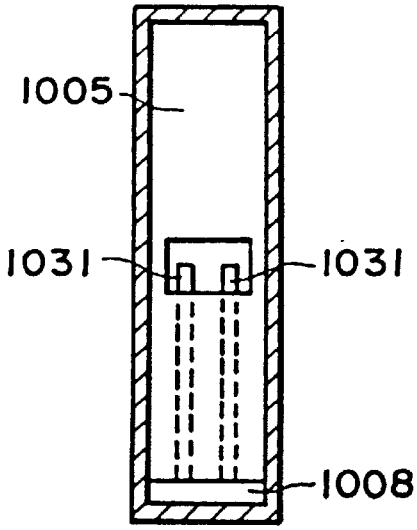
FIG. 28 is a sectional view of an ink cartridge showing the surface of the partition rib according to a further embodiment of the present invention.

For example, the desired effect can be provided by formation of a partial vacuum producing material adjusting chamber 1032 at the central portion of the rib 1005 at the end portion of the air introduction groove 1031. An ink cartridge with a chamber 1032 in this location is shown in FIGS. 26–28.

In order to provide the equivalent function to the vacuum producing material adjusting chamber 1032 of this embodiment, the configuration of the vacuum producing material 1003 may be changed. The configuration and the dimensions are not limited if the above-described requirements are satisfied.

As described in the foregoing, according to this embodiment, the air and the ink in the ink container are stably and smoothly exchanged upon the ink supply operation, and as a result, the internal pressure in the ink supply portion can be stably controlled. This enables the recording head to effect stabilized ink ejection at high speed.

In addition, the ink container is substantially free from ink leakage even if the internal pressure of the ink container changes due to an ambient condition change or the like.

Embodiment 10

Figure 34:
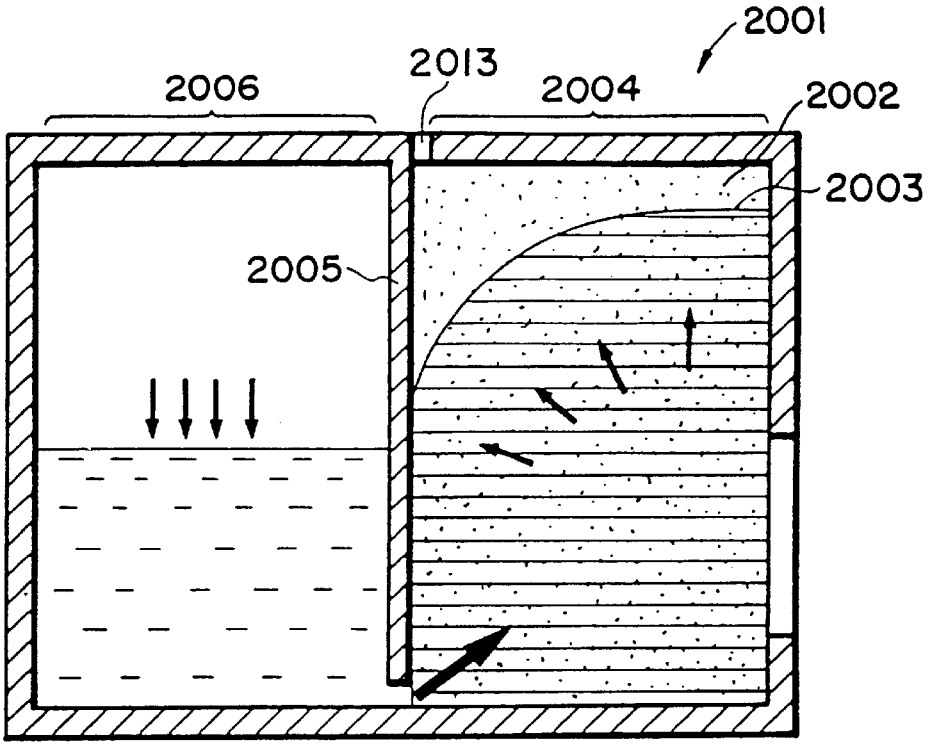
FIG. 34 illustrates leakage ink buffer function of the compressed ink absorbing material in an ink chamber.

The ink container 2001 of this embodiment, as shown in FIG. 34, is a hybrid type in which the inside thereof is partitioned into two ink chambers 2004 and 2006, which communicate with each other at a bottom portion, and wherein an ink absorbing material 2002 having adjusted capillary force is packed in the ink container 2004 substantially without clearance, and there is provided an air vent 2013.

Figure 15:
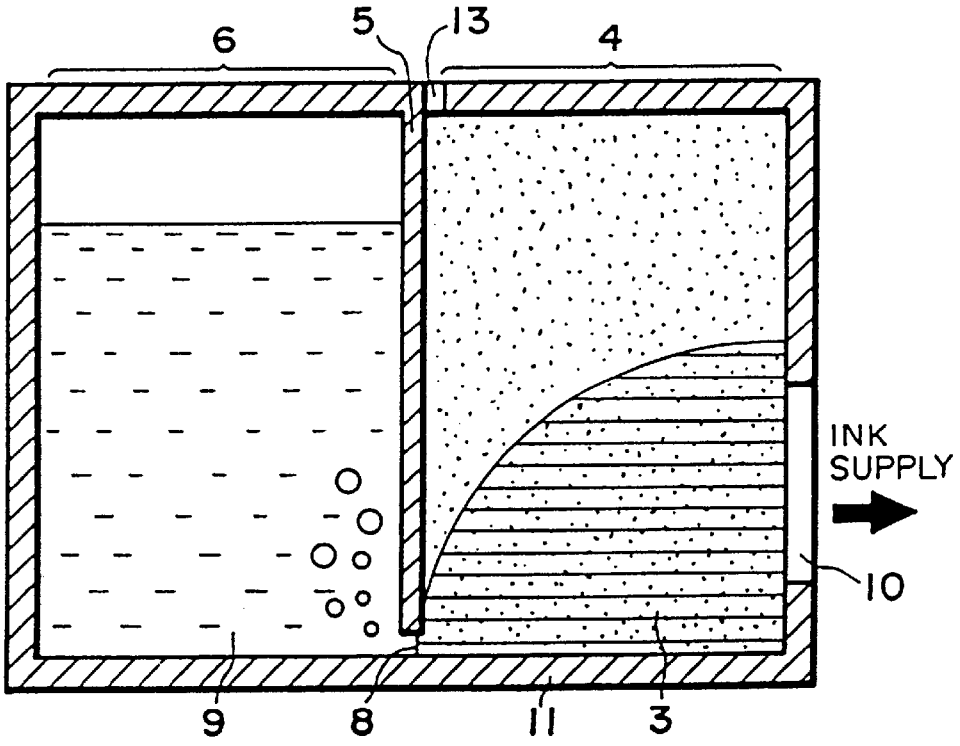
FIG. 15 illustrates a state in which the air-liquid interface starts to be formed.

In the state shown in FIG. 15, the suppliable ink has been supplied from the ink chamber 4 and one half of the ink in the ink chamber 6 has been consumed from the initial state where the ink chambers 4 and 6 are sufficiently filled. In FIG. 15, the ink in the compressed ink absorbing material 3 is maintained at a height at which the static head from the ink ejection part of the recording head, the vacuum in the ink chamber 6 and the capillary force of the compressed ink absorbing material are in balance. When the ink is supplied from the ink supplying portion, the amount of the ink in the ink chamber 4 does not decrease, but the ink is consumed from the ink chamber 6. That is, the ink distribution in the ink chamber 4 does not change, and the ink is supplied from the ink chamber 6 into the ink chamber 4 corresponding to the ink consumption with the balanced internal pressure maintained. Correspondingly, air is introduced through the ink chamber 4 and through the air vent 13.

At this time, as shown in FIG. 15, the ink and the air are exchanged at the bottom of the ink chamber, and the meniscus formed in the compressed ink absorbing material in the ink chamber 4, is partly blocked from the portion close to the ink chamber 6, and the pressure of the ink chamber 6 is balanced with the meniscus retaining force of the compressed ink absorbing material, by the introduction of the air into the ink chamber 6. Referring to FIG. 15, the ink supply and the production of the ink internal pressure in the hybrid type, will be described in more detail. The compressed ink absorbing material adjacent the ink chamber wall is in communication with the air venting portion when the ink in the ink chamber 4 has been consumed to a predetermined extent, and therefore, a meniscus is formed against the atmospheric pressure. The ink internal pressure at the ink supply portion is maintained by the compressed ink absorbing material adjacent to the ink chamber wall which is adjusted to the predetermined capillary force by proper compression. Before the ink flows out, pressure due to the closed space at the top of the ink chamber 6 is balanced with the capillary force of the compressed ink absorbing material adjacent to the ink chamber wall and the static head of the ink remaining in the ink chamber 6, and the meniscus of the compressed ink absorbing material is maintained by the reduced pressure. When the ink is supplied to the recording head through the ink supply portion in this state, the ink flows out of the ink chamber 6, and the pressure of the ink chamber 6 is further reduced corresponding to the consumption of the ink. At this time, the meniscus formed in the compressed ink absorbing material at the bottom of the ink chamber wall is partly broken, so that air is introduced into the ink chamber from which the ink is being consumed, so that the pressure of the excessively pressure-reduced ink chamber 6 is balanced with the meniscus retaining force of the compressed ink absorbing material and the static head of the ink itself in the ink chamber 6. In this manner, the internal pressure of the ink supply portion is maintained at a predetermined level by the capillary force of the compressed ink absorbing material at the position adjacent to the bottom end of the ink chamber wall.

FIG. 34 illustrates the function of the compressed absorbing material as the buffering material. It shows the state in which the ink in the ink chamber 2006 has been flowed out into the ink chamber 2004 due to the expansion of the air in the ink chamber 2006 due to the temperature rise or the atmospheric pressure reduction or the like, from the state shown in FIG. 15. In this embodiment, the ink flowed into the ink chamber 2004 is retained in the compressed absorbing material 2003.

A description will now be made of the desirable conditions regarding the compressed ink absorbing material and the ink chamber structure in the hybrid type container.

Figure 65:
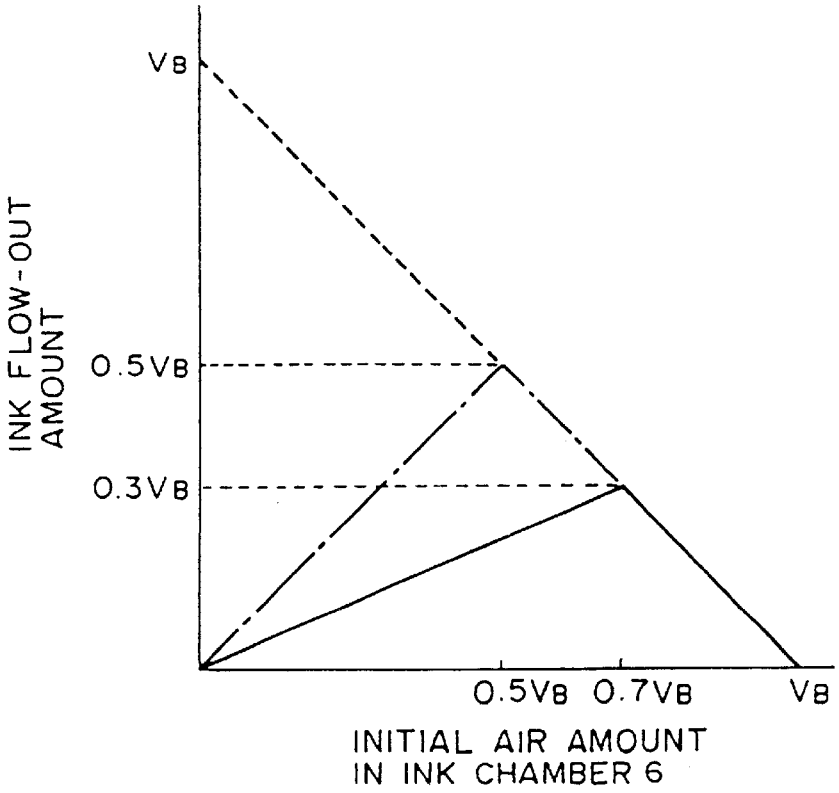
FIG. 65 shows the ink flowing amount upon the pressure decrease.

The relationship between the ink absorbing quantity of the compressed ink absorbing material and the ink chamber is determined from the standpoint of preventing ink leakage when the ambient pressure or the temperature changes. The maximum ink absorbing quantity of the ink chamber 2004 is determined from consideration of the quantity of the ink flowed out from the ink chamber 2006 in the worst predictable condition, and the ink quantity retained in the ink chamber 2004 at the time of ink supply from the ink chamber 2006. The ink chamber 2004 has a volume capable of accommodating at least such an ink quantity by the compressed absorbing material. FIG. 65 shows a graph in which a solid line shows a relationship between the initial space volume of the ink chamber 2006 before the pressure reduction and the quantity of flowed ink when the pressure is reduced to 0.7 atm. In the graph, the chain line shows the case in which the maximum pressure reduction is 0.5 atm. As for the estimation of the quantity of the ink flowed out of the ink chamber 2006 under the worst condition, the quantity of the ink flow from the ink chamber 2006 is maximum with the condition of the maximum reduced pressure being 0.7 atm, when 30% of the volume VB of the ink chamber 2006 remains in the ink chamber 2006. If the ink below the bottom end of the ink chamber wall is also absorbed by the compressed absorbing material in the ink chamber 2004, it is considered that all of the ink remaining in the ink chamber 2006 (30% of VB) is leaked out. When the worst condition is 0.5 atm, 50% of the volume of the ink chamber 2006 is flowed out. The air in the ink chamber 2006 expanding by the pressure reduction is larger if the remaining amount of the ink is smaller. Therefore, a larger ink is pushed out. However, the maximum amount of the flowed ink is lower than the quantity of the ink contained in the ink chamber 2006. Therefore, when 0.7 atm is assumed, when the amount of the remaining ink becomes not more than 30%, the remaining amount of the ink becomes lower than the expanded volume of the air, so that the amount of ink flowed into the ink chamber 2004 reduces. Therefore, 30% of the volume of the ink chamber 2006 is the maximum leaked ink quantity (50% at 0.5 atm). The same applies to the case of the temperature change. However, even if the temperature increases by 50° C., the amount of the flowed out ink is smaller than the above-described pressure reduction case.

If, on the contrary, the atmospheric pressure increases, the pressure difference between the air at low pressure because of the ink static head in the upper portion of the ink chamber 2006 and the increased ambient pressure is too large, and therefore, there is a tendency to return to the predetermined pressure difference by introduction of ink or air into the ink chamber 2006. In such a case, similarly to the case of ink supply from the ink chamber 2006, the meniscus of the compressed ink absorbing material 2003 adjacent to the bottom end portion of the ink chamber wall 2005 is broken, and therefore, the air is mainly introduced into the ink chamber 2006 into the pressure balance state, so that the internal pressure of the ink supply portion hardly changes without substantial influence to the recording property. In the foregoing example, when the ambient pressure returns to the original state, the amount of the ink corresponding to the introduced air into the ink chamber 2006 flows from the ink chamber 2006 into the ink chamber 2004, and therefore, similarly to the foregoing embodiment, the amount of the ink in the ink chamber 2004 temporarily increases with the result of rise of the air-liquid interface. Therefore, similarly to the initial state, the ink internal pressure is temporarily slightly more positive than that at the stabilized state; however, the influence on the ink ejection property of the recording head is so small that there is no practical problem. The above-described problem arises when, for example, the recording apparatus used under a low pressure condition such as a high altitude location is moved to a low altitude location having normal atmospheric pressure. Even in that case, what occurs is only the introduction of the air into the ink chamber 2006. When it is used after being moved to the high altitude location again, what occurs is only a slight increase of the ink internal pressure in the ink supplying portion. Since the use of the apparatus under the condition of extremely high pressure over the normal atmospheric pressure is not feasible, there is no practical problem.

The ink is positively retained in the ink chamber 2004 by the compressed ink absorbing material 2003 in the ink chamber 2004 from the start of the use of the ink container to immediately before the exchange thereof. Since the ink chamber 2006 is closed, there is no ink leakage from the opening (air vent and the ink supply portion), which permits easy handling.

As for the size of the communicating part between the ink chambers formed at the bottom portion of the ink chamber wall 2005, it is not less than a size incapable of formation, at the communication part, or the ink in the ink chamber 2006 which is closed at the top, as a first condition. The size is selected such that in response to the maximum ink supply speed from the ink supplying portion (ink supply speed at the time of solid black printing or the sucking operation by the main assembly of the recording apparatus), smooth air-liquid exchange is carried out through the communication opening in consideration of the nature of the ink such as its viscosity. However, a consideration should be given to the fact that when the top surface of the ink remaining in the ink chamber 2006 becomes lower than the bottom portion of the ink chamber wall 2005, as described hereinbefore, the internal pressure at the ink supply portion changes temporarily in the positive direction, and therefore, the size is selected to avoid the influence of this event on the ink ejection property of the recording head.

As described in the description of the operation of the ink container, in the hybrid type ink container, the ink internal pressure at the ink supply portion is retained by the compressed ink absorbing material 2003 adjacent the ink chamber wall, and therefore, in order to maintain the desired internal pressure at the time of the ink supply from the ink chamber 2006, the capillary force of the compressed ink absorbing material 2003 adjacent the to bottom end portion of the ink chamber wall 2005 is desirably adjusted. More particularly, the compression ratio or the initial pore size is selected such that the capillary force of the compressed ink absorbing material 2003 adjacent to the bottom end of the ink chamber wall 2005 is capable of producing the ink internal pressures required for the recording operation. For example, when the internal ink pressure at the ink supply portion is −h (mm), the compressed ink absorbing material 2003 adjacent to the bottom end of the ink chamber wall 2005 is satisfactory if it has the capillary force capable of sucking the ink to h mm. If the structure of the compressed ink absorbing material 2003 is simplified, the fine pore radius P1 of the compressed ink absorbing material 2003 preferably satisfies:

$$P1=2\gamma \cos \Theta/\rho g h$$

where ρ is the density of the ink, γ is the surface tension of the ink, Θ is a contact angle between the ink absorbing material and the ink, and g is the force of gravity.

While the ink is being supplied from the ink chamber 2006, when the air-liquid interface of the ink in the ink chamber 2004 becomes lower than the top end of the ink supply portion, air is supplied to the recording head. Therefore the air-liquid interface adjacent to the ink supply portion should be maintained at a position higher than the top end of the ink supply portion. Thus, the compressed ink absorbing material 2003 above the ink supply portion is given a capillary force capable of sucking the ink up to the height (h+i), wherein i is the height of the air-liquid interface set position (i mm) above the top of the ink supply portion. Similarly to the above, if the structure of the compressed ink absorbing material is simplified, the radius P2 of the fine pores of the compressed ink absorbing material at the top of the ink supply portion is:

$$P2=2\gamma \cos \Theta/\rho g(h+i)$$

In the above equation, the height (i mm) of the air-liquid interface right above the ink supply portion is satisfactory if it is at a position higher than the top end of the ink supply portion. The ink sucking force (capillary force) is gradually decreased (if the material of the absorbing material is the same, the radius P3 of the fine pores is gradually increased) (FIG. 35), or the capillary force of the compressed ink absorbing material is reduced only adjacent to the ink chamber wall 2005 (FIG. 36), so that the air-liquid interface height gradually decreases toward the ink chamber wall in the further inside portion of the compressed ink absorbing material 2003 in the ink chamber 2004. The capillary force change is connected to the capillary force at the bottom end of the ink chamber wall 2005 (if the material is the same, the pore radius at the location is PI).

Figure 37:
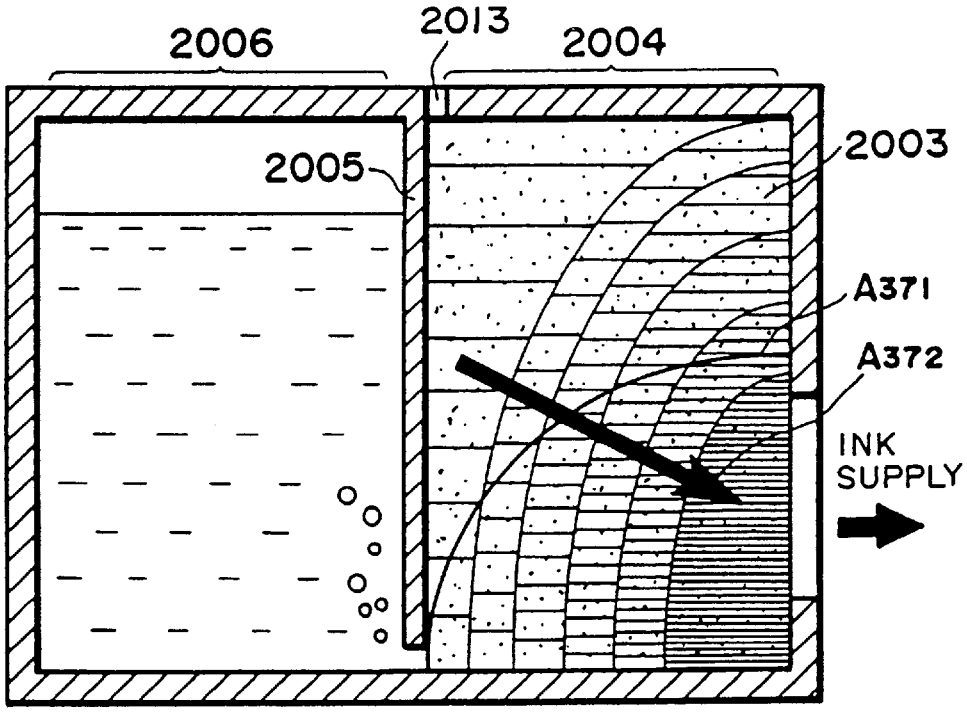
FIG. 37 shows a further example of the compression ratio distribution of the compressed ink absorbing material in the embodiment of FIG. 35.

The capillary force of the portion of the compressed ink absorbing material 2003 which is below the air-liquid interface in the compressed ink absorbing material 2003 may be any if the ink container is not subjected to shock, inclination, rapid temperature change or another special external force. However, in order to permit supply of the ink remaining in the ink chamber 2004 even if such external force is imparted or if the ink in the ink chamber 2006 is all consumed, the capillary force is increased (radius P4 of the fine pores) gradually toward the ink supply portion than the capillary force (radius P1 of fine pores) at the bottom end portion of the ink chamber wall 2005, and the capillary force at the ink supply portion is made larger (radius P5 of the fine pores) (FIG. 37). That is, the adjustment of the capillary force distribution satisfies:

(the capillary force at the end portion of the ink chamber wall)<(the capillary force right above the ink supply portion)

Preferably, (the capillary force at the bottom end portion of the ink chamber wall)<(the capillary force at the bottom portion in the middle of the ink chamber)<(upper position in the middle of the ink chamber)<(right above the ink supply portion)<(ink supply portion)

If the structure of the compressed ink absorbing material 2003 is simplified, the radii of the pores satisfy:

$$P1>P2$$

Preferably, $$P1>(P3, P4)<(P2, P5)$$

As regards the relation between P3 and P4, and the relation between P2 and P5, it may be in accordance with the distribution of the compression ratio such that P3<P4, and P2<P5, or P3=P4, or P2=P5.

Figure 35:
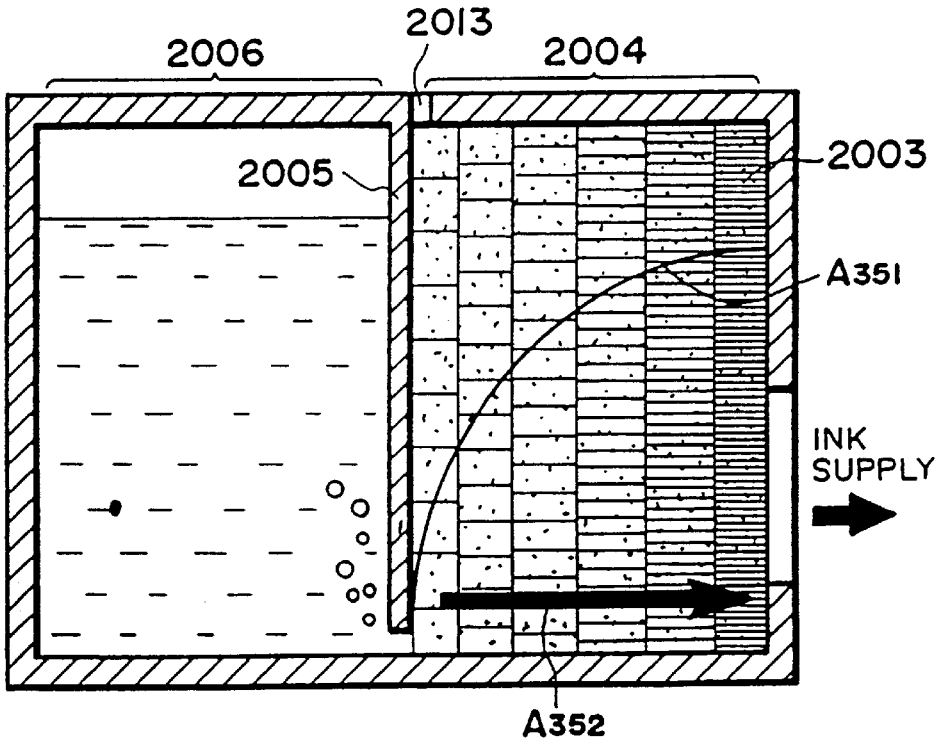
FIG. 35 shows an example of compression ratio distribution of the compressed ink absorbing material, according to a further embodiment of the present invention.
Figure 36:
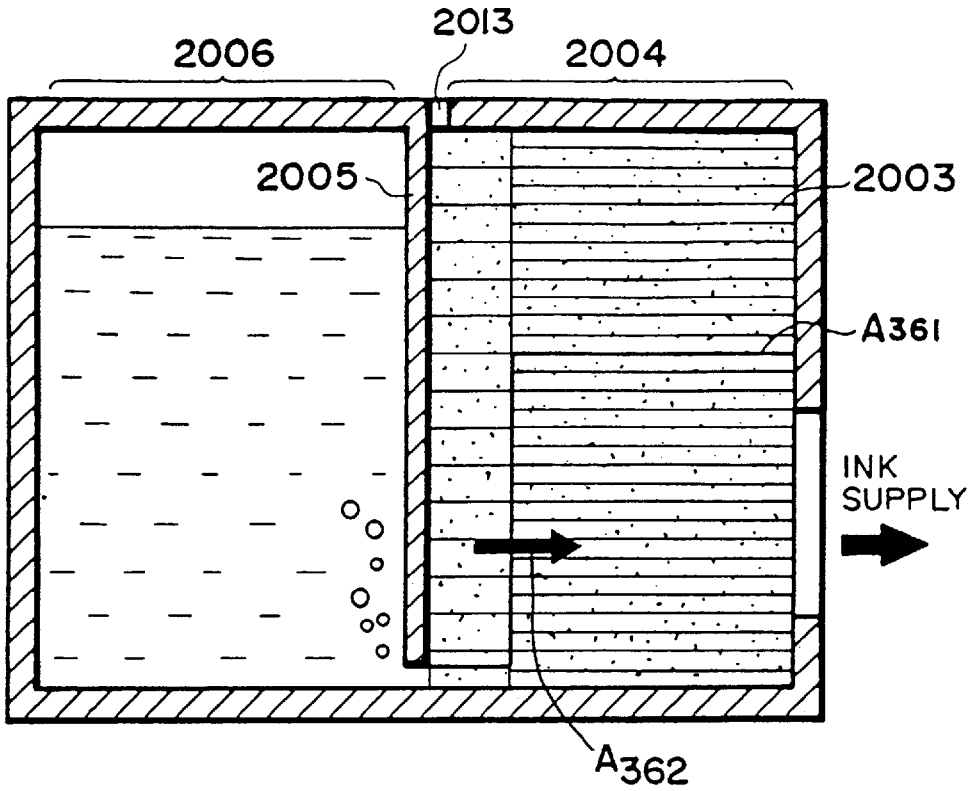
FIG. 36 shows another example of the compression ratio distribution of the compressed ink absorbing material in the embodiment of FIG. 35.

Referring to FIGS. 35, 36 and 37, there is shown a preferable compression ratio distribution as an example in which the above-described relations are satisfied by adjusting the compression ratio, using the same material as the ink absorbing material 2003. In these Figures, A351, A361 and A371 indicate the air-liquid interface, and arrows A352, A362 and A372 indicate the compression ratio of the compressed ink absorbing material which is increasing.

Figure 38:
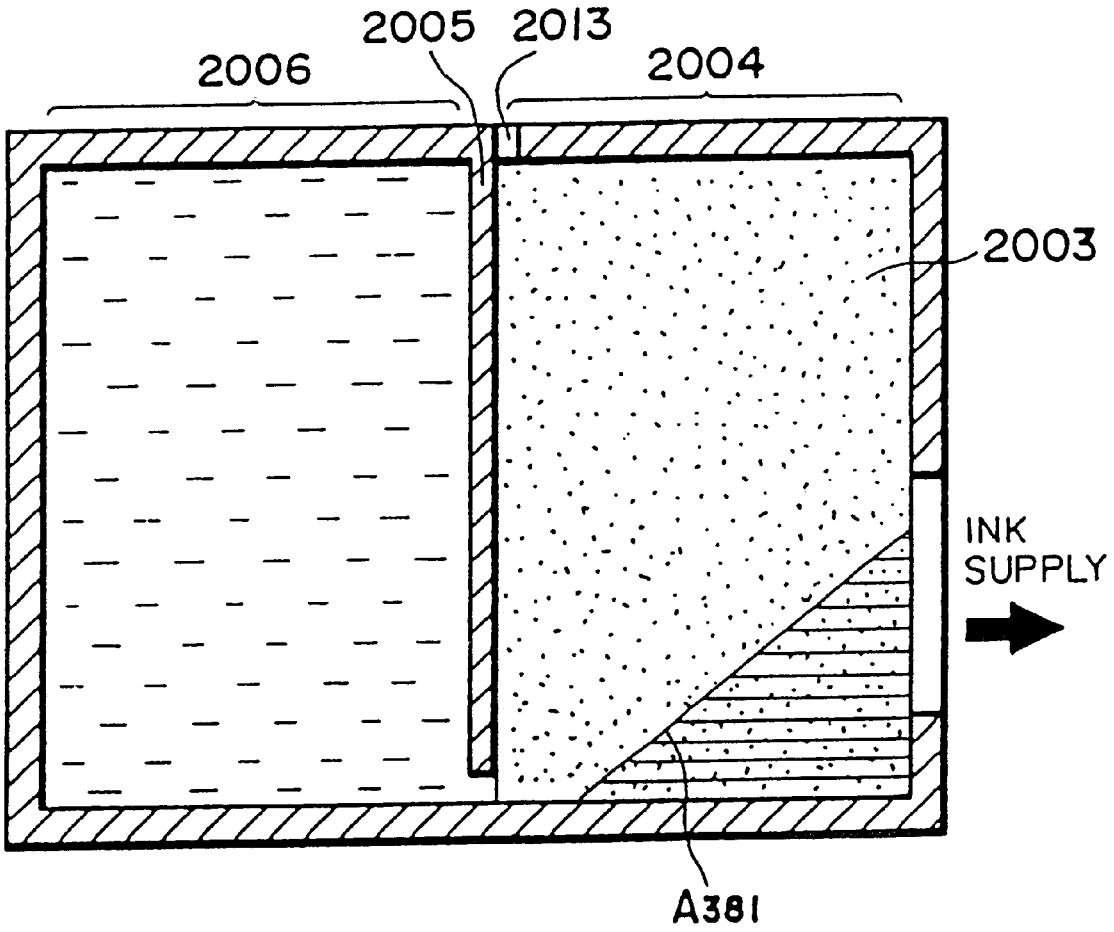
FIG. 38 shows an example of the compression ratio distribution of the compressed ink absorbing material in a comparison example.

FIG. 38 shows Comparison Example 3, in which the capillary force of the compressed ink absorbing material 2003 at the ink supply portion is not larger than that in the neighborhood of the ink chamber wall. The figure shows the state in which the ink has been supplied out to a certain extent from the ink chamber 2004. In this comparison example, and air-liquid interface A381 is formed adjacent to the bottom end portion of the ink chamber wall 2005, and the communication part between the ink chamber 2004 and the ink chamber 2006 is positioned at the air phase side. In this case, the ink can not be supplied out from the ink chamber 2006, and the air introduced through the air vent portion 2013 is directly supplied into the recording head from the ink supply portion, and the ink container becomes non-operable at that time.

Figure 39A:
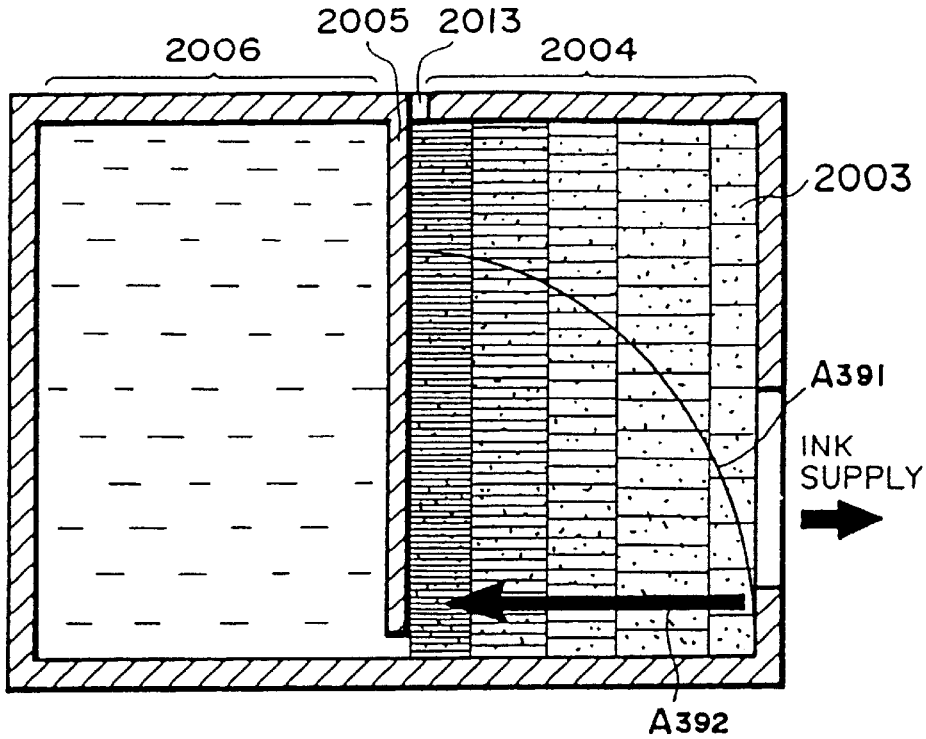
FIGS. 39A and 39B show two further examples of the compression ratio distribution of the compressed ink absorbing material in a comparison example.
Figure 39B:
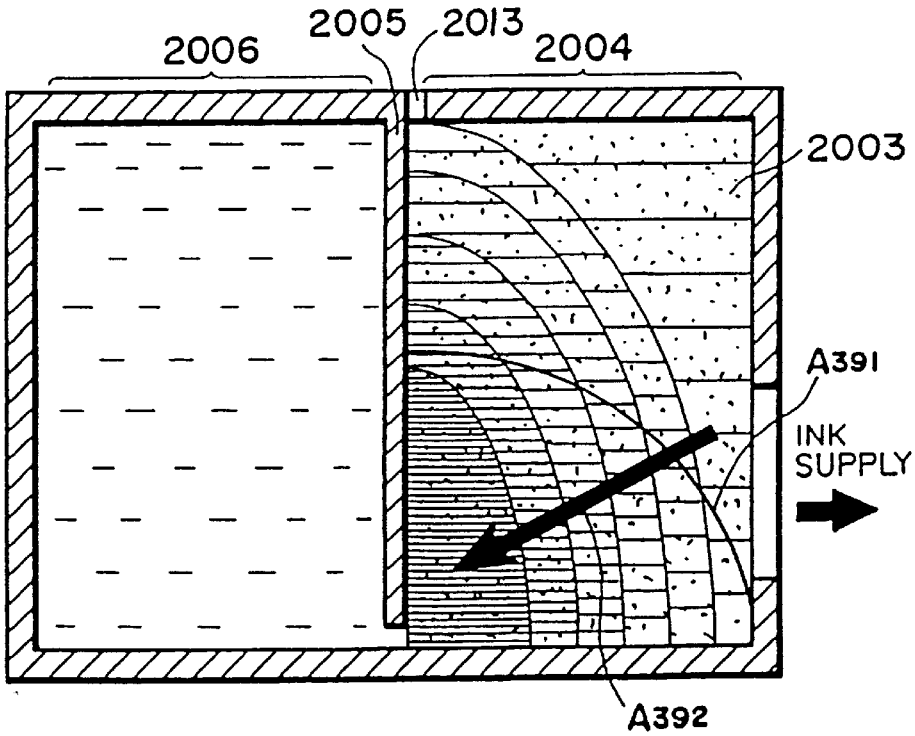

FIGS. 39A and 39B show a Comparison Example 4, in which, contrary to the embodiment of this invention, the capillary force of the compressed ink absorbing material 2003 adjacent to the bottom and portion (FIG. 39B) or the ink chamber wall side (FIG. 39A) is greater than that in the ink supply portion, with the compression ratio increasing in the direction of arrow A392. Similarly to Comparison Example 3, before the air-liquid interface A391 is formed adjacent the bottom end portion of the ink chamber wall 2005, the air-liquid interface decreases beyond the top end of the ink supply portion, and therefore, the ink cannot be supplied from the ink chamber 2006, and therefore, the air introduced through the air vent portion 2013 is directly supplied to the recording head from the ink supply portion. In that event, the ink container is no longer usable.

In the foregoing the description has been made as to a monochromatic recording apparatus having one recording head. However, the embodiments are applicable to a color ink jet recording apparatus having four recording heads (BK, C, M and Y, for example) capable of ejecting different color inks or to a single recording head capable of ejecting different color inks. In that case, means are added to limit the connecting position and direction of the exchangeable ink container.

In the foregoing embodiments, the ink container is exchangeable, but these embodiments are applicable to a recording head cartridge having a unified recording head and ink container.

Embodiment 11

Figure 40:
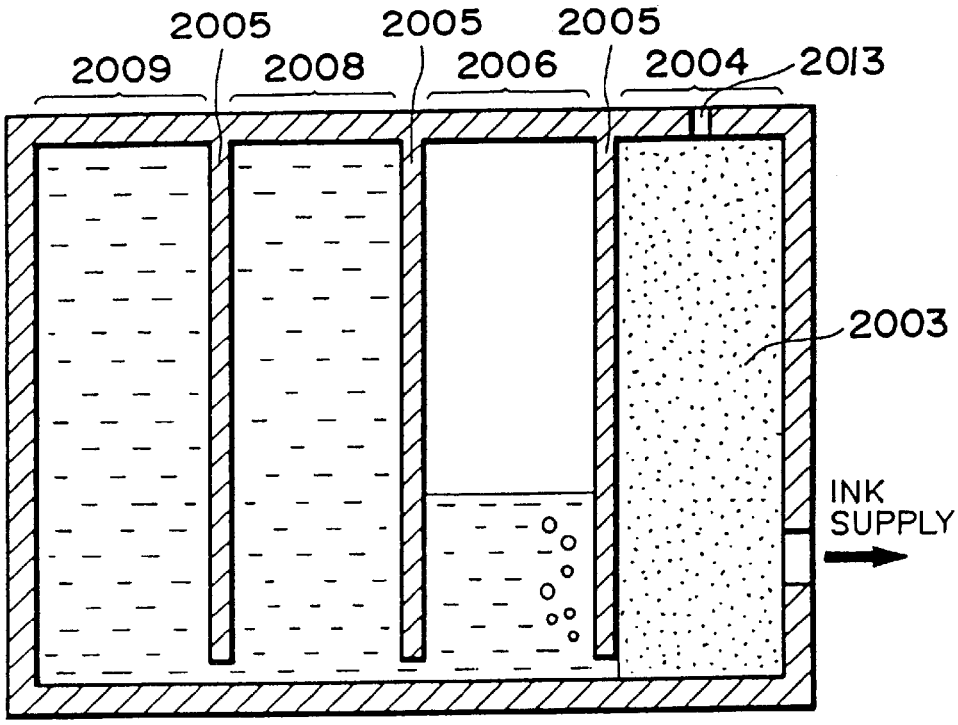
FIG. 40 shows an example of an additional ink chamber, according to a further embodiment of the present invention.
Figure 41:
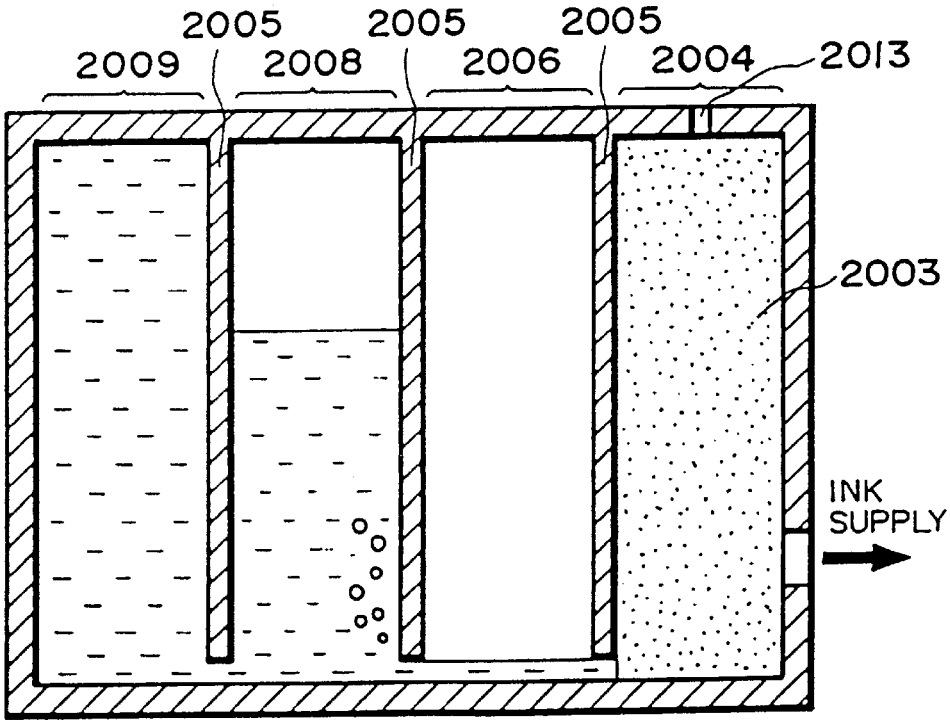
FIG. 41 shows an example of an additional ink chamber in the embodiment of FIG. 40.

FIGS. 40 and 41 show a device according to an eleventh embodiment. An additional two ink chambers 2008 and 2009 are provided in communication with the ink chamber 2006. In this modified example, the ink is consumed in the order of the ink chamber 2006, the ink chamber 2008 and the ink chamber 2009. In this modified example, the ink chamber is separated into four chambers, for the purpose of further better prevention of ink leakage upon an ambient pressure reduction or temperature change which have been described with respect to the foregoing embodiments. If the air is expanded in the ink chamber 2006 and the ink chamber 2008 in the state of FIG. 41, the expanded part of the air in the ink chamber 2006 is released through the ink chamber 2004 and through the air vent portion 2013, and the expanded portion of the ink chamber 2008 is released by the flow of the ink into the ink chamber 2006 and to the ink chamber 2004. Thus, the ink chamber 2004 is given the function of a buffering chamber. Therefore, the ink retention capacity of the compressed ink absorbing material 2003 in the ink chamber 2004 may be determined by considering the leakage quantity from one ink chamber. Therefore, the volume of the compressed ink absorbing material 2003 can be reduced as compared with that in Embodiment 10, and therefore, the ink retention ratio can be increased.

Embodiment 12

Figure 42:
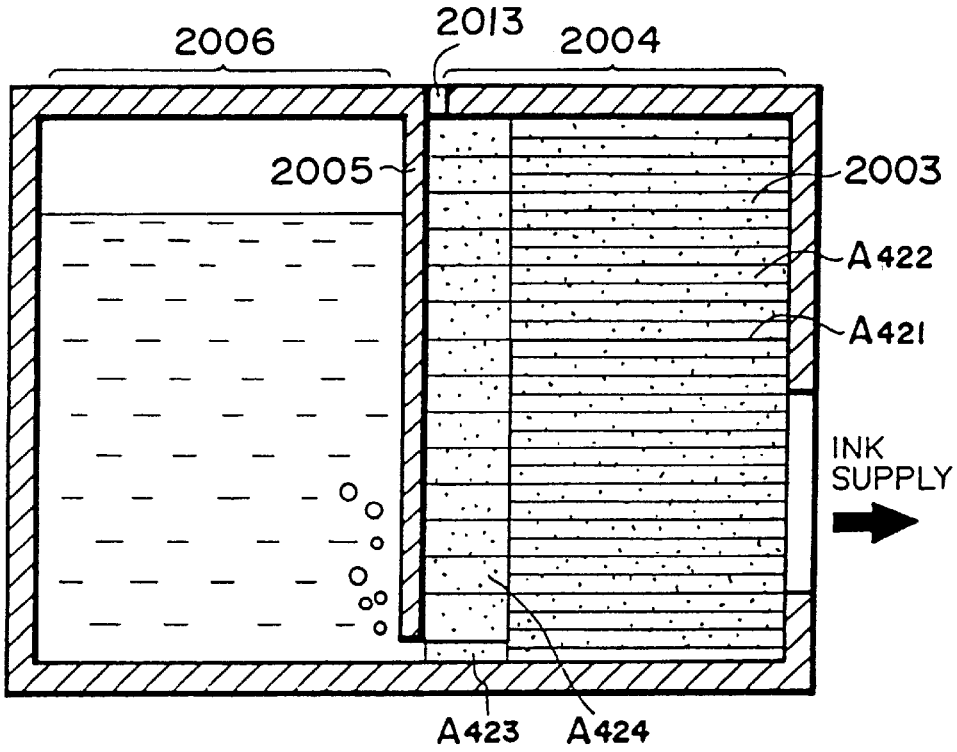
FIG. 42 shows an example of the divided compressed ink absorbing material, according to a further embodiment of the present invention.

FIG. 42 shows a twelfth embodiment, in which the compressed ink absorbing material contained in the ink chamber 2004 is separated into three parts, each of which is given particular functions. In FIG. 42, the compressed ink absorbing material A422 adjacent to the ink supply portion, which occupies a major part of the ink chamber 2004, has been compressed beforehand with a relatively high compression ratio in order to increase the capillary force. The compressed ink absorbing material adjacent to the end portion of the ink chamber A423 is smaller, but it is sufficient to supply sufficient capillary force to produce the internal pressure of the ink required for the supply thereof (it has a relatively low compression ratio). In addition, along the wall of the ink chamber, even smaller compression ratio material A424 is disposed to promote the formation of the air-liquid interface A421 adjacent to the bottom end portion of the ink chamber. In this embodiment, the compressed ink absorbing material 2003 is separated into three parts, and is compressed beforehand, and thereafter is accommodated therein. This results in a slightly complicated manufacturing process of the ink container, but the compression ratio (and therefore capillary force) can be adjusted to be of proper size at selected positions. In addition, the low capillary force absorbing material is disposed at the lateral ink chamber wall, and therefore, the internal pressure of the ink supply portion reaches more quickly to the predetermined level.

Embodiment 13

Figure 43:
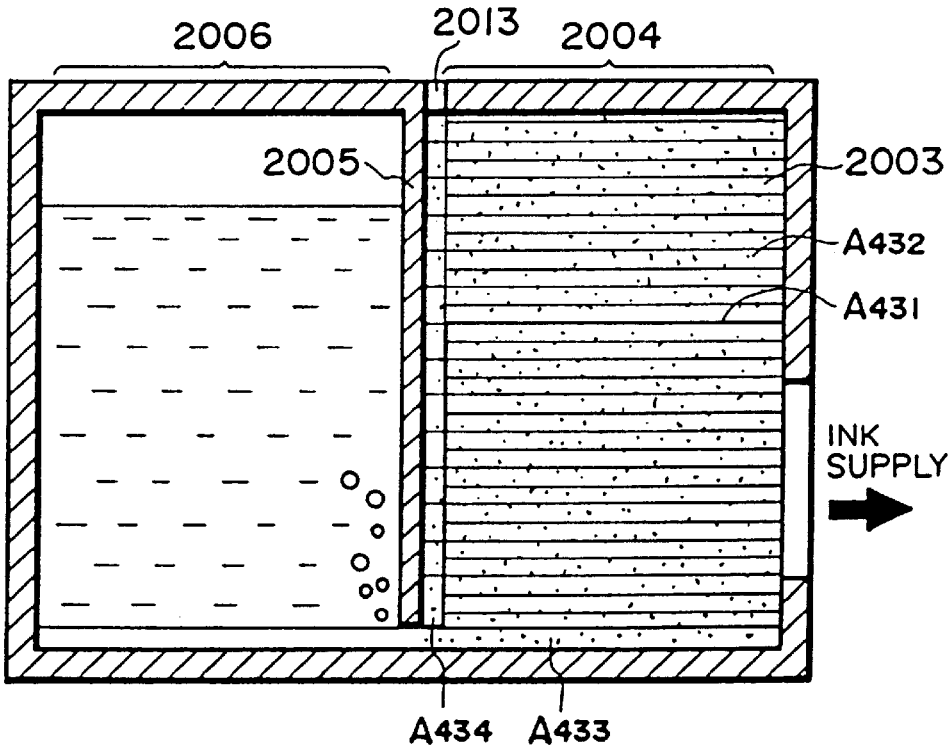
FIG. 43 shows an example of the ink absorbing material arrangement in the ink chamber, according to a further embodiment of the present invention.
Figure 44:
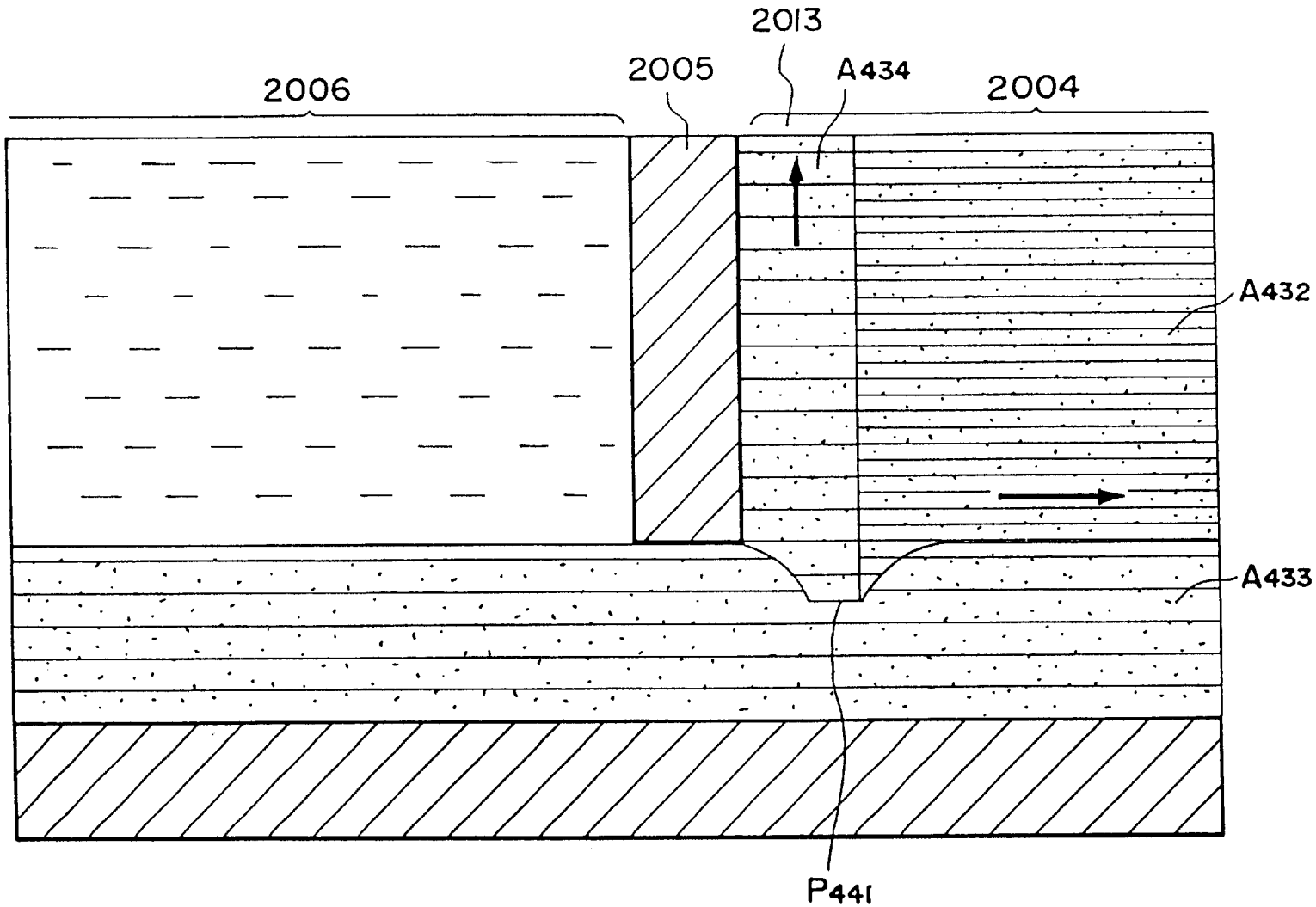
FIG. 44 illustrates problems with the assembling of the apparatus for the FIG. 43 embodiment.

FIG. 43 shows a 13th embodiment, in which similarly to the 12th embodiment, the compressed ink absorbing material 2003 is separated into three parts, and there is a high compression ratio portion A432, a minimum compression ratio portion A434, and a small compression ratio portion (intermediate capillary force) A433 at the bottom portion of the ink chamber 2006. In this embodiment, even if the ink level in the ink chamber 2006 becomes lower than the bottom end of the ink chamber wall 2006, the ink discharge into the ink chamber 2004 can be suppressed, and therefore, the ink internal pressure variation in the ink supplying portion can be reduced. Therefore, the opening for the communication between the ink chambers at the bottom thereof can be increased, so that the limitation in the design of the ink container can be slightly reduced. In this Figure, A431 shows the air-liquid interface. However, in this embodiment, as shown in FIG. 44, if the ink absorbing material is further compressed partly (P441) at the time of assembling the compressed ink absorbing material 2003 at the bottom end portion of the ink chamber wall, the compression ratio adjacent to the ink chamber 2006 becomes locally high resulting in a local increase of the capillary force. Then, there is a possibility that the air is blocked between the portion adjacent the ink chamber 2006 having the normal compression ratio, and therefore, the smaller capillary force, with the result of formation of a meniscus preventing the ink supply from the ink chamber 2006. Therefore, this should be avoided.

As described in the foregoing, according to Embodiments 10, 11, 12 and 13, the hybrid type ink container is improved, and there are provided the supply portion to the recording head and the air vent, and there are further provided a supply ink chamber containing ink absorbing material having adjusted capillary force, and one or more ink chambers in communication therewith. The capillary force of the ink absorbing material in at least the upper part of the ink supply portion for the recording head is made larger than the capillary force of the ink absorbing material at the communicating part with the ink chamber, so that stabilized ejection is maintained, and the leakage of the ink can be prevented. Therefore, the ink container is easy to handle, and the ink retention rate is high.

Embodiment 14

During pressure reduction tests for the ink containers described in the foregoing, a problem has been found that the ink is leaked out in some of the ink containers when the ink has the composition which will be stated in the comparison ink 3 which will be described hereinafter, therefore, the leakage prevention performance is varied for individual ink containers. Various investigations and tests by the inventors have revealed that the ink buffering effect is influenced by affinity between the ink and the ink container.

Figure 45:
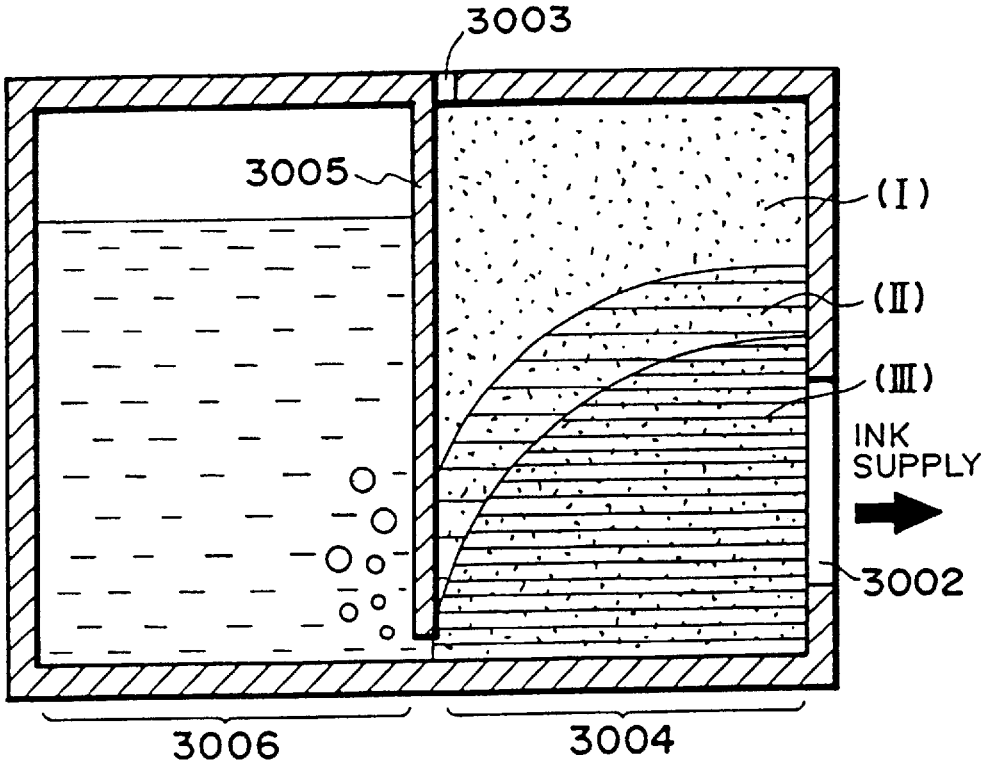
FIG. 45 illustrates ink consumption in a comparison example.
Figure 46:
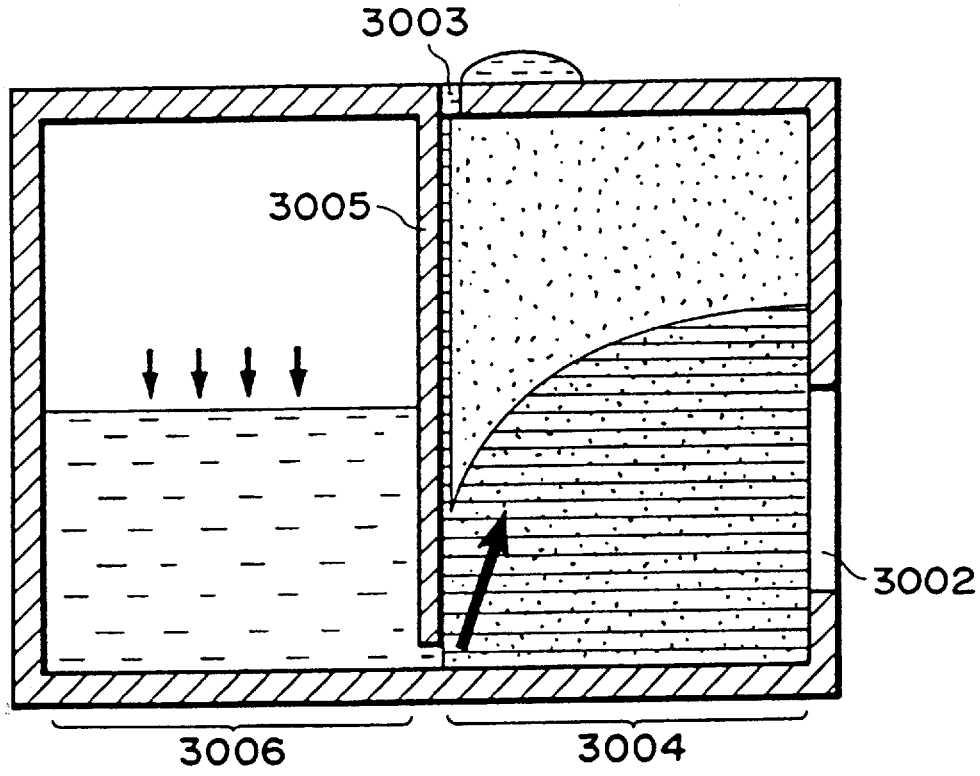
FIG. 46 shows the ink leakage upon pressure reduction in the comparison example of FIG. 45.

FIGS. 14, 45 and 46 show comparison of the ink container resulting in the ink leakage. In FIG. 45, (I) indicates a region in which the ink absorbing material has never been contacted by the ink; (II) is the region which has once absorbed the ink; and (III) is a region containing the ink. Ink chambers 3004 and 3006 are separated by ink chamber wall 3005, and the ink is supplied to the recording head from an ink supply outlet 3002. FIG. 14 shows the initial state of the ink container, while FIG. 45 shows the state in which the ink has been consumed from the suppliable ink in the ink chamber 3004 and also one fifth the ink in the ink chamber 3006, from the initial state. FIG. 46 shows a situation where the ink in the ink chamber 3006 is pushed out into the ink chamber 3004 by expansion of the air in the ink chamber 3006 due to the ambient pressure decrease or temperature increase from the state of FIG. 45. A part of the ink is absorbed into the portion which has once absorbed the ink. However, additional ink is not absorbed by the absorbing material but leaks out from the air vent 3003 along the ink container wall or the clearance between the ink container wall and the absorbing material.

The reason for this is considered as follows. The ink absorbing material never contacted by the ink exhibits poor ink absorbing properties. The ink absorbing material having the experience of ink absorption, has a different surface state to permit better ink absorption. This has been confirmed in the following manner. An unused compressed absorbing material (polyurethane foamed material) and a compressed absorbing material having the experience of ink absorption once, were immersed in the ink, and the height of ink absorptions were measured. It has been found that the unused ink absorbing material hardly absorbs the ink (several mm), whereas the absorbing material having the experience of ink absorption exhibited not less than several cm, and therefore, the remarkable difference in the ink absorbing nature has been confirmed. In the ink cartridge of this embodiment, the ink can be filled in the ink chamber 3006 to the limit of its volume at the initial state. In addition, the ink can be filled into the ink chamber 3004 to the ink retaining limit. Therefore, in consideration of the above-described points, the ink is filled into the ink chamber 3006 to the limit of its volume, and the ink is filled into the ink chamber 3004 to establish the once wet state of the absorbing material before the use thereof. Further thereafter, in order to maintain the predetermined vacuum immediately after the ink cartridge is unpacked, a proper amount of the ink can be removed so that the ink contained in the ink chamber 3004 is less than the ink retaining limit thereof.

After the unpacking of the ink container, the ink is consumed from the ink chamber 3004, and thereafter, the ink in the ink chamber 3006 is used. When the ink is consumed from the ink chamber 3006 requiring the buffering function, the ink absorbing material in the ink chamber 3004 has once been wet, and therefore, the ink can be easily absorbed thereby, and therefore, the buffering function can be sufficiently accomplished. Therefore, the ink is effectively prevented from leaking out through the air vent. An ink container thus produced was mounted on an ink jet recording apparatus, and the pressure reduction tests were carried out. It has been found that the ink did not leak out from any of the ink containers, and in addition, the resultant recording has high print quality.

In order to manufacture the ink container provided with such functions, it would be considered that the absorbing material is treated with the ink or another agent providing good rewetting before the absorbing material is set in the container. However, this may require a drying step or the like. Or, if an agent other than the ink is used, the consideration should be paid to the possibility of damage to the heater by the agent solved into the ink. It would be also considered that an ink having good affinity with the absorbing material should be used. However, such an ink generally exhibits better seeping property in the paper, and therefore, the printed ink smears along the fibers of the paper in random directions, thus decreasing the print quality.

Figure 47:
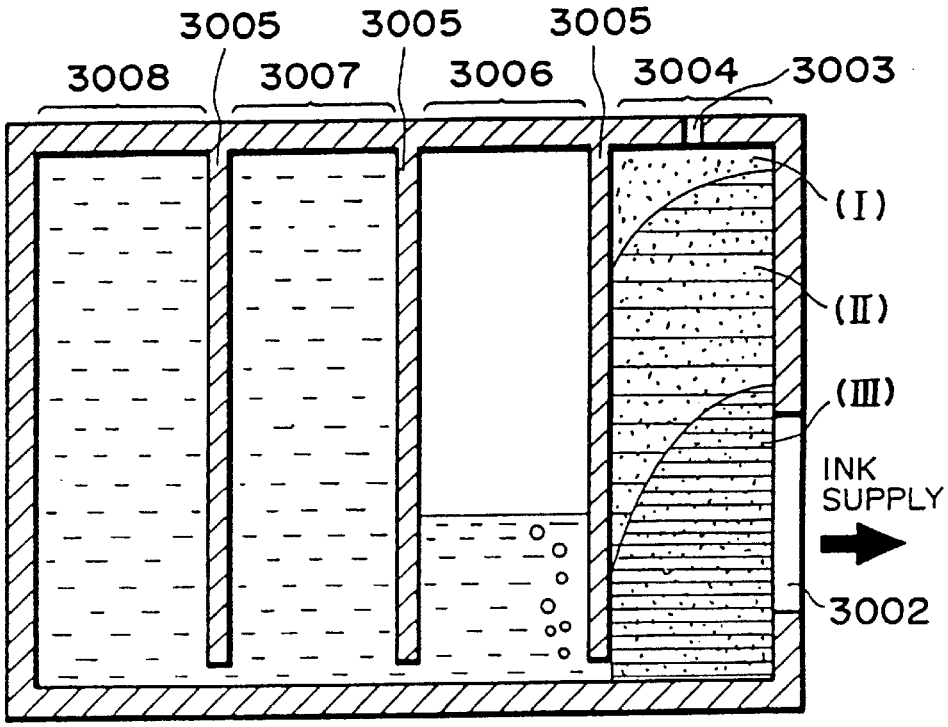
FIG. 47 is a modified example according to a further embodiment of the present invention.
Figure 48:
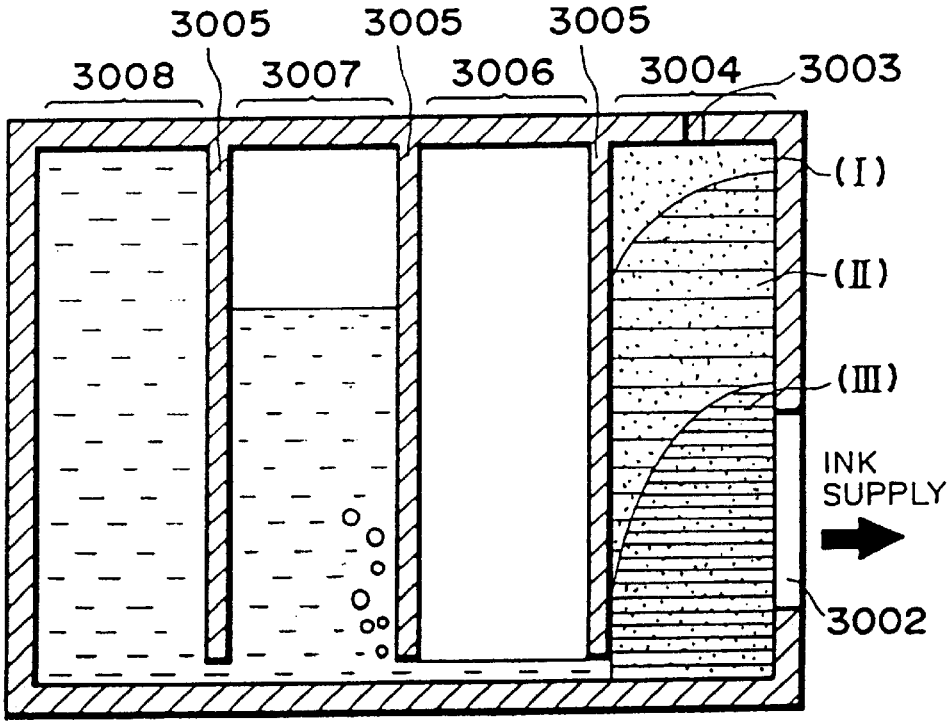
FIG. 48 is a modified example of FIG. 47 embodiment.

FIGS. 47 and 48 show a modified embodiment of this invention. In these Figures, (I), (II) and (III) refer to an arrangement similar to (I), (II) and (III) of FIG. 45. In this example, two ink chambers 3007 and 3008 are provided which are in communication with the ink chamber 3006. In the embodiment, the ink is consumed in the order of the ink chamber 3006, the ink chamber 3007 and the ink chamber 3008. In this modified example, the ink chamber is separated into four chambers, for the purpose of preventing the leakage of the ink at the time of a pressure reduction or a temperature change, as described with the foregoing embodiments. When the air spaces in the ink chambers 3006 and 3007 are expanded in the state of FIG. 48, for example, the expanded volume of the air in the ink chamber 3006 is released through the air vent in the ink chamber 3004. The expanded volume in the ink chamber 3007 is released by the ink flowing out from the ink chamber 3006 and the ink chamber 3004. In this manner, the ink chamber 3004 is given the function of a buffering chamber. The ink retention capacity of the compressed ink absorbing material in the ink chamber 3004 may be determined by considering the amount of ink leading from one ink chamber. In this case, too, the entirety of the compressed absorbing material of the ink chamber 3004 is once subjected to ink absorption, so that the above-described advantageous effects can be provided. Since the buffering chamber (ink chamber 3004) can be reduced in size, the residual ink amount when the ink is removed after being filled in the manufacturing process, can also be reduced.

Embodiment 15

Figure 49:
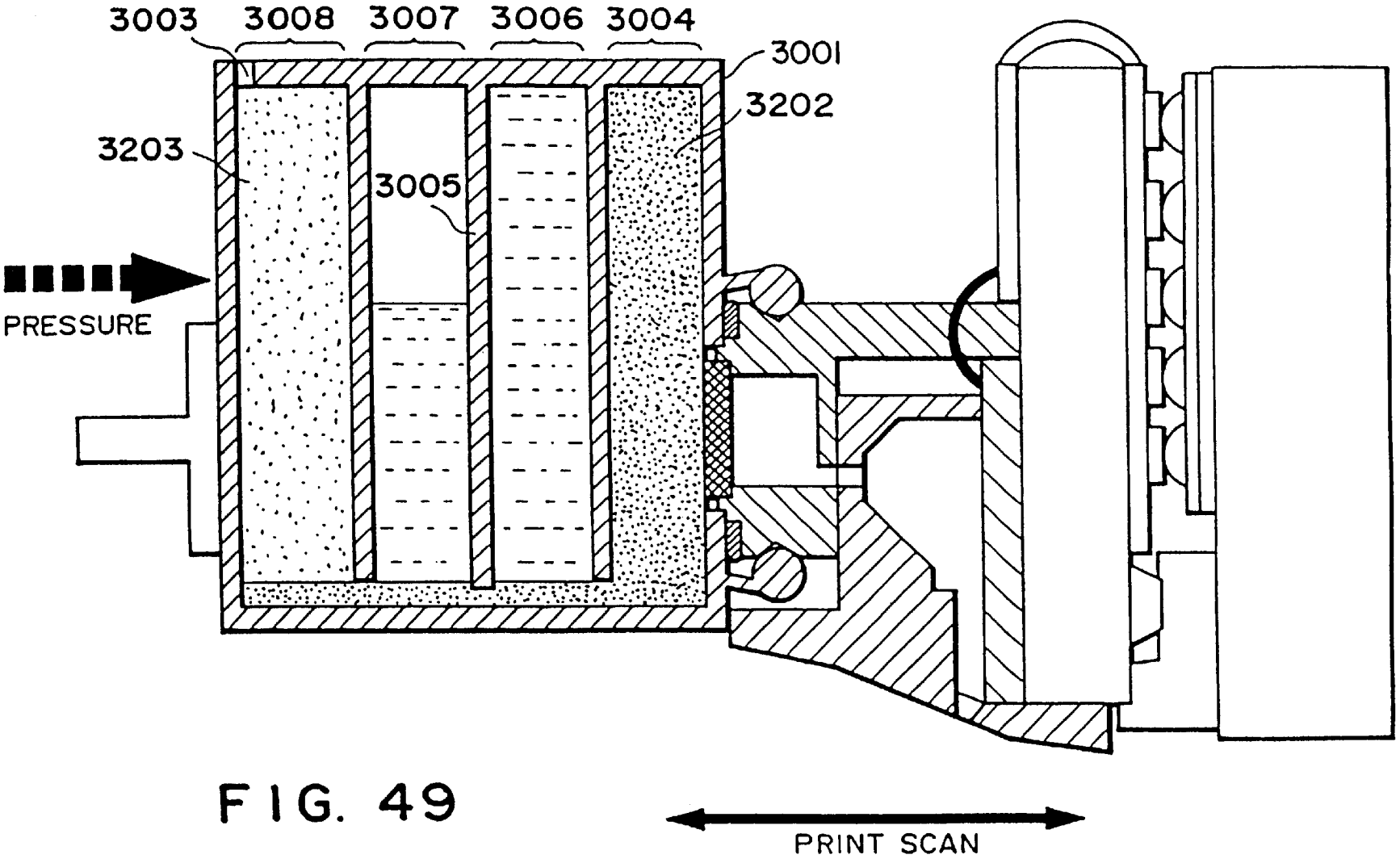
FIG. 49 is a sectional view showing the mounting of the exchangeable ink container and the recording head onto the carriage, according to an embodiment of the present invention.

Referring to FIG. 49, Embodiment 15 will be described. The fundamental structure of the recording head is the same as with FIG. 1. The inside of the exchangeable ink container 3001 is separated into four ink chambers, 3004, 3006, 3007 and 3008, which communicate at the bottom. An ink absorbing material 3202 having an adjusted capillary force is packed into the communication part between the ink chamber 3004 and the ink chambers functioning as the ink supply portion without substantial clearance. The ink chamber 3004 having an air vent 3003 is packed with a buffering absorbing material 3203 to prevent the leakage of the ink. This is thus a hybrid type ink cartridge.

Figure 50:
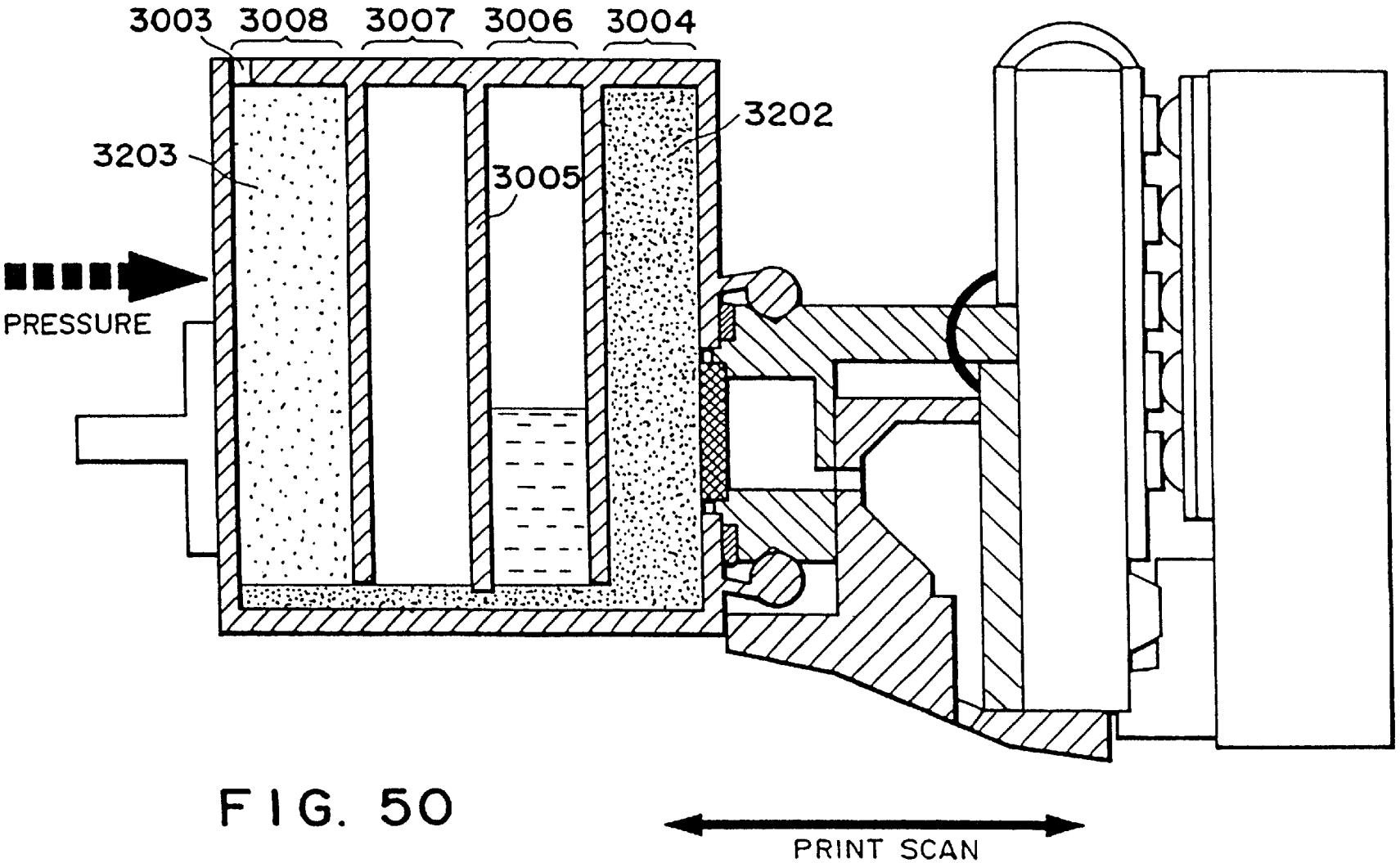
FIG. 50 illustrates ink consumption in the apparatus according to the embodiment of FIG. 49.

In the state of FIG. 49, about one half of the ink in the ink chamber 3007 has been consumed from the initial state having sufficiently filled ink chambers 3004, 3006 and 3007. When the ink is further consumed, the ink is supplied from the ink chamber 3006, as shown in FIG. 50, from the time at which the ink is used up from the ink chamber 3007. The ink is further consumed from the state shown in FIG. 50, and at the time when the ink is used up from the ink chamber 3006, the ink starts to be supplied from the ink absorbing material in the ink chamber 3004. When the ink is substantially used up from the ink chamber 3004, the exchangeable ink container is exchanged.

Figure 51:
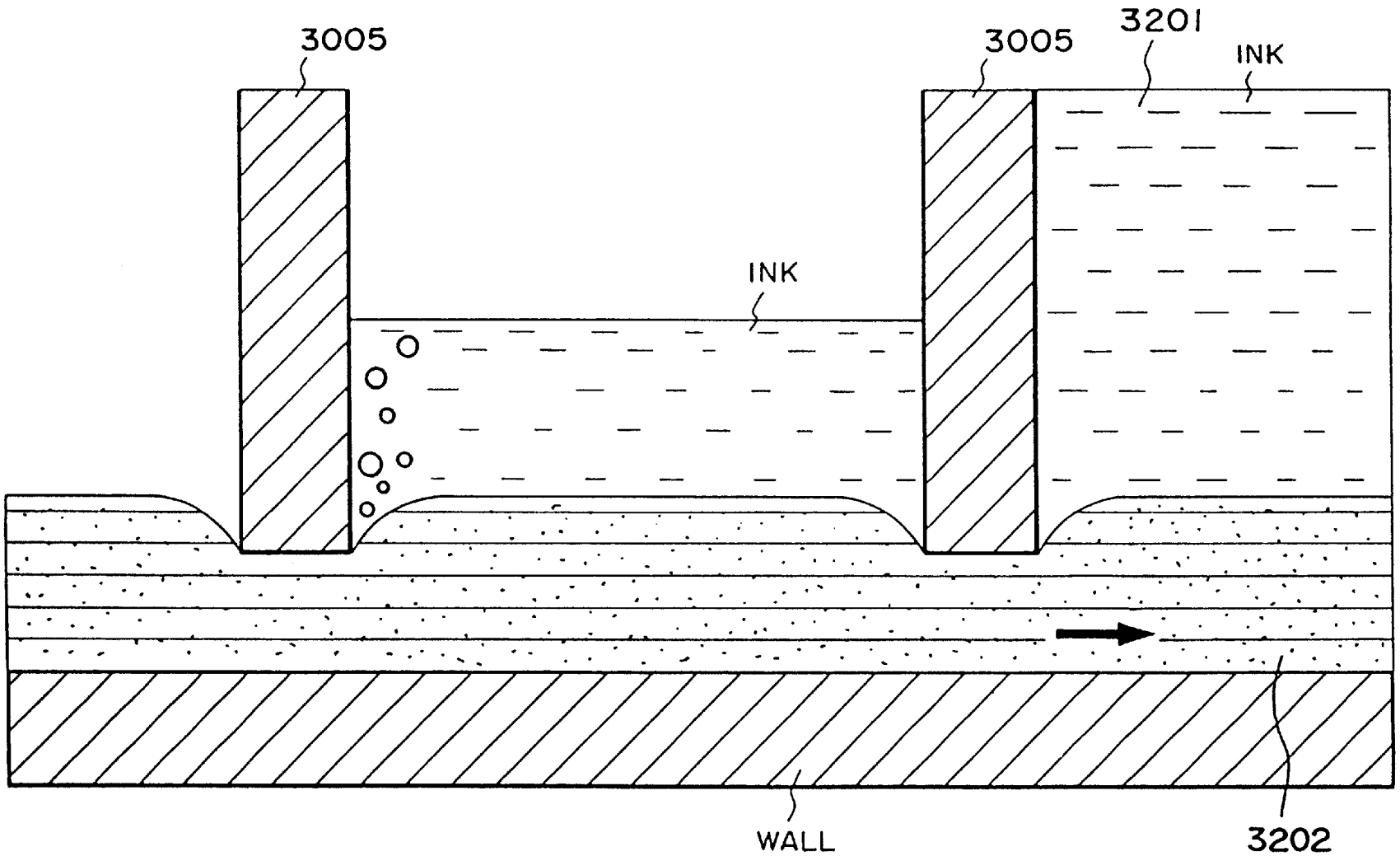
FIG. 51 illustrates fundamentals of the exchange between the air and the ink.

FIG. 51 shows the principle of the internal pressure production of the ink and the ink supply in Embodiment 15. From the left ink changer in FIG. 51, the ink 3201 has been substantially used up, and because of the communication with the ambience through the air vent and the communicating portion between the ink chambers, it is at atmospheric pressure. The ink is supplied to the recording head from the ink supply portion through the communication parts between ink chambers, in response to which the ink 3201 is supplied out from the ink chamber in communication with the ink chamber which is at atmospheric pressure through the ink absorbing material 3202, this material having an enhanced capillary force by compression, between the ink chambers. The pressure of the ink chamber is reduced corresponding to the consumption of the ink. Then, air is introduced into the ink chamber from which the ink is consumed so that the pressure in the ink chamber, whose pressure is reduced by partial breakdown of the meniscus in the compressed ink absorbing material 3202 between the ink chambers, is restored. The internal pressure of the ink supply portion is maintained at a predetermined level by the capillary force of the compressed ink absorbing material in the ink communicating part between ink chambers.

Figure 52:
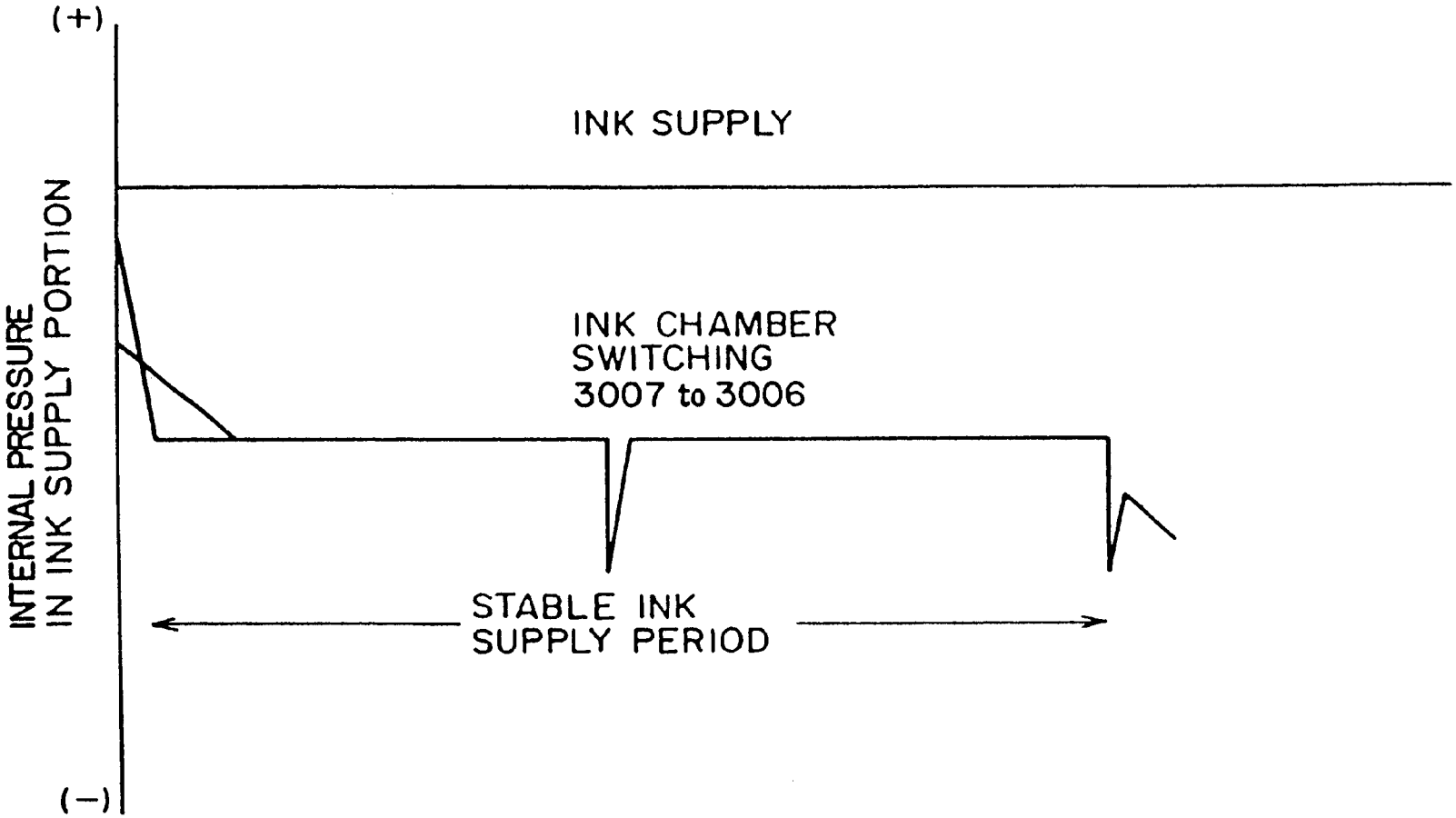
FIG. 52 illustrates the internal pressure of the ink supply portion, according to a further embodiment of the present invention.

FIG. 52 shows the change of the internal pressure at the ink supply portion of the exchangeable ink container of Embodiment 15 in response to the ink supply (consumption). The internal pressure is produced not only by the capillary force of the buffering absorbing material or ink absorbing material, but also by the capillary force of the compressed ink absorbing material (compressed portion) in the communicating part between the ink chamber 3008 and the ink chamber 3007 in accordance with the supply of the ink, so that during the ink supply from the ink chamber 3007, a substantially constant ink pressure is maintained as described in the foregoing. When the ink is further consumed, the ink supply from the ink chamber 3006 is started. Upon the switching of the ink chamber, the internal pressure at the ink supply portion slightly varies. It is considered that this phenomenon is related to the measurement of the internal pressure with the continuous ink supply and the temporary occurrence of the pressure reduction state both in the ink chambers 3007 and 3006. However, it has been confirmed that the variation is not a significant problem with respect to the function such as the recording performance of the recording head.

When the ink becomes stably consumed from the ink chamber 3006, the internal pressure is stabilized again. When the ink is consumed from the ink chamber 3006, the ink is supplied (consumed) from the ink chamber 3004. It has been found that the recording operation is not adversely affected during the ink supply stabilization period shown in FIG. 52.

Figure 53:
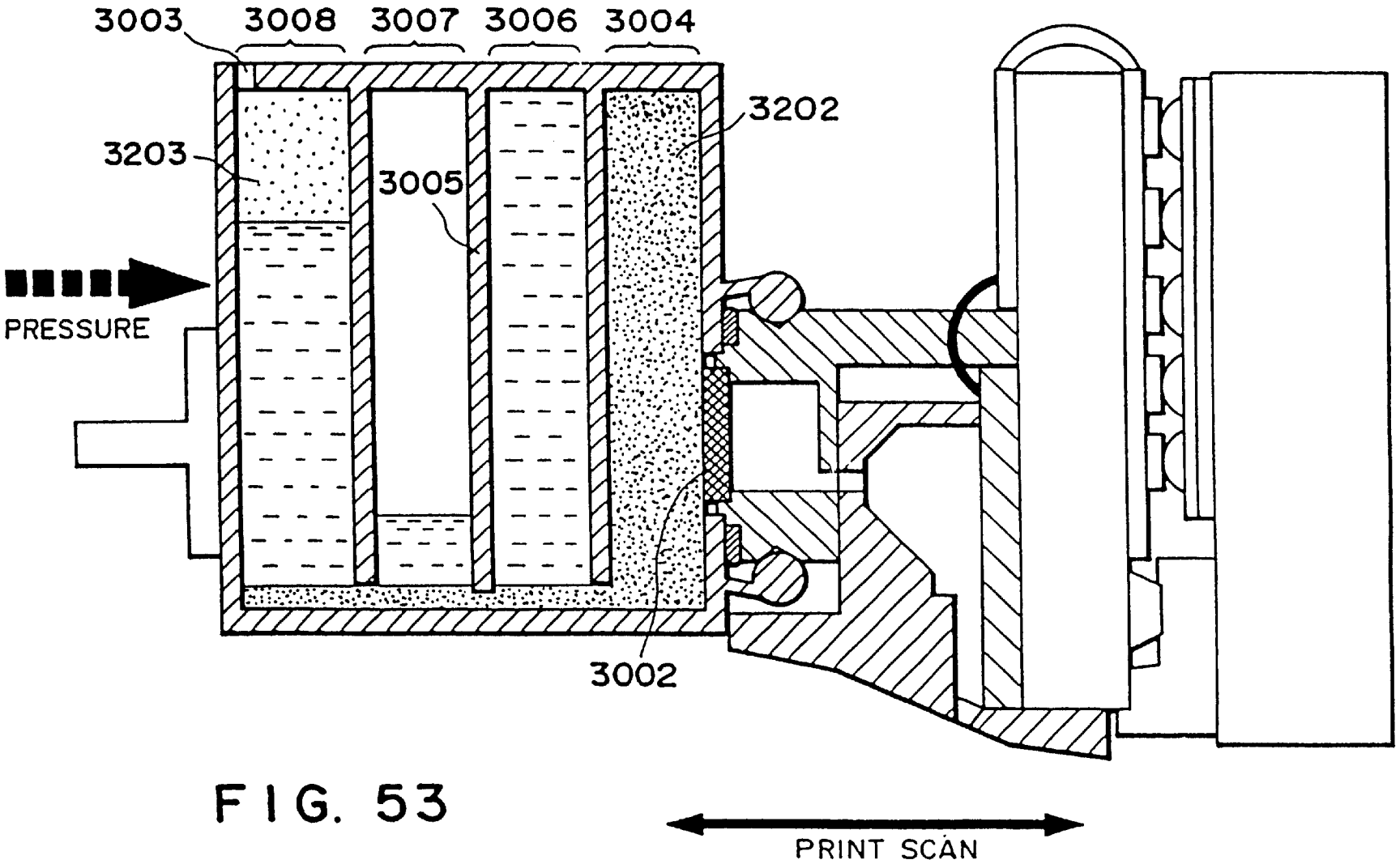
FIG. 53 illustrates the ink buffering function in the apparatus of FIG. 52 embodiment.

FIG. 53 illustrates the function of the buffering absorption material 3203, when the ink has overflowed from the ink chamber 3007 due to air expansion in the ink chamber 3007 attributable to a reduction of the atmospheric pressure or temperature rise. In this embodiment, the overflowed ink in the ink chamber 3008 is retained by the buffering absorbing material. In the case of 0.7 atm, the retaining capacity of the buffering absorbing material 3203 is determined in accordance with 30% ink leakage from the ink chamber 3007 at the maximum. When the atmospheric pressure is restored to the level before pressure reduction (1 atm), the ink leaked into the ink chamber 3008 and retained in the buffering absorbing material 3203 returns to the ink chamber 3007. This phenomenon occurs in a similar manner in the case of temperature change of the ink container, but the amount of leakage is smaller than in the case of pressure reduction even if the temperature increases by 50° C. approximately.

In this case, the ink buffering material is designed in consideration of the maximum leakage. However, during the pressure reduction test, a problem has been found that the ink leaks out in some of the ink containers, and therefore, the leakage prevention property is dependent on the individual containers. It has been found that this is because of the affinity between the ink and the buffering absorbing material 3203 in the ink chamber 3008.

In Embodiment 15, therefore, the buffering absorbing material 3203 is subjected to the experience of ink absorption therein before use thereof. It has been confirmed that when the ink is pushed out into the ink chamber 3008 due to the expansion of the air in the ink chamber 3007 due to a temperature rise or a pressure reduction, the ink is absorbed in the buffering absorbing material 3203 in the ink chamber 3008, and therefore, the ink does not leak out.

As described hereinbefore, the ink chamber 3008 is an ink buffering chamber, and therefore, at an initial stage of use, it is preferable that it not be filled with ink. Therefore, in this embodiment, the ink chambers 3004, 3006 and 3007 are filled with the ink up to the limit, and the ink chamber 3008 is filled with the ink substantially to the limit, and thereafter, the ink is removed from the ink chamber 3008, thus assuring the buffering effect.

An ink container produced in this manner was loaded in an ink jet recording apparatus, and pressure reduction tests were carried out. As a result, it has been confirmed that there occurs no leakage, and the resultant recording is of high quality and reliability.

As described in the foregoing with respect to Embodiments 14 and 15, there is provided an ink container cartridge having an ink supply chamber containing ink absorbing material having adjusted capillary force and one or more ink chambers for containing ink and in communication with the supply ink chamber, in which the absorbing material has been wetted with the ink, so that ink does not leak out even if the ambient condition of the ink jet recording apparatus changes, whether a recording operation is carried out or not carried out. The ink usage efficiency is high and the print quality is also high.

Embodiment 16

In the ink cartridge of the foregoing embodiments, when the supply ink chamber containing the ink absorbing material becomes empty, it is difficult to refill the container in some cases.

Figure 61:
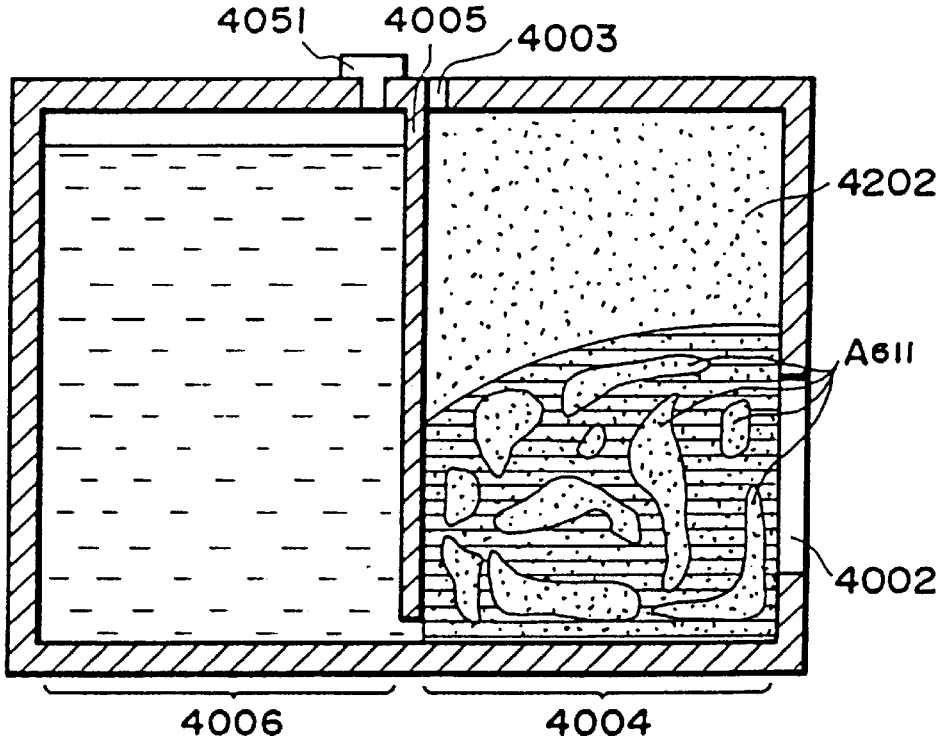
FIG. 61 illustrates the state in which the ink is reinjected after the ink in the ink chamber is used up.

FIG. 61 shows the situation in which the ink is to be supplied (refilled) into the ink container when the ink in the supply ink chamber has been used up. As in previously discussed embodiments, the ink chambers 4004 and 4006 are separated by an ink chamber partition 4005, and the ink container has an ink supply outlet 4002 and an air vent 4003. Even if the ink is used up in the supply ink chamber (ink chamber 4004) after the ink in the ink chamber 4006 has been used up, a slight amount of ink remains in the absorbing material. The ink forms meniscuses in various portions of the absorbing material. When the ink is supplied into the ink chamber 4006 not containing the absorbing material 4202, the meniscuses in the absorbing material in the ink chamber 4004 prevent dense filling of the ink therein. Rather, big bubbles remain, as indicated by A611. When such an ink container is joined with the recording head, the ink flow is not sufficient because of the existence of the air bubbles in the absorbing material 4202 in the ink chamber 4004, and therefore, the ink flow easily stops.

In this case, the operator does not notice the emptiness of the ink chamber 4006 because the ink is contained in the absorbing material 4202 in the ink chamber 4004, and therefore, the recording operation is possible even after the ink is used up in the ink chamber 4006. The operator will first become aware that the ink has been used up from the ink chamber 4004 and the ink chamber 4006 only after the recording operation becomes not possible as a result of the complete consumption of the ink in the absorbing material 4202 in the ink chamber 4004. Even if the ink is refilled in the ink chamber 4006 at this point, the ink in the ink chamber 4006 does not come into contact with the ink contained in the absorbing material in the ink chamber 4004, and therefore, it is not possible to supply the ink in a way that no bubble remains in the absorbing material 4202 in the ink chamber 4004.

In order to solve this problem, the ink container comprises an ink supply chamber provided with an ink supply portion for the recording head, an air vent and ink absorbing material contained therein, at least one ink chamber in communication with the ink supply chamber and containing ink, and ink detecting means for detecting a reduction of the remaining amount of the ink while a predetermined amount of the ink remains in the ink chamber.

The description will be made as to the means for detecting the remaining amount of the ink.

Figure 54:
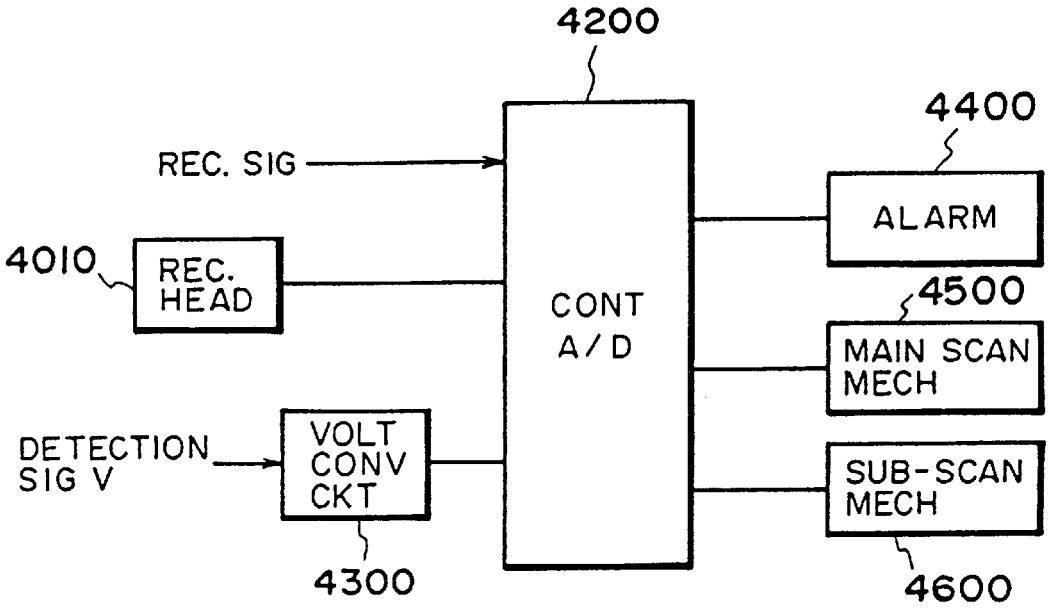
FIG. 54 is a block diagram showing an example of the control system for the apparatus.
Figure 66:
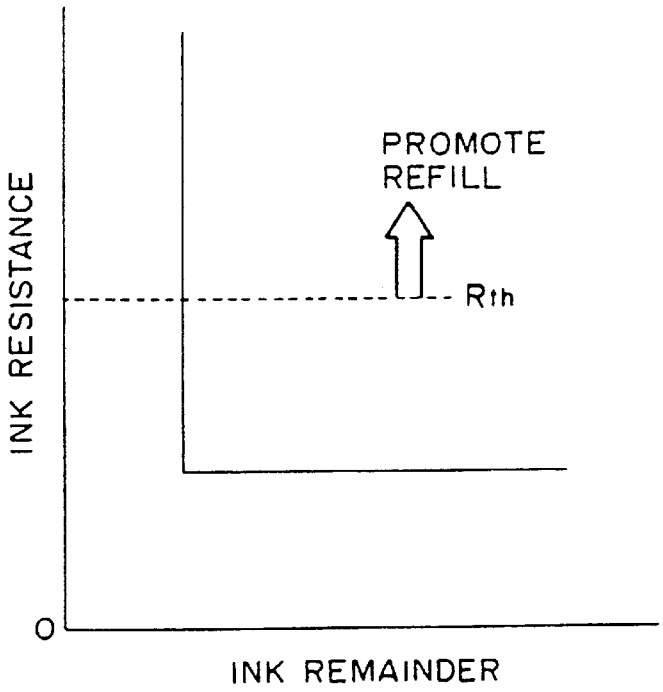
FIG. 66 shows a relationship between the remaining amount of the ink and the electric resistance between electrodes.

FIG. 54 shows an example of a control system according to this invention. It comprises a controller in the form of a microcomputer having a built-in A/D converter 4200, a voltage converter 4300, and an alarming device 4400. Designated by a reference numeral 4010 is a recording head. The alarming device may be in the form of an LED display or the like or tone producing means such as buzzer or the like, or in the form of a combination thereof. A main scan mechanism 4500 for scanningly moving the carriage HC includes a motor or the like. A sub-scan mechanism 4600 includes a motor or the like for feeding the recording medium. Designated by a reference V is a remaining amount detection signal from the ink container. In this embodiment, a constant current flows between two electrodes in the ink chamber 4006, and the remaining amount of the ink in the ink chamber 4006 is determined on the basis of the resistance between the two electrodes. In this case, there is a relationship as shown in FIG. 66 between the remaining amount of the ink and the resistance between electrodes.

Figure 55:
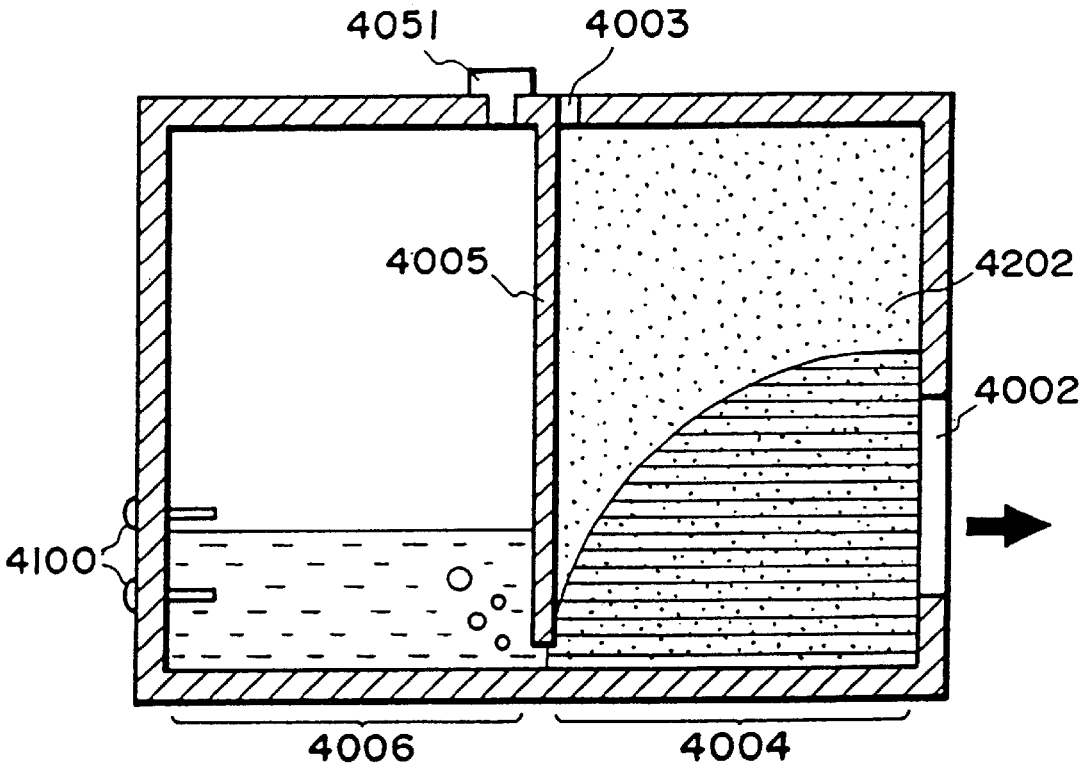
FIG. 55 shows the state when the remaining amount of the ink is detected, according to a further embodiment of the present invention.

As shown in FIG. 55, when the ink level in the ink chamber 4006 falls below the upper electrode of the two electrodes 4100, the resistance between the two electrodes abruptly increases, and a corresponding voltage is produced between the electrodes. The voltage is supplied directly or through a voltage converter circuit 4300 to the A/D converter in the controller, and is A/D-converted thereby. When the measured value exceeds a predetermined level Rth, the necessity of the ink injection is signaled to the operator by actuating the warning device 4400. At this time, the operation of the main apparatus may be stopped, or the apparatus may be stopped after the current operation is completed.

Thus, the ink consumption is stopped while a small amount of the ink remains in the ink chamber 4006, and therefore, the ink can be refilled continuously in the absorbing material in the ink chamber 4004, and therefore, the ink container can be reused.

Figure 56:
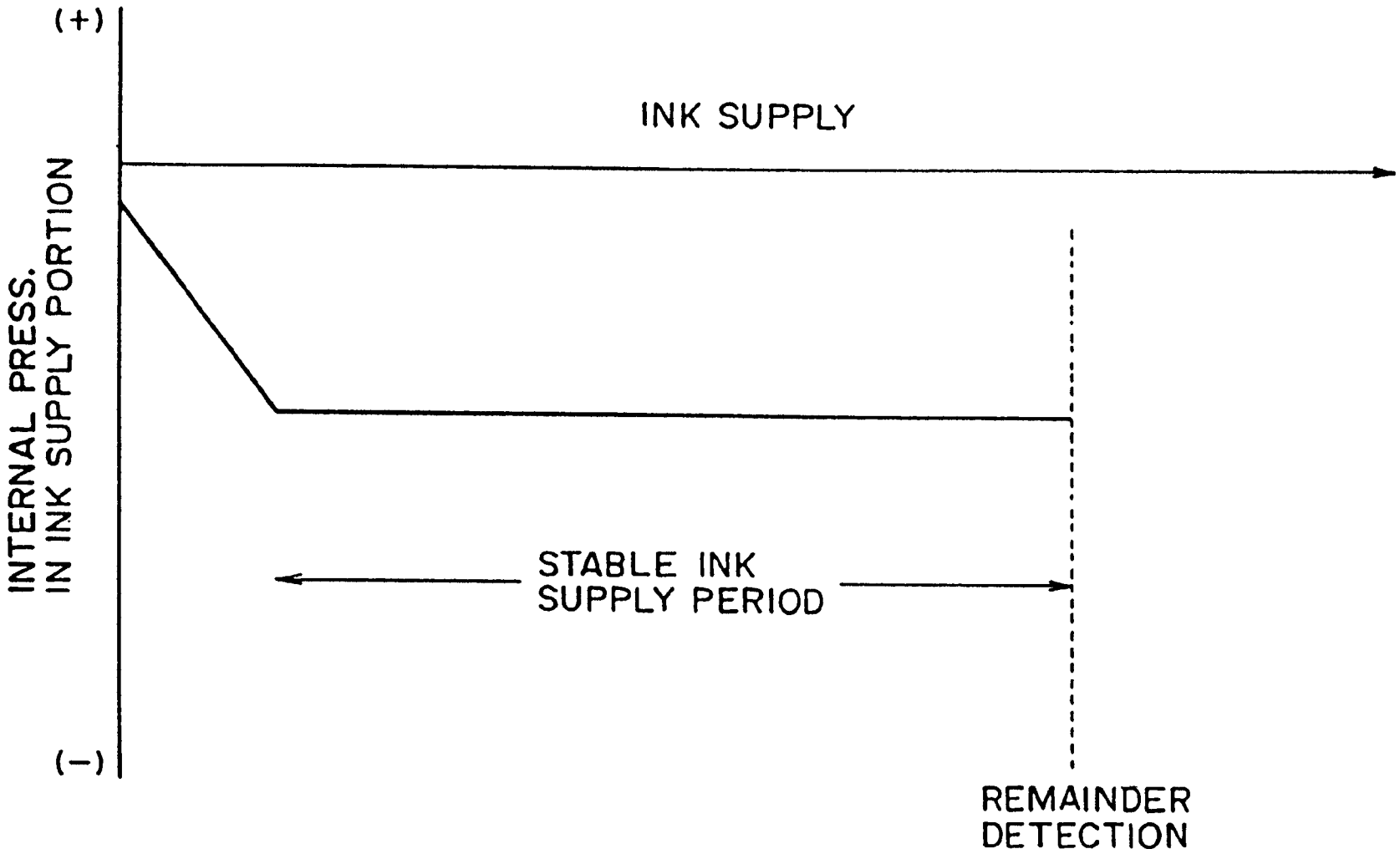
FIG. 56 illustrates the internal pressure of the ink supply portion in the container according to FIG. 55 embodiment.

FIG. 56 shows the change of the internal pressure at the ink supply portion of the exchangeable ink container according to this embodiment in accordance with the ink supply (consumption). At the initial stage, the internal pressure (negative pressure) is produced by the capillary force of the compressed ink absorbing material 4202 in the ink chamber 4004. However, with the reduction of the ink in the ink chamber 4004 by the consumption of the ink, the internal pressure due to the capillary force gradually increases in accordance with the compression ratio distribution (pore size distribution) in the compressed ink absorbing material 4202. When the ink is further consumed, the ink distribution in the ink chamber 4004 is stabilized, and the ink in the ink chamber 4006 starts to be consumed, and air is introduced into the ink chamber 4006 in the manner described in the foregoing. Thus, substantially constant internal pressure is maintained. When the ink is further consumed to such an extent that a predetermined amount of the ink is consumed from the ink chamber 4006, the remaining amount detector operates, and the action of promoting ink refilling and stoppage of the printing operation, is carried out. Accordingly, ink refilling is possible before the ink is consumed from the ink chamber 4004 beyond a predetermined degree, and therefore, the ink can be refilled while the device is in a refillable state.

Figure 57:
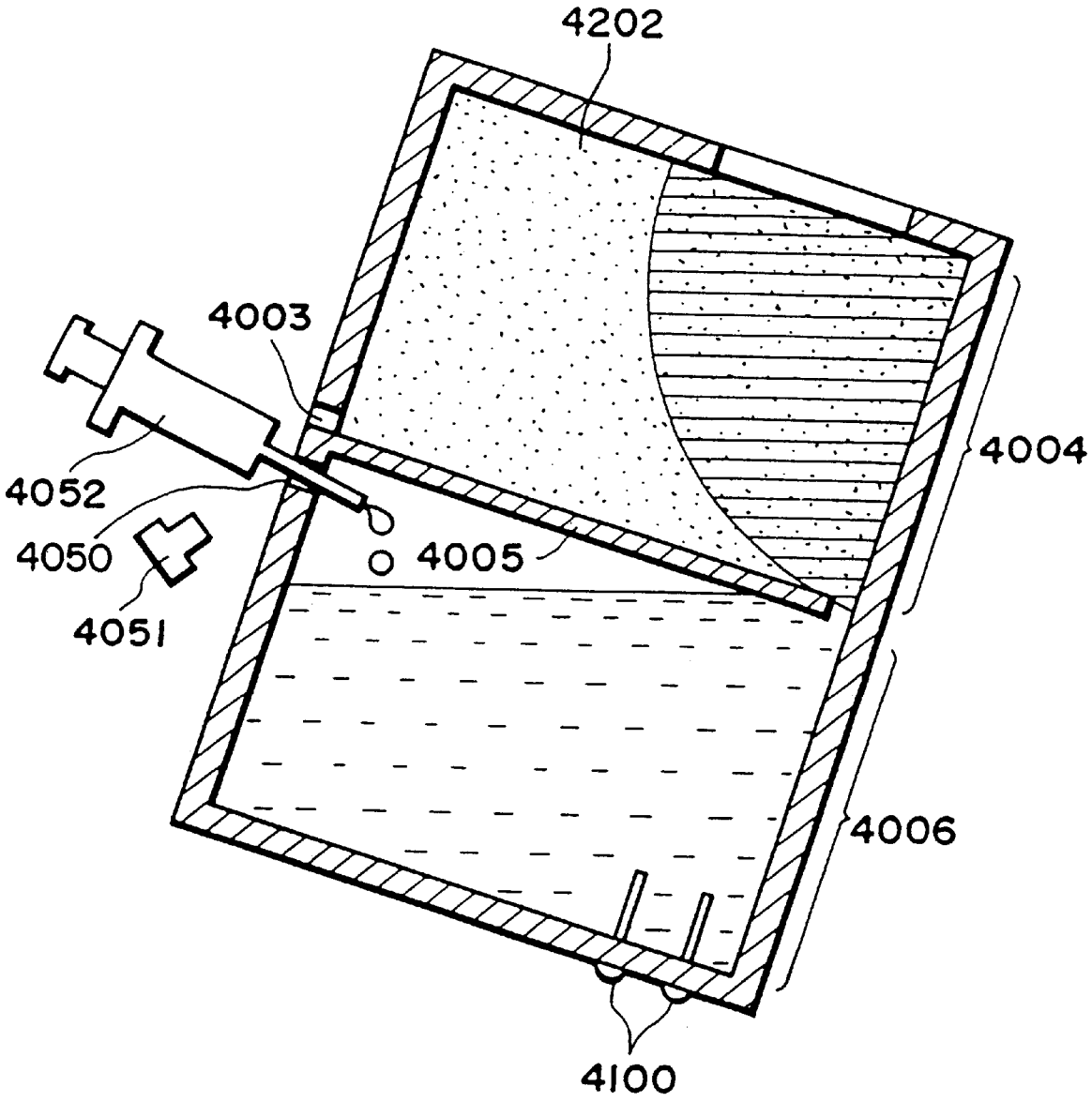
FIG. 57 shows an example of an ink refilling method.

As for the refilling method, as shown in FIG. 57, for example, an ink filling port 4050 of the ink chamber 4006 is unplugged, and the ink is injected into the ink chamber 4006 with a pipette 4052 or the like. After the injection, the filling port 4050 is plugged by a plug 4051. The refilling method is not limited to this, but other methods are usable. The position of the ink filling port 4050 is not limited to that described above. Thus, the ink cartridge can be reused.

In the foregoing, the remaining amount of the ink is detected on the basis of the resistance between electrodes in the container. However, the method of detection is not limited to this type. Mechanical or optical detection methods are also usable.

In this embodiment, the ink container is an exchangeable type, but it may be an ink jet recording head cartridge having a recording head and an ink container as a unit.

Embodiment 17

Figure 58:
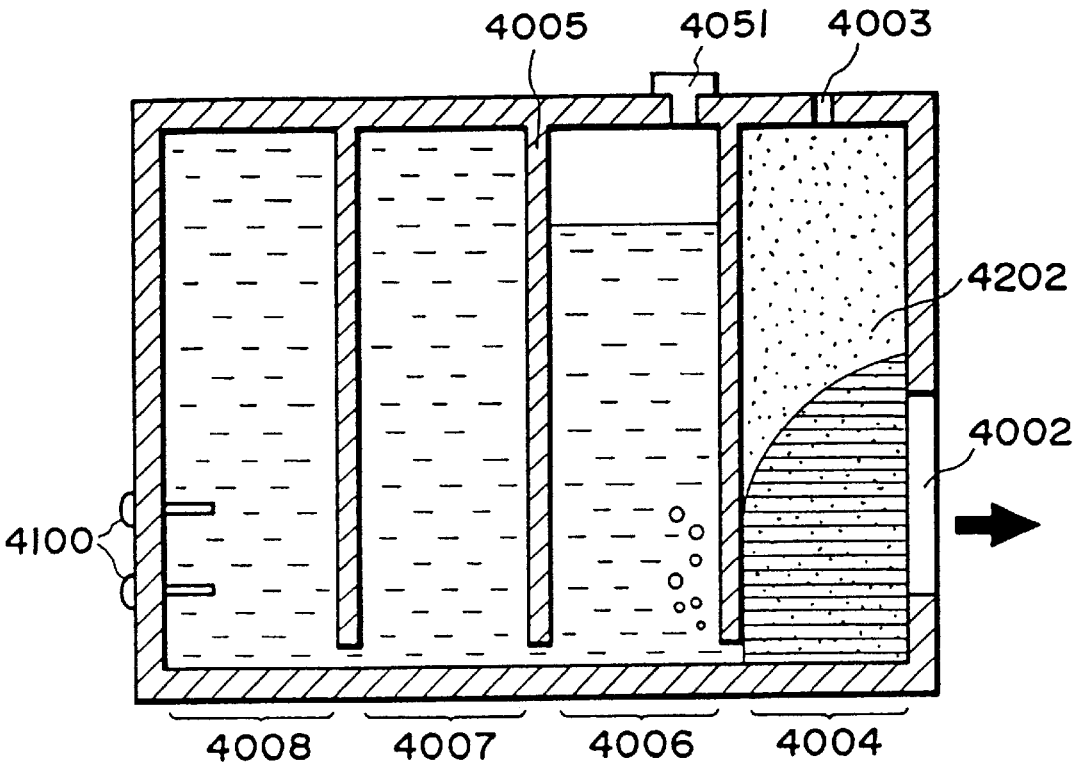
FIG. 58 illustrates ink consumption, according to a further embodiment of the present invention.
Figure 59:
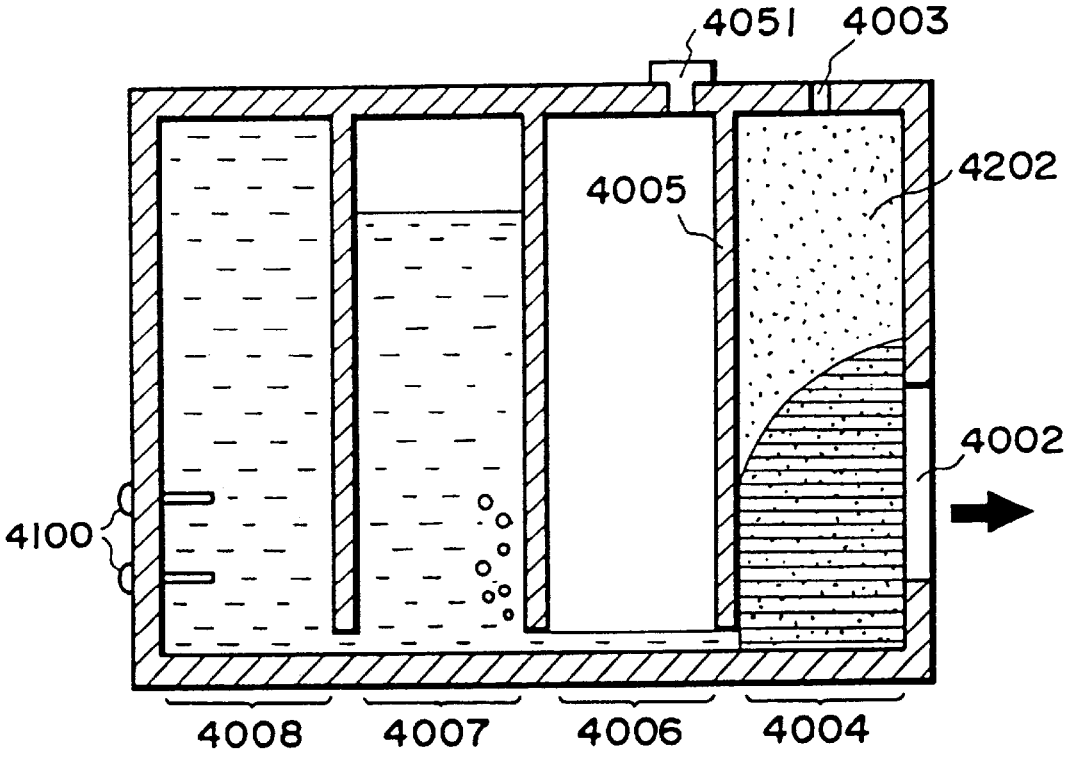
FIG. 59 illustrates a further ink consumption according to the embodiment of FIG. 58.
Figure 60:
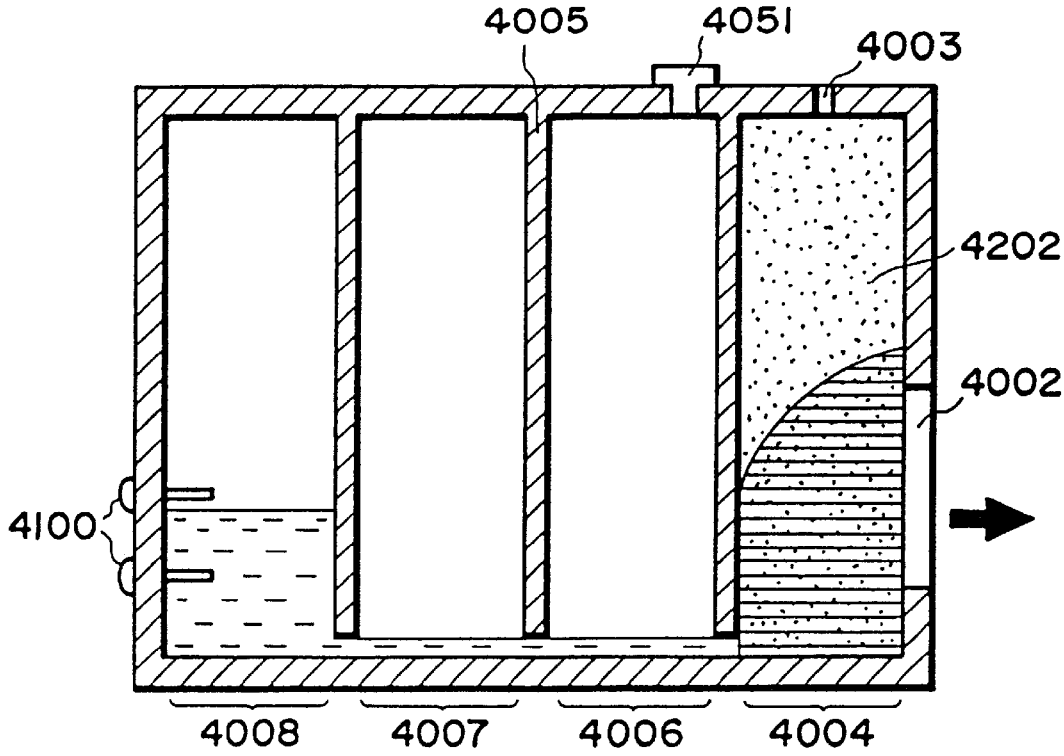
FIG. 60 shows the state in which the remaining amount of the ink is detected, in the device of the embodiment of FIG. 58.

Referring to FIGS. 58, 59 and 60, Embodiment 17 will be described. In fluid communication with the ink chamber 4006, two ink chambers 4007 and 4008 are provided. In this embodiment, the ink is consumed in the order of ink chamber 4006, ink chamber 4007 and the ink chamber 4008. In this embodiment, the ink chamber is divided into four parts, for the purpose of preventing ink leakage when the ambient pressure decreases or the ambient temperature increases, as described with respect to Embodiment 16. For example, when the air spaces in the ink chamber 4006 and the ink chamber 4007 expand in the state of FIG. 58, the expanded amount of air in the ink chamber 4006 is released through the air vent and through the ink chamber 4004. As shown in FIG. 59, the expanded amount of air in the ink chamber 4007 is released by the flow of ink into the ink chamber 4006 and the ink chamber 4004. Thus, the ink chamber 4004 is provided with buffering chamber function. Therefore, the ink retaining capacity of the compressed ink absorbing material 4202 in the ink chamber 4004 is determined in consideration of the leakage of the ink from one ink chamber.

In this case, the ink is consumed sequentially from the ink chamber 4006 and the ink chamber 4007. When the ink is consumed from the last ink chamber 4008, then the ink is consumed from the ink chamber 4004 containing the absorbing material up until the ink supply stops. In order to detect the remaining amount of the ink in the ink chamber 4008, there are provided electrodes 4100 in the ink chamber 4008, as shown in FIG. 60. An ink injection port is formed in the ink chamber 4006. In this embodiment, the remaining amount of the ink is detected only in the ink chamber 4008, and therefore, the ink chamber 4006 and the ink chamber 4007 are capable of containing the ink to the full volume thereof except for the communicating part. If the electrodes are located at the same level as in Embodiment 16, the amount of the ink remaining in the ink chamber not containing the absorbing material at the time when the electrodes detect the limit, can be reduced, to permit efficient use of space.

In this embodiment, similarly to Embodiment 16, refilling is possible before the ink becomes insufficient in the ink chamber 4004 containing the absorbing material.

Embodiment 18

Figure 62A:
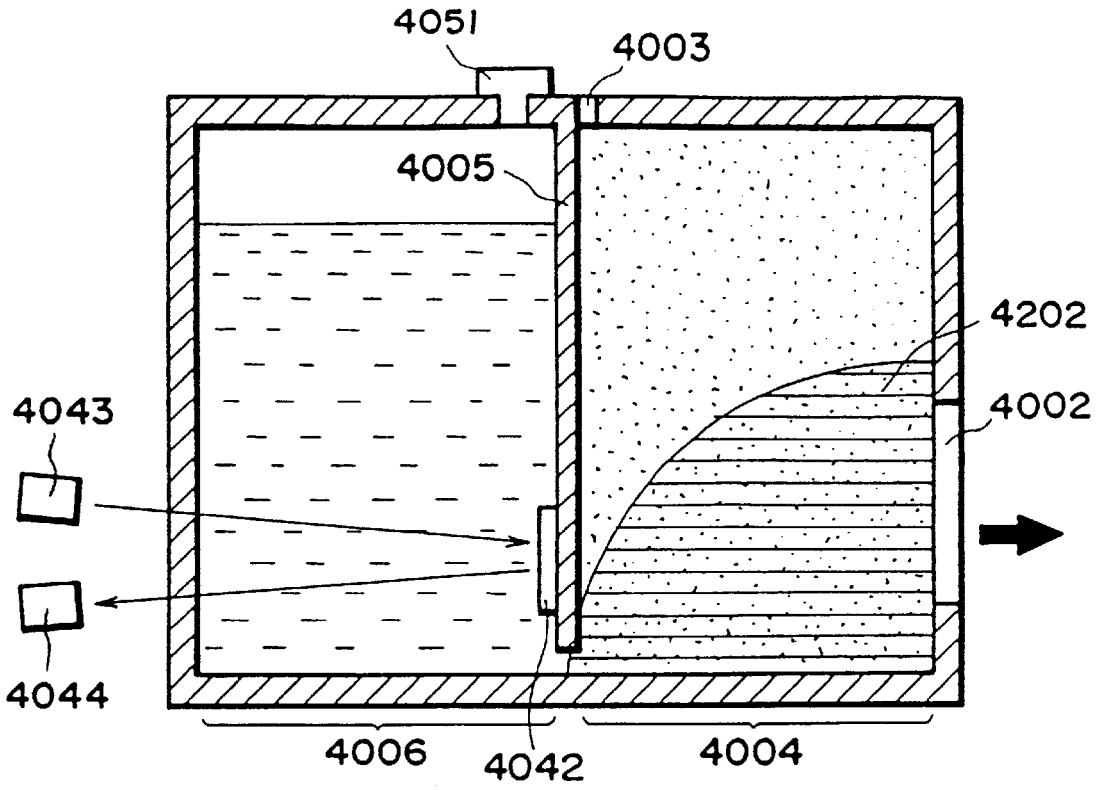
FIGS. 62A and 62B illustrate remaining ink amount detection, according to a further embodiment of the present invention, showing a normal ink-level condition and an ink-empty condition, respectively.
Figure 62B:
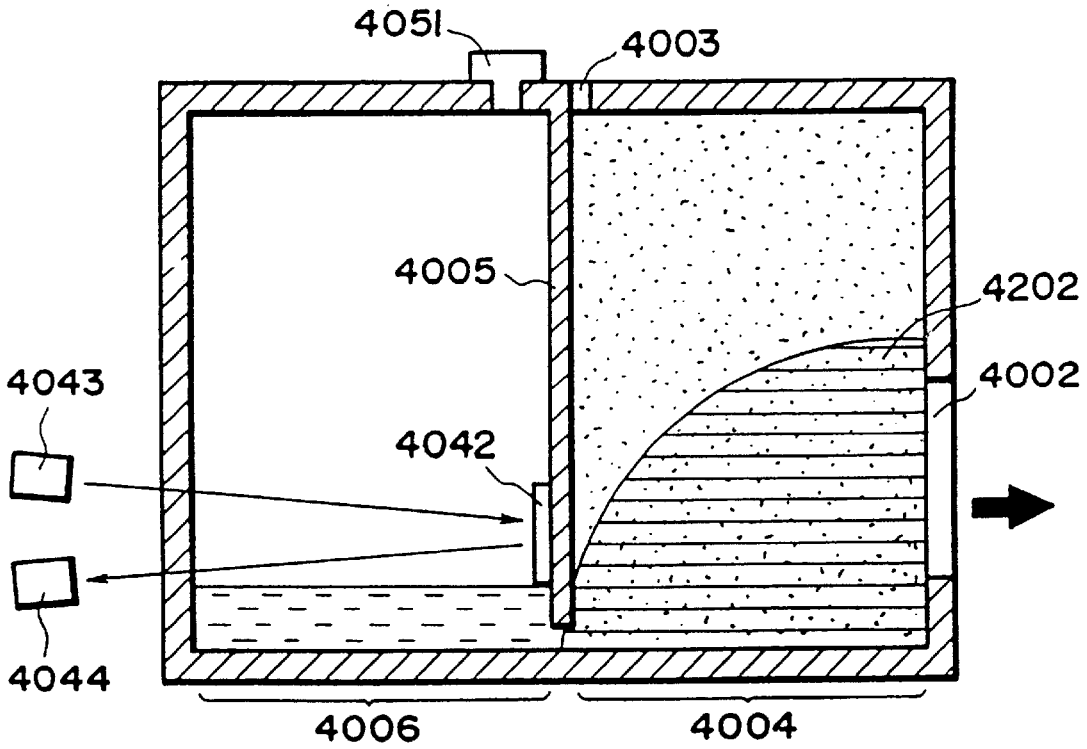

FIGS. 62A and 62B show Embodiment 18, in which the wall of the ink container is of transparent or semi-transparent material, so that the remaining amount of ink can be detected optically. In this case, a light reflecting plate 4042 such as mirror for reflecting the light is provided on the ink chamber wall in the ink chamber 4006 to reflect light, and a photosensor comprising a light emitting element 4043 and a light receiving element 4044 are disposed outside the container. The light emitting element 4043 and the light receiving element 4044 may be provided on the carriage, or at the home position having the recovery system.

In FIGS. 62A and 62B, the light is emitted from the light emitting element 4043 at a predetermined angle, and the light is received by the light receiving element 4044 after it is reflected by the reflection plate. For example, the light emitting element 4043 may be an LED element, and the light receiving element 4044 a phototransistor or the like. In FIG. 62A, the container is substantially full of ink. In such a situation, the light emitted from the light emitting element 4043 is blocked by the ink in the ink chamber 4006, and therefore, the light receiving element 4044 does not receive the light, and therefore the output of the detector is small. However, when the ink is consumed to the state shown in FIG. 62B, the light from the light emitting element 4043 is not blocked, and therefore, the output of the light receiving element becomes high. When the light energy (output of the detector) of the light receiving element 4044 exceeds a predetermined threshold, a warning signal for promoting the injection of the ink is produced.

Figure 63A:
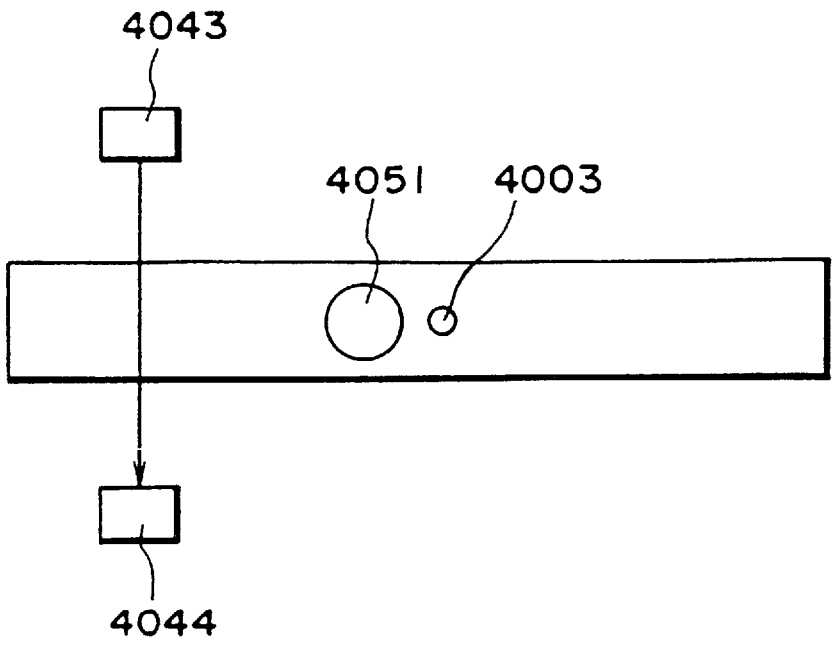
FIGS. 63A and 63B illustrate a modified ink remaining amount detection, in the embodiment of FIGS. 62A and 62B.
Figure 63B:
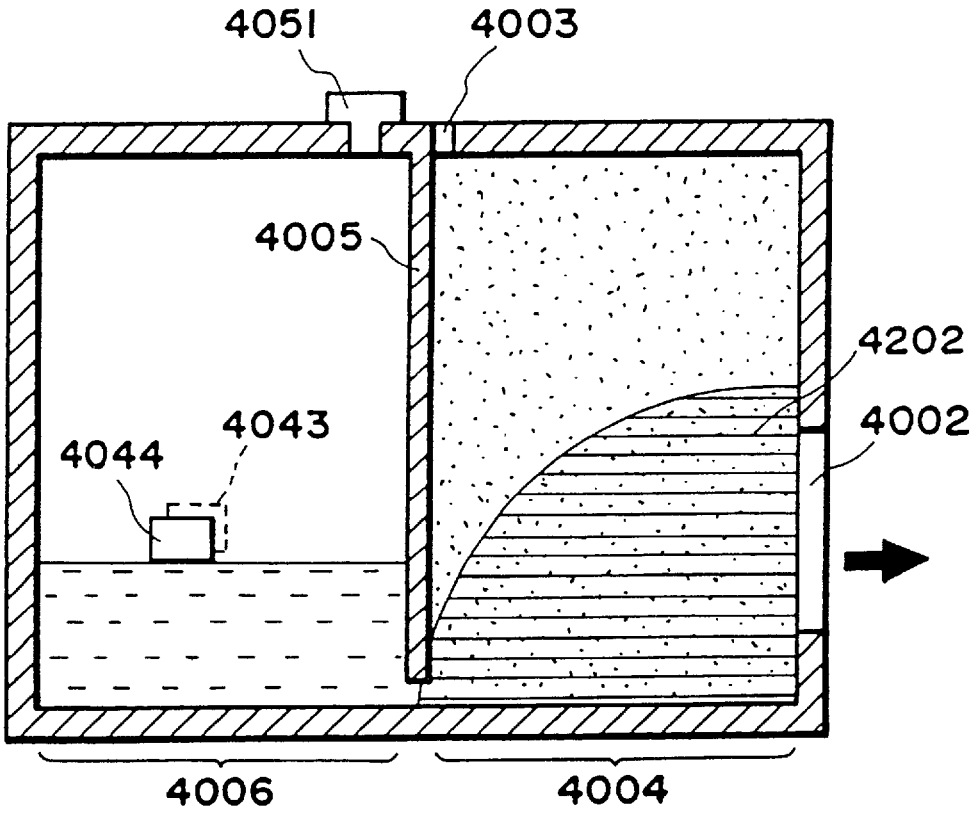

FIGS. 63A and 63B show a modified example in which the light emitting element and the light receiving element are opposed with the ink container therebetween. FIG. 63A is a top plan view, and FIG. 63B is a cross-sectional view. In this case, the material of the ink chamber 4006 is also transparent or semi-transparent. In this example, there is no need of using the reflection plate, and the detection sensitivity is better since the light is directly received.

In the foregoing, the description has been made with respect to a single ink container, but the present invention is applicable to ink containers for a color ink jet recording apparatus operable with a plurality of recording heads for black, cyan, magenta and yellow color. Also, the present invention is usable with a single recording head capable of ejecting different color inks.

The detection threshold may be changed for the respective colors. A filter or the like may be used in accordance with the color of the ink to select a predetermined wavelength of light, and the ink remaining amount may be detected on the basis of the transmissivity of the ink.

In the foregoing, the ink container is exchangeable. However, it may also be in the form of an ink jet head cartridge having an integral recording head and ink container.

Embodiment 19

Figure 64A:
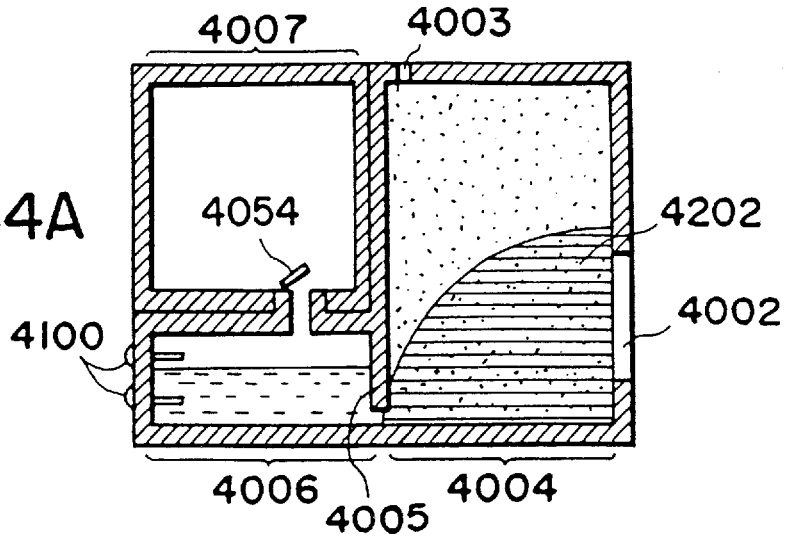
FIGS. 64A, 64B and 64C illustrate three steps in a method of ink refilling, according to a further embodiment of the present invention.
Figure 64B:
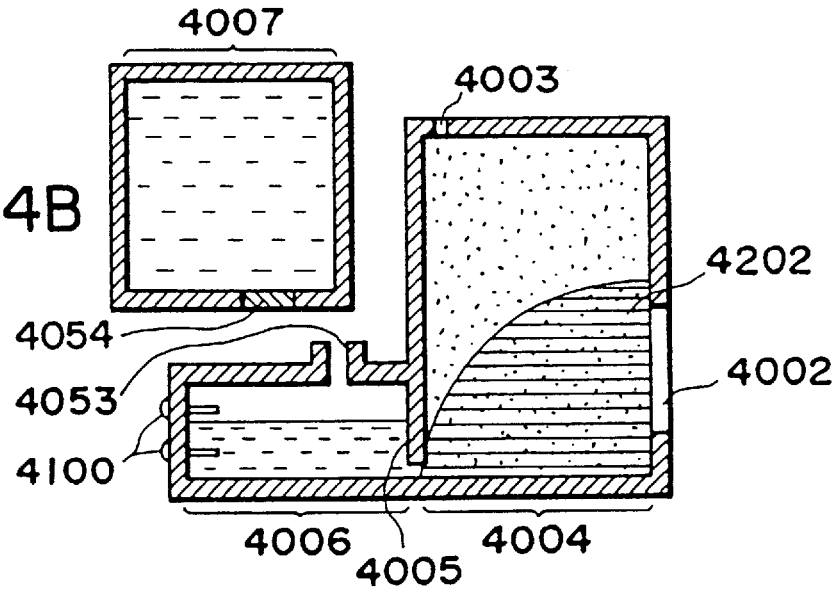
Figure 64C:
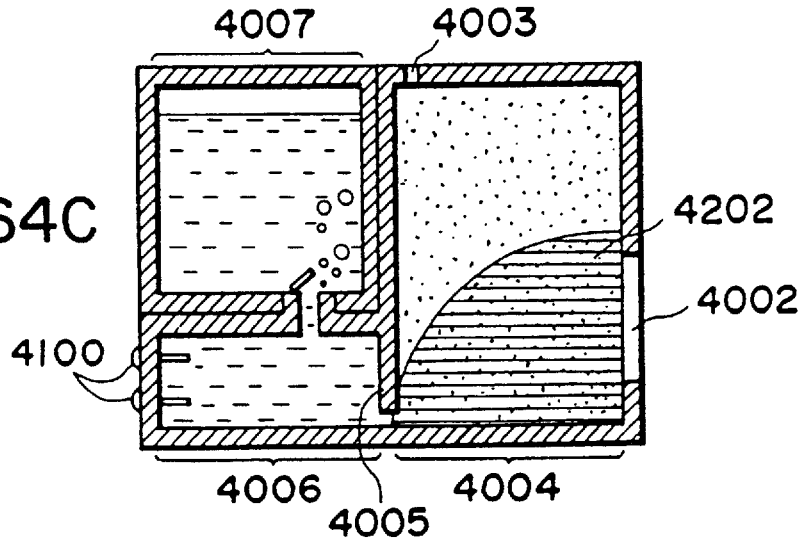

FIGS. 64A, 64B and 64C show Embodiment 19, in which the ink chamber 4006 in Embodiment 16 is divided into two parts, and one of them (ink chamber 4007) is exchangeable. FIG. 64A shows the state in which the remaining amount detector is actuated as a result of the ink consumption. In this case, a fresh ink chamber 4007 is prepared, and replaces the ink chamber 4007. FIG. 64B shows the state in which the used-up ink chamber 4007 is removed, and a full fresh ink container is going to be mounted. In FIG. 64C, the exchange has been completed. At this time, a plug 4054 at the bottom of the ink chamber is opened by the injection port 4053 located at an upper position of the ink chamber 4006, so that the ink is supplied. By doing so, there is no need of using a pipette or injector, and therefore, the operators fingers are not contaminated. It is possible that the ink chamber 4004 and the ink chamber 4006 remain connected, so that a minimum number of parts are exchanged, which is advantageous from an economical standpoint.

In Embodiment 19, the remaining amount detector is not limited to the type using the resistance between the electrodes. It may be an optical type as in Embodiment 18, or possibly another type. A further preferable ink remaining amount detecting method is to detect whether or not there is ink liquid continuing through the communicating part between the ink chamber 4004 and the ink chamber 4006. As a structure for doing this, the electrodes 4100 may be disposed at the opposite sides of the communicating part between the ink chamber 4004 and the ink chamber 4006, respectively.

In this embodiment, the recording head and the ink container are separable. However, the recording head may be integral with the ink container including the ink chambers 4004 and 4006.

As described in the foregoing, according to Embodiments 16–19, there is provided an ink container having an ink supply portion for the recording head and an air vent, which comprises an ink supply chamber containing the ink absorbing material, at least one ink chamber for containing the ink and communicating with the ink supply chamber, in which the insufficiency of the ink is detected while a predetermined amount of the ink remains in the ink chamber, and the result of the detection is signaled to the operator. Then, the recording operation can be stopped so as to permit the ink chamber to be refilled with the ink, so that the ink container can be reused.

Composition of Inks

The inventors have investigated the properties of the ink suitably usable with the ink containers of the foregoing embodiments. The preferable ink shows stability of the air-liquid exchange portion against the vibration of the ink, and it is stabilized against ambient condition change.

The description will be made of such inks suitably usable with the ink containers of the foregoing embodiments.

The fundamental structure of the ink includes at least water, coloring material and a water-soluble organic solvent. The organic solvent is a low volatility and low viscosity material having high compatibility with water. The following are examples: amides such as dimethylformamide and dimethylacetoamide, ketones such as acetone, ethers such as tetrahydrofuran and dioxane, polyalkylene glycols such as polyethylene glycol and polypropylene glycol, alkylene glycols such as ethylene glycol, propylene glycol, butylene glycol, triethylene glycol, thiodiglycol, hexylene glycol and diethylene glycol, lower alkyl ethers of polyhydric alcohols such as ethylene glycol methyl ether, diethylene glycol monomethyl ether and triethylene glycol monomethyl ether, monohydric alcohols such as ethanol and isopropyl alcohol, and, in addition, glycerol, 1,2,6-hexanetriol, N-methyl-2-pyrrolidone, 1,3-dimethyl-2-imidazolidinone, triethanolamine, sulfolane and dimethyl sulfoxide. No particular limitation is imposed on the content of the water-soluble organic solvent. However, it may preferably be within a range of from 1 to 80% by weight. The coloring material usable with this invention may be a dye or a pigment. The dye may preferably be water-soluble acid dye, direct color, basic dye, reactive dye or the like. The content of the dye is not particularly limited, but 0.1–20% by weight on the basis of the ink total weight is preferable.

Use of surfactant is desirable to adjust the surface tension. Examples of such a surfactant used include anionic surfactants such as fatty acid salts, higher alcohol sulfuric ester salts, alkylbenzene-sulfonates and higher alcohol phosphoric ester salts, cationic surfactants such as aliphatic amine salts and quaternary ammonium salts, nonionic surfactants such as ethylene oxide adducts of higher alcohols, ethylene oxide adducts of alkylphenols, aliphatic ethylene oxide adducts, ethylene oxide adducts of higher alcohol fatty acid esters, ethylene oxide adducts of higher alkyl amines, ethylene oxide adducts of fatty acid amides, ethylene oxide adducts of polypropylene glycol, higher alcohol fatty acid esters of polyhydric alcohols and alkanolamine fatty acid amides, and amino acid- and betaine-type amphoteric surfactants. No particular limitation is imposed on such a surfactant. However, nonionic surfactants such as ethylene oxide adducts of higher alcohols, ethylene oxide adducts of alkylphenols, ethylene oxide-propylene oxide copolymers, ethylene oxide adducts of acetylene glycol are preferably used. Further, it is particularly preferred that the number of moles of added ethylene oxide in the ethylene oxide adducts should be within a range of from 4 to 20. No particular limitation is imposed on the amount of the surfactant to be added. However, it may preferably be within a range of from 0.01 to 10% by weight. The surface tension may be controlled by the above-described water-soluble organic solvent.

In addition to the above components, the first liquid may contain additives such as viscosity modifiers, pH adjusters, mildew proofing agents or antioxidants, as needed.

The viscosity of the ink is 1–20 cp. The surface tension should be 20 dyne/cm–55 dyne/cm. Further preferably, it is 25–50 dyne/cm. If the surface tension of the ink is within this range, breakage of the meniscus of the recording head orifice is avoided, so that no ink is leaked out from the head orifice when the printing operation is not carried out.

The quantity of the ink contained in the ink cartridge may be properly determined up to the limit of its inside volume. In order to maintain the vacuum immediately after the ink cartridge is unpacked, the ink may be filled to its limits. However, the quantity of the ink in the vacuum producing material may be lower than the ink retaining capacity of the vacuum producing material. Here, the ink retaining capacity is the amount of the ink capable of being retained in the individual material.

The inks according to the embodiments of the present invention and the comparison examples will be described.

A mixture of water and water-soluble organic solvent was stirred with a dye for four hours, and thereafter, a surfactant was added thereto. Then, it was passed through a filter to remove foreign matter. The ink has been supplied in the ink cartridge of FIG. 1, and the recording operation carried out in the recording apparatus of FIG. 4.

The following is the composition, nature of the ink and the result of recording therewith.

| | Ex. 1 | Ex. 2 | Ex. 3 | Ex. 4 |
|---|---|---|---|---|
| diethylene glycol | 15% | 10% | 10% | 10% |
| cyclohexanol | | | | 2% |
| glycerol | | 5% | | |
| thiodiglycol | | | 5% | 5% |
| SURFRON S-145 (fluorinated surfactant) | | 0.1% | | |
| ACETYLENOL EH (acetylene glycol-ethylene oxide adducts) | 2% | | | |
| dyestuff | 2.5% | 2.5% | 0.2% | 2.5% |
| water | rest | rest | rest | rest |
| [surface tension] | [31 dyne/cm] | [25 dyne/cm] | [40 dyne/cm] | [40 dyne/cm] |

Clear color images have been recorded, and the ink in the cartridge has been used up without trouble, for all of Examples 1–4.

| | Comp. Ex. 1 | Comp. Ex. 2 |
|---|---|---|
| diethylene glycol | 15% | |
| glycerol | | 5% |
| thiodiglycol | | 5% |
| SURFLON S-145 (fluorinated surfactant) | 0.1% | |
| ACETYLENOL EH (acetylene glycol-ethylene oxide adducts) | | |
| dyestuff | 2.5% | 2.5% |
| water | rest | rest |
| [surface tension] | 17.6 dyne/cm Clear color images have been formed. The ink has dropped out from the head by small impact. | 57.4 dyne/cm Bleeding has occurred between colors. The ink has dropped out from the head by small impact. |

The yellow dye was Acid Yellow 23, the cyan dye was Acid Blue 9, the magenta dye was Acid Red 289, and the black dye was Direct Black 168.

The surface tension was measured at 25° C. through using the Wilhelmy method.

The following is the surface potential at 20–25° C. of typical water-soluble organic solvents:

Ethanol (22 dyne/cm), isopropanol (22 dyne/cm), cyclohexanol (34 dyne/cm), glycerin (63 dyne/cm), diethyleneglycol (49 dyne/cm), diethyleneglycol monomethylether (35 dyne/cm), triethyleneglycol (35 dyne/cm), 2-pyrrolidone (47 dyne/cm)), N-methylpyrrolidone (41 dyne/cm).

The desirable surface tension can be provided by mixture with water.

The method of controlling the ink surface tension using surfactant will be described.

For example, 28 dyne/cm of the surface tension can be provided by addition of 1% of sorbitan monolaurate ester on the basis of water; 35 dyne/cm can be provided by addition of 1% of polyoxyethylene-sorbitan monolaurate ester; 28 dyne/cm can be provided by addition of not less than 1% of ACETYLENOL EH (acetylene glycol-ethylene oxide adducts). If a lower surface tension is desired, 17 dyne/cm provided by addition of 0.1% of SURFLONS-145 (perfluoroalkyl-ethylene oxide adducts) (available from Asahi Glass Kabushiki Kaisha, Japan). The surface tension may be slightly varied using other additives, and therefore, proper adjustment can be done by those skilled in the art.

As described in the foregoing, the ink buffer is designed in accordance with the maximum leaking ink quantity. It has been found that the ink buffering effect is significantly influenced by the composition of the ink.

The following is a comparison example.

| Comp. Ex. 3 | |
|---|---|
| dye | 4 parts |
| glycerol | 7.5 parts |
| thiodiglycol | 7.5 parts |
| urea | 7.5 parts |
| pure water | 73.5 parts |

When the ink is pushed from the ink chamber 3006 into the ink chamber 3004 due to the expansion of the air in the ink chamber 3006 due to a pressure reduction or temperature rise, as shown in FIG. 46, the problem occurs that the ink is not absorbed by the absorbing material and is leaked through the air vent 3003 or the like through the clearance between the container wall and the absorbing material.

The ink for the ink jet recording containing surfactant has been proposed. The ink is advantageous in that the fixing property is very good for a copy sheet, bond sheet or another plain paper, and in that improper color mixing (bleed or the like) does not occur even when different color ink recording regions are close in the color recording, and therefore, uniform coloring is possible. The following is an example of the composition:

| Ex. 5 | |
|---|---|
| dye | 4 parts |
| glycerol | 7.5 parts |
| thiodiglycol | 7.5 parts |
| acetylene glycol-ethyl oxide adducts (m + n = 10) | 5 parts |
| urea | 7.5 parts |
| pure water | 68.5 parts |

When such an ink is used, the ink does not leak out of the ink cartridge because the ink is absorbed by the absorbing material 2003 in the ink chamber 2004 when the ink is pushed out of the ink chamber 2006 into the ink chamber 2004 due to the expansion of the air in the ink chamber 2006 due to a temperature rise or a pressure reduction in the atmosphere, as shown in FIG. 34.

As described hereinbefore, the air-liquid interface of the ink in the ink chamber 2004 when the ink is supplied from the ink chamber 2006, is maintained at a height where the static head from the ejection part of the recording head, the vacuum in the ink chamber 2006 and the capillary force of the compressed ink absorbing material are in balance. It is assumed that the average ink height of the air-liquid interface in the ink chamber 2004 at this time is H. When the ink is flowed out from the ink chamber 2006 due to an atmospheric pressure reduction or temperature rise, the height of the air-liquid interface of the ink chamber 2004 is desirably maintained further higher by h. In an example of this embodiment, the total height in the ink chamber is 3 cm, and the ink chamber 2004 and the ink chamber 2006 each have a volume of 6 cc, respectively. At the time of the initial stage, the ink chamber 2006 is completely filled (6 cc), and the ink chamber 2004 containing the compressed absorbing material 2003 (polyurethane foamed material) contains 4 cc ink (ink total: 10 cc). The porosity of the absorbing material is not less than 95%, and if it is assumed that the ink is completely contained in the all of the pores of the absorbing material, the ink chamber 2004 is capable of containing approx. 6 cc. The ink is first consumed from the ink chamber 2004, and a while after, the ink starts to be consumed from the ink chamber 2006. The air-liquid interface of the ink chamber 2004 is maintained at the level where the static head of the ejection part of the recording head, the vacuum in the ink chamber 2006 and the capillary force of the compressed ink absorbing material are balanced. On the average, the level of the air-liquid interface at this time is approx. 1.5 cm. If it is assumed that all of the pores of the absorbing material contain the ink, the quantity of the ink in the ink chamber 2004 is approx. 3 cc. Here, the maximum pressure reduction of the atmosphere is 0.7 atm, meaning that 1.8 cc of the ink which is approx. 30% of the volume of the ink chamber 2006, can be overflowed. Therefore, the ink chamber 2004 preferably absorbs and retains approx. 3 cc+1.8 cc (ink level of approx. 2.4 cm). When the maximum reduced pressure is 0.5 atm, 3 cc of the ink which is approx. 50% of the volume of the ink chamber 2006 can be overflowed, and therefore, the ink chamber 2004 can absorb and retain approx. 3 cc+3 cc (ink liquid surface height of approx. 3 cm). Therefore, the ink chamber 2004 has a large enough volume to contain the volume of the absorbing material, the volume of the ink retained in the ink chamber 2004 and the volume of the ink overflowed from the ink chamber 2006. Therefore, the desired volume of the ink chamber 2004 is influenced by the estimation of the ink overflow volume from the ink chamber 2006.

The retaining ink height H of the porous absorbing material is generally expressed by a capillary force equation, as follows:

$$H=2\gamma \cos \Theta/\rho g r$$

where $\gamma$ is the surface tension of the ink, $\Theta$ is the contact angle between the ink and the ink absorbing material, $\rho$ is the density of the ink, g is the force of gravity, and r is an average pore radius of the ink absorbing material.

It will be understood that in order to increase the ink retention capacity by increasing the height H, it is considered that the surface tension of the ink is increased, or the contact angle between the ink and the ink absorbing material is decreased ($\cos \Theta$ is increased).

As regards the increase of the ink surface tension, the ink of comparison example 3 has a relatively high surface tension (50 dyne/cm). However, as described hereinbefore, the ink has not been absorbed properly by the ink absorbing material. As regards the reduction of the contact angle $\Theta$ between the ink and the ink absorbing material, this entails increasing the wettability of the ink to the absorbing material. In order to accomplish this, surfactant is used.

In the case of Example 5 ink, the surface tension is small (30 dyne/cm) because of the addition of the surfactant, but the wettability between the absorbing material and the ink is improved. By doing so, it is more effective to improve the wettability of the ink than to increase the surface tension in order to improve the permeability.

For the purpose of comparison with regard to ink permeability, the compressed absorbing material (polyurethane foam material) was immersed in the Comparison Example 3 ink and the Example 5 ink, and the height of ink absorption was measured. The Comparison Example 3 ink hardly absorbed the ink (several mm), whereas the Example 5 ink was absorbed to a height of not less than 2 cm. It will be understood that an ink having improved permeability due to containing surfactant, as in the case of Example 5, can be sufficiently absorbed even when the ink is overflowed from the ink chamber due to a pressure reduction or temperature rise.

The preferable penetrating agents include anionic surfactants such as an OT type aerosol, sodium dodecylbenzenesulfonate, sodium laurylsulfate, higher alcohol-ethylene oxide adducts represented by general Formula [1], alkylphenol-ethylene oxide adducts represented by general Formula [2], ethylene oxide-propylene oxide copolymer represented by general Formula [3] and acetylene glycol-ethylene oxide adducts represented by general Formula [4].

The anionic surfactant has stronger foam producing tendency, and is poorer in the bleeding, color uniformity and feathering or the like than the nonionic surfactant; nonionic surfactants represented by the following formulas are used.

Here, n is preferably 6–14, and R preferably has 5–26 carbon atoms, in Formula [1] and [2]; m+n is preferably 6–14 in Formulas [3] and [4].

$$R_O_{}_{Error!}CH_2CH_2O_{Error!Error!}\text{-}H \quad [1]$$

where R is alkyl,

[2]

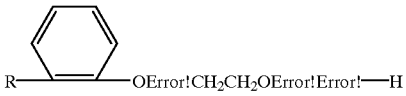

where R is alkyl, [3]

where R is hydrogen or alkyl, [4]

where m and n are respectively an integer.

Among the ethylene oxide nonionic surfactants, acetylene glycol-ethylene oxide adducts are preferable from the standpoint of absorption in the ink absorbing material, image quality on the recording material and overall ejection performance. The hydrophilic property and penetrating property can be controlled by changing the number m+n of ethylene oxides to be added. If it is smaller than 6, the penetrating property is good, but water solution nature is not good, and therefore, the solubility in water is not good. If it is too large, the hydrophilic property is too strong, and the penetrating property is too small. If it is larger than 14,the penetrating property is insufficient, and the ejection property is deteriorated. Therefore it is preferably 6–14.

The amount of the nonionic surfactant is preferably 0.1–20% by weight. If it is lower than 0.1%, the image quality and the penetrating property are not sufficient. If it is larger than 20%, no improvement is expected, the cost increases, and the reliability decreases.

One or more of the above described surfactants are usable in combination.

The ink may contain dye, a low volatility organic solvent such as polyhydric alcohols to prevent clogging, or an organic solvent such as alcohols to improve bubble creation stability and fixing property on the recording material.

The water-soluble organic solvents constituting the ink of the embodiment may include polyalkylene glycols such as polyethylene glycol, and polypropylene glycol; alkylene glycols having 2 to 6 carbon atoms such as ethylene glycol, propylene glycol, butylene glycol, triethylene glycol, 1,2,6-hexanetriol, hexylene glycol, and diethylene glycol; glycerin; lower alkyl ether of polyhydric alcohols such as ethylene glycol methyl ether, diethylene glycol methyl (or ethyl) ether, and triethylene glycol monomethyl (or ethyl) ether; alcohols such as methyl alcohol, ethyl alcohol, n-propyl alcohol, isopropyl alcohol, n-butyl alcohol, sec-butyl alcohol, t-butyl alcohol, isobutyl alcohol, benzyl alcohol, and cyclohexanol; amides such as dimethylformamide, and dimethylacetamide; ketones and ketone alcohols such as acetone, and diacetone alcohol; ethers such as tetrahydrofuran, and dioxane; and nitrogen-containing cyclics such as N-methyl-2-pyrrolidone, 2-pyrrolidone, 1,3-dimethyl-2-imidazolidinone.

The water soluble organic solvent can be added without deteriorating the image quality or the ejection reliability. Preferably, it is a polyhydric alcohol or an alkyl ether of polyhydric alcohols. The content thereof is preferably 1–3% by weight. And, the pure water content is 50–90% by weight.

The dyes usable with the present invention include direct dyes, acid dyes, reactive dyes, dispersive dyes, vat dyes or the like. The content of the dye is determined depending on the kinds of the liquid components and the required properties of the ink, the ejection volume of the recording head or the like. Generally, however, it is 0.5–15% by weight, preferably 1–7% by weight.

By addition of thioglycol or urea (or derivatives thereof) in the ink, the ejection property and the clog (solidification) preventing property is remarkably improved. This is considered to be because the solubility of the dye in the ink is improved. The content of the thioglycol or urea (or the derivatives thereof) is preferably 1–3%, and may be added as desired.

The main constituents of the ink of the present invention are described above. Other additives may be incorporated provided that the objects of the invention are achievable. Such additives may include viscosity-adjusting agents such as polyvinyl alcohol, celluloses, and water-soluble resins; pH-controlling agents such as diethanolamine, triethanolamine, and buffer solutions; fungicides and so forth. To the ink of electrically chargeable type used for ink-jet recording in which the ink droplets are charged, a resistivity-adjusting agent is added such as lithium chloride, ammonium chloride, and sodium chloride.

A comparison example will be explained.

| Comp. Ex. 4 | |
|---|---|
| dye | 3 parts |
| diethyleneglycol | 5 parts |
| thioglycol | 5 parts |
| ethyl alcohol | 3 parts |
| pure water | 84 parts |

In this case, when the ink is overflowed from the ink container to the absorbing material container chamber due to the expansion of the air in the ink container due to an atmospheric pressure reduction or temperature rise, the problem arises that the ink leaks out through the air vent or the ink supply portion by way of the clearance between the container wall and the absorbing material.

An ink for an ink jet recording apparatus containing a surfactant has been proposed. Such an ink is advantageous in that the fixing speed is very high for a copy sheet, bond sheet or another plain sheet paper, and that improper color mixture (bleed or the like) does not occur, even if different color recording regions are in contact, and therefore, uniform coloring can be accomplished. Following is an example of such an ink.

| Comp. Ex. 5 | |
|---|---|
| dye | 3 parts |
| glycerol | 5 parts |
| thioglycol | 5 parts |
| ethylene oxide-propylene oxide copolymer | 3 parts |
| urea | 5 parts |
| pure water | 79 parts |

When this ink is used, the ink is absorbed by the absorbing material in the absorbing material container and does not leak out even when the ink is overflowed from the ink chamber into the absorbing material container due to the expansion of the air in the ink chamber due to an atmospheric pressure reduction or temperature increase.

As described in the foregoing, there is provided an ink cartridge comprising a supply ink chamber containing an ink absorbing material having an adjusted capillary force and one or more ink chambers, wherein the ink contains a nonionic surfactant, so that the ink does not leak out even if an ambient condition change occurs, either during recording operation or when the recording operation is not carried out, and therefore, the ink use efficiency is high.

The above-described Embodiments 1–13, are advantageous respectively, however the combination thereof is further advantageous. In addition, the combination of the process in the Embodiments 14 and 15, and the structure with Embodiments 16–19 and the above-described ink, is further preferable.

The present invention is usable with any ink jet apparatus, such as those using an electromechanical converter such as a piezoelectric element, but is particularly suited for use in an ink jet recording head and recording apparatus wherein thermal energy generated by an electrothermal transducer, laser beam or the like is used to cause a change of state of the ink to eject or discharge the ink. This is because a high density of the picture elements and a high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleation boiling point, so that the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards possible variations of the mountable recording head, it may be a single head corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below room temperature but liquefied at room temperature. Since the ink is controlled within a temperature range, not lower than 30° C. and not higher than 70° C. to stabilize the viscosity of the ink to provide the stabilized ejection in usual recording apparatus of this type, the ink may be such that it is liquid within the temperature range when the recording signal in the present invention is applicable to other types of ink. In one of them, the temperature rise due to the thermal energy is positively prevented since the energy is consumed in the state change of the ink from the solid state to the liquid state. Another ink material is solidified when it is left, to prevent the evaporation of the ink. In either of these cases, the application of the recording signal produces thermal energy, the ink is liquefied, and the liquefied ink may be ejected. Another ink material may start to be solidified at the time when it reaches the recording material. The present invention is also applicable to such an ink material as it is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for a liquid jet recording apparatus, comprising:

a first chamber containing negative pressure producing material and having a liquid outlet connectable to the liquid jet head to supply liquid from the cartridge to the liquid jet head and an air vent for allowing ambient air into the cartridge;

a second chamber communicating with the first chamber by means of a communication path, except for which said second chamber is substantially hermetically sealed;

a wall extending upwardly from the communication path in said first chamber; and ambient air introducing path provided between said wall and said negative pressure producing material and extending from a point partly up said wall toward said communication path, for introducing the ambient air into said second chamber.

2. A liquid container according to claim 1, wherein said ambient air introducing path terminates at the point, and extends to said communication path.

3. A liquid container according to claim 1, wherein said ambient air introducing path terminates at the point and terminates before said communication path.

4. A liquid container according to claim 1, wherein the point is above said liquid outlet.

5. A liquid container according to any one of claims 1 to 4, wherein said air introducing path is defined by a rib on said wall.

6. A liquid container according to any one of claims 1 to 4, wherein said air introducing path is defined by a groove in said wall.

7. A liquid container according to claim 1, wherein said liquid outlet and said air vent are sealed by one member during transportation.

8. A liquid container according to claim 1, wherein said container is of material through which inside thereof is visible.

9. A liquid container according to claim 1, wherein the liquid contained in said container is contributable to image printing, and wherein the liquid is supplied from said second chamber into said first chamber through said communication path by introduction of the air into said second chamber through said air introducing path.

10. A liquid container according to claim 1, wherein said negative pressure producing material is sponge which is not heat-compressed and is compressed into said first chamber.

11. A liquid container according to claim 1, wherein said negative pressure producing material is heat-compressed sponge.

12. A liquid container according to claim 1, wherein a path connecting said air vent and the point extends across said negative pressure producing material.

13. A liquid container according to claim 1, wherein a plurality of such air introducing paths are provided.

14. A liquid container according to claim 1, wherein said liquid container is integral with the liquid jet head.

15. A liquid container according to claim 1, wherein the container contains printing liquid.

16. A liquid container according to claim 1, wherein said first chamber contains liquid.

17. A liquid container according to claim 1, wherein said second chamber contains a liquid containing at least one type of non-ionic surfactant.

18. An ink container for containing ink to be supplied to an ink jet head, said ink container comprising:

a first chamber containing a negative pressure producing member and having an air vent for communication between an inside of said ink container and ambient air and with an ink supply port connectable to the ink jet head for supplying ink to said ink jet head;

a second chamber communicating with said first chamber by means of a communication path, except for which said second chamber is substantially hermetically sealed;

a wall extending upwardly from the communication path, for forming a partition between said first chamber and said second chamber; and an ambient air introducing path provided in a surface of said wall, the ambient air introducing path being in contact with said negative pressure producing member and extending from a point partly up said wall toward said communication path, wherein said ambient air introducing path is a recess formed in said wall having an upper portion for producing a relatively small capillary force and a lower portion for producing a relatively large capillary force.

19. An ink container for containing ink to be supplied to an ink jet head, said ink container comprising:

a first chamber containing a negative pressure producing member and having an air vent for communication between an inside of said ink container and ambient air and with an ink supply port connectable to the ink jet head for supplying ink to said ink jet head;

a second chamber communicating with said first chamber by means of a communication path, except for which said second chamber is substantially hermetically sealed;

a wall extending upwardly from the communication path, for forming a partition between said first chamber and said second chamber; and an ambient air introducing path, in the form of a recess for regulating capillary force, provided in a surface of said wall which and being in contact with said negative pressure producing member and extending from a point partly up said wall toward said communication path.

20. An ink container according to claim 19, wherein said recess has an upper portion for producing a relatively small capillary force and a lower portion for producing a relatively large capillary force.

* * * * *

UNITED STATES PATENT AND TRADEMARK OFFICE

CERTIFICATE OF CORRECTION

PATENT NO. : 6,390,578 B1
DATED : May 21, 2002
INVENTOR(S) : Noribumi Koitabashi et al.

It is certified that error appears in the above-identified patent and that said Letters Patent is hereby corrected as shown below:

Column 2,
Line 34, “in” should read -- in the --.

Column 3,
Lines 29, 33, 37, 42 and 46, “longitudinal” should read -- horizontal --.

Column 4,
Line 2, “longitudinal” should read -- horizontal --; and
Line 31, “container” should read -- cartridge --.

Column 7,
Line 9, “with” should read -- with the --.

Column 8,
Line 42, “5” should read -- 6, --.

Column 9,
Line 13, “level” should read -- levels --.

Column 10,
Line 37, “quire” should read -- quite --.

Column 12,
Line 7, “ink),” should read -- ink) expands --.

Column 16,
Line 56, “outlet 6.” should read -- outlet. --;
Line 60, “outlet” should read -- outlet 6 --; and
Line 61, “supply” should read -- supplying --.

Column 18,
Line 20, “in the partition” should read -- of the partition 1005. --.

Column 21,
Line 17, “with” should read -- under --;
Line 20, “remains in” should read -- flows out of --;
Line 24, “is” should read -- has --;
Line 26, “air” should read -- air volume --;
Line 28, “ink” should read -- ink volume --;
Line 35, “reduces” should read -- decreases --; and
Line 38, “the” (first occurrence) should read -- a --.

UNITED STATES PATENT AND TRADEMARK OFFICE

CERTIFICATE OF CORRECTION

PATENT NO. : 6,390,578 B1
DATED : May 21, 2002
INVENTOR(S) : Noribumi Koitabashi et al.

It is certified that error appears in the above-identified patent and that said Letters Patent is hereby corrected as shown below:

Column 22,
Line 28, “a” should be deleted; and
Line 43, “the to” should read -- to the --.

Column 24,
Line 58, “of” should read -- of an --.

Column 25,
Line 27, “thereafter” should read -- thereafter, --; and
Line 59, “adjacent” should read -- adjacent to --.

Column 27,
Line 49, “leading” should read -- leaking --; and
Line 66, “3004” should read -- 3008 --.

Column 29,
Line 2, “or” should read -- or a --.

Column 31,
Line 66, “with” should read -- with a --.

Column 38,
Lines 32 through 44,

“R_O_*Error!*$CH_2$ $CH_2O$*Error!Error!*-H [1]

where R is alkyl,

[2]

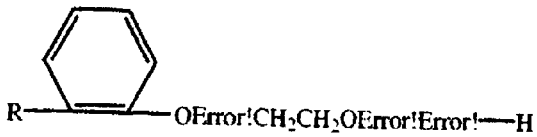

where R is alkyl, [3]

where R is hydrogen or alkyl, [4]”

UNITED STATES PATENT AND TRADEMARK OFFICE

CERTIFICATE OF CORRECTION

PATENT NO. : 6,390,578 B1 
DATED : May 21, 2002
INVENTOR(S) : Noribumi Koitabashi et al.

It is certified that error appears in the above-identified patent and that said Letters Patent is hereby corrected as shown below:

Column 38 (cont'd),
should read

--

$$R\text{-}O\text{-}(CH_2CH_2O)_n\text{-}H \qquad [1]$$

where R is alkyl,

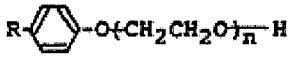

[2]

where R is alkyl, $$H\text{-}(CH_2CH_2O)_m\text{-}(CH(CH_3)\text{-}CH_2O)_n\text{-}R \qquad [3]$$

where R is hydrogen or alkyl,

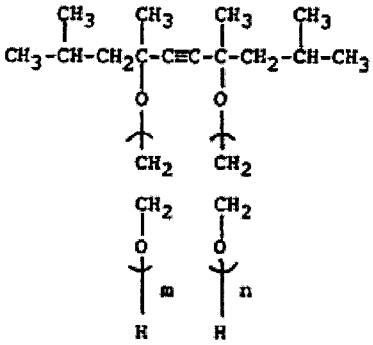

[4]

Signed and Sealed this

Thirteenth Day of May, 2003

JAMES E. ROGAN
*Director of the United States Patent and Trademark Office*